US005597993A

United States Patent [19]

Yorita et al.

[11] Patent Number: 5,597,993

[45] Date of Patent: Jan. 28, 1997

[54] VACUUM INTERRUPTER

[75] Inventors: Mitsumasa Yorita, Marugame; Hideaki Toya, Amagasaki; Hiroshi Hasegawa, Marugame; Kenichi Koyama, Amagasaki, all of Japan

[73] Assignee: Mitsubishi Denki Kabushiki Kaisha, Tokyo, Japan

[21] Appl. No.: 475,333

[22] Filed: Jun. 7, 1995

Related U.S. Application Data

[62] Division of Ser. No. 145,743, Nov. 4, 1993, Pat. No. 5,495,085.

[30] Foreign Application Priority Data

| | | | |
|---|---|---|---|
| Nov. 10, 1992 | [JP] | Japan | 4-326090 |
| Nov. 10, 1992 | [JP] | Japan | 4-326092 |
| Nov. 19, 1992 | [JP] | Japan | 4-335146 |
| Nov. 19, 1992 | [JP] | Japan | 4-335147 |
| Jul. 5, 1993 | [JP] | Japan | 5-165429 |
| Jul. 5, 1993 | [JP] | Japan | 5-165430 |
| Jul. 22, 1993 | [JP] | Japan | 5-181300 |
| Jul. 22, 1993 | [JP] | Japan | 5-181301 |
| Oct. 29, 1993 | [JP] | Japan | 5-271959 |

[51] Int. Cl.[6] ..... H01H 33/66; H01H 1/06

[52] U.S. Cl. ..... 218/129

[58] Field of Search ..... 218/121, 123, 218/124, 125, 127, 128, 129, 130, 118–120, 131–136; 200/275, 279

[56] References Cited

U.S. PATENT DOCUMENTS

| | | | |
|---|---|---|---|
| 3,089,936 | 5/1963 | Smith, Jr. | 218/128 |
| 3,405,300 | 10/1968 | Wasa et al. | 313/161 |

(List continued on next page.)

FOREIGN PATENT DOCUMENTS

| | | | |
|---|---|---|---|
| 0113962 | 7/1984 | European Pat. Off. | H01H 33/66 |
| 0192251 | 8/1986 | European Pat. Off. | H01H 33/66 |
| 0199593 | 10/1986 | European Pat. Off. | H01H 33/66 |
| 3510981 | 10/1985 | Germany | H01H 33/66 |
| 3610245 | 10/1987 | Germany | H01H 33/66 |
| 4013903 | 11/1990 | Germany | H01H 33/66 |
| 50-52562 | 5/1975 | Japan | H01H 33/66 |
| 57-76713 | 5/1982 | Japan | H01H 33/66 |
| 61-195528 | 8/1986 | Japan | H01H 33/66 |
| 2111309 | 6/1983 | United Kingdom | H01H 33/66 |
| 2231723 | 11/1990 | United Kingdom | H01H 33/66 |

OTHER PUBLICATIONS

*Physics and Applications of Pseudosparks*, edited by M. A. Gundersen et al. (Plenum Press, New York, 1990), p. 6.

J. Christiansen et al., "Comparison of Electrode Effects in High–Pressure and Low–Pressure Gas Discharges Like Spark–Gap and Pseudospark Switch", *Physics and Applications of Pseudosparks*, edited by M. A. Gundersen et al. (Plenum Press, New York 1990), pp. 89–93.

(List continued on next page.)

*Primary Examiner*—J. R. Scott

*Attorney, Agent, or Firm*—Burns, Doane, Swecker & Mathis, LLP

[57] ABSTRACT

A vacuum interrupter comprising each electrode assembly of a pair of electrode assemblies having substantially the same structure and arranged in an evacuated envelope in opposed relationship adapted to be connected with or disconnected from each other. Each electrode assembly includes a coil electrode having a plurality of arms extending outwardly from a center ring shaped holding part and a plurality of arc-shaped coil parts formed substantially along the same circumference of the coil electrode and connected to respective ones of the arms, a main electrode including an arc-shaped arm electrically connected to each arc-shaped coil part of the coil electrode, the coil parts being in contact with corresponding ones of the arc-shaped arms along entire surfaces thereof, and a first arm connected to each of the arc-shaped arms of the main electrode and extended substantially toward a center of the main electrode in the radial direction. The first arms of one of electrode assemblies are arranged in substantially the same direction as the direction of first arms in the other electrode assembly arranged in opposed relationship to the electrode assembly.

3 Claims, 55 Drawing Sheets

U.S. PATENT DOCUMENTS

| | | | |
|---|---|---|---|
| 3,517,256 | 6/1970 | Barbini | 315/155 |
| 3,522,399 | 7/1970 | Crouch | 218/128 |
| 3,811,070 | 5/1974 | Voshall | 315/150 |
| 3,946,179 | 3/1976 | Murano et al. | 218/129 |
| 3,980,850 | 9/1976 | Kimblin | 218/127 |
| 4,152,625 | 5/1979 | Conrad | 315/111.71 |
| 4,336,430 | 6/1982 | Kurosawa et al. | 218/129 |
| 4,430,536 | 2/1984 | Kurosawa et al. | 218/127 |
| 4,453,054 | 6/1984 | Peche et al. | 218/128 |
| 4,473,731 | 9/1984 | Yorita | 218/123 |
| 4,512,867 | 4/1985 | Andreev et al. | 204/298.41 |
| 4,553,002 | 11/1985 | Slade | 218/128 |
| 4,584,445 | 4/1986 | Kashiwagi et al. | 218/130 |
| 4,588,879 | 5/1986 | Noda et al. | 218/127 |
| 4,667,070 | 5/1987 | Zuckler | 218/129 |
| 4,931,702 | 6/1990 | Voronin et al. | 315/344 |
| 4,935,588 | 6/1990 | Hess et al. | 218/123 |
| 4,978,893 | 12/1990 | Brannon et al. | 315/150 |
| 5,055,639 | 10/1991 | Schels et al. | 218/129 |
| 5,495,085 | 2/1996 | Yorita et al. | 218/123 |

OTHER PUBLICATIONS

G. Kirkman et al., "Recent Experimental Studies of the BLT Switch", *Digest of Technical Papers*, 7th IEEE Pulsed Power Conference, Monterey, CA Jun. 11–14, 1989, pp. 1–4.

*Patent Abstracts of Japan*, vol. 16, No. 91 (E–1174), Mar. 5, 1992, JP–A–03 272 530.

*Patent Abstracts of Japan*, vol. 17, No. 608, (E–1457), Nov. 9, 1993, JP–A–05 190 062.

VACUUM INTERRUPTER

This application is a divisional, of application Ser. No. 08/145,743, filed Nov. 4, 1993, now U.S. Pat. No. 5,495,085.

FIELD OF THE INVENTION AND RELATED ART STATEMENT

1. Field of the Invention

The present invention relates generally to a vacuum interrupter which is used in a vacuum circuit breaker or the like, and more particularly to a vacuum interrupter having an electrode-structure which generates a magnetic field in the direction parallel to an electric arc generated after disconnection of the vacuum interrupter.

2. Description of the Related Art

In a vacuum interrupter for interrupting a heavy-current In an evacuated envelope, diffusion of an arc generated after disconnection operation of the vacuum interrupter has been studied in order to improve the interruption characteristic thereof. The diffusion of the arc is performed by a magnetic field which is generated by an arc current flowing after the disconnection operation. A conventional vacuum interrupter comprising such an arc diffusion means is elucidated hereafter with reference to FIGS. 57, 58 and 59.

FIG.57 is a cross-section of a side view showing schematic structure of the conventional vacuum interrupter. Referring to FIG.57, an evacuated envelope 4 is composed of a cylindrical insulating container 1 and end plates 2 and 3 for sealing both ends of the insulating container 1. A disc-shaped stationary electrode assembly 6 connected to a stationary electrode rod 5 and a disc-shaped movable electrode assembly 7 connected to a movable electrode rod 8 are arranged in opposed relationship in the evacuated envelope 4. The movable electrode assembly 7 is constructed so as to connect or disconnect with respect to the stationary electrode assembly 6 by an operation mechanism (not shown) connected mechanically to the movable electrode rod 8. A bellows 10 is disposed between the end plate 8 and the movable electrode rod 8, and thereby air-tightness of the evacuated envelope 4 is maintained and the movable electrode rod 8 is permitted to move in the axial direction (upward or downward in FIG. 57). Moreover, a shield 9 is arranged in a manner of surrounding the stationary electrode assembly 6 and the movable electrode assembly 7 in the evacuated envelope 4.

In a conventional vacuum circuit breaker having the vacuum interrupter constructed as mentioned above, when a disconnecting instruction is inputted to the vacuum circuit breaker, the movable electrode assembly 7 is disconnected from the stationary electrode assembly 6 by activation of the operation mechanism. At the instant, an arc A is generated between the stationary electrode assembly 6 and the movable electrode assembly 7, and an arc current flows across the stationary electrode assembly 6 and the movable electrode assembly 7. A magnetic field in the axial direction is generated between the stationary electrode assembly 6 and the movable electrode assembly 7 by controlling a direction of the arc current flowing across the stationary electrode assembly 6 and the movable electrode assembly 7. The magnetic field in the axial direction serves to diffuse a plasma arc produced between both the electrode assemblies onto entire surfaces of the stationary electrode assembly 6 and the movable electrode assembly 7 which are arranged in opposed relationship. An arc voltage across the stationary electrode assembly 6 and the movable electrode assembly 7 is decreased by diffusing the plasma arc during the disconnection operation, and a temperature rise in both the electrode assemblies is significantly suppressed.

An example of the conventional vacuum interrupter having the electrode-structure for generating the magnetic field is shown in the U.S. Pat. No. 4,473,731.

FIG. 58 is an exploded perspective assembly view of a movable electrode assembly 7 in the vacuum interrupter of the U.S. Pat. No. 4,473,731, and FIG. 59 is a plan view of the movable electrode assembly 7 shown in FIG. 58. Referring to FIG. 58, a movable electrode 21 is mounted on the top of a movable electrode rod 8 through a short circuit member 22, and is supported at the central part by a support member 23 which is made of high resistance material and fixed on the movable electrode rod 8. Four arms 21*a* are formed on the peripheral portion of the movable electrode 21 along the circumference thereof. On the other hand, four arms 22*a* extending in radial directions are formed on the short circuit member 22. The ends of the arms 22*a* of the short circuit member 22 contact the respective arms 21*a* of the movable electrode 21, and the movable electrode 21 is electrically connected to the short circuit member 22.

The movable electrode assembly 7 comprising the movable electrode 21, the movable electrode rod 8, the short circuit member 22 and the support member 23 shown in FIG. 58 is arranged in the evacuated envelope 4 in opposed relationship to the stationary electrode assembly 6 as shown in FIG. 57.

Referring to FIG. 59, current paths of the arc current are illustrated by arrows. The arc current flows from the central part P of the movable electrode 21 to the connection parts of the arms 21*a* in the radial direction as shown by arrows X, and passes through the arms 21*a* along the circumference of the movable electrode 21 as shown by arrows Y. Subsequently, the arc current flows to the movable electrode rod 8 through the arms 22*a* of the short circuit member 22 in the radial directions as shown by arrows Z. Consequently, four fan-shaped current paths are formed as shown in the plan view of FIG. 59, and magnetic fields in the axial direction are generated in these fan-shaped regions by the known right-handed screw rule. The plasma arc produced between the stationary electrode assembly 6 and the movable electrode assembly 7 is diffused by the magnetic field. The intensity of the magnetic field in the fan-shaped region is larger than that in the region between neighboring two fan-shaped regions. Therefore, the intensity of the magnetic field is not uniform between the stationary electrode assembly 6 and the movable electrode assembly 7, and the plasma arc is not effectively diffused owing to the lack of uniformity of the magnetic field.

OBJECT AND SUMMARY OF THE INVENTION

An object of the present invention is to provide a vacuum interrupter in which a uniform magnetic field is generated between a stationary electrode and a movable electrode by guiding an arc current along full circumference of the stationary electrode and the movable electrode.

The vacuum interrupter in accordance with the present invention comprises:

a first electrode assembly and a second electrode assembly respectively having substantially the same structure arranged in an evacuated envelope in mutually opposed relationship by respective electrode rods in a manner to connect or disconnect with each other; each electrode assembly comprising;

a connecting conductor having a holding part electrically connected to the electrode rod and an arm part extended from the holding part in the radial direction, a coil electrode having a ring-shaped coil part with a cut-part cut out a part of the circumference and electrically connected to the arm part at an end adjacent to the cut-part of the ring-shaped coil part, and a disc-shaped main electrode mounted on a surface of the coil electrode in a manner of facing the other electrode assembly, having at least one slot formed in a radial direction directed to the cut-part of the coil electrode and passing through the central part of a surface of the disc-shaped main electrode opposing to the other electrode assembly, the cut-part of the coil electrode of the first electrode assembly being opposed to the cut-part of the coil electrode of the second electrode assembly, and a position connecting between the coil part and the arm part in the first electrode assembly being arranged in point symmetry with respect to the position connecting between the coil part and the arm part in the second electrode assembly.

The vacuum interrupter in accordance with the present invention has the following technical advantage as a result of the above-mentioned configuration:

in the vacuum interrupter of the embodiments shown in FIGS. 1–9, a current at generation of an arc is made to flow along a substantially arc-shaped path at each electrode by forming slots on the mutually opposed surfaces of the main electrodes and coil electrodes. Consequently, a uniform magnetic field of the axial direction is generated between both the electrodes arranged in mutually opposed relationship, by a rather simple configuration, and thereby a plasma arc generated between both the electrodes is effectively diffused and distinguished, and the vacuum interrupter having superior disconnection characteristic can be provided.

According to the configuration of the vacuum interrupter of the embodiments shown in FIGS. 10–15, the coil part arranged along the circumference of the coil electrode is protruded to the back surface of the main electrode and contacts the main electrode Therefore, the magnetic field in the axial direction of the coil electrode is enhanced, and leak of magnetic flux decreases. Consequently, suitable distribution of the magnetic field is realizable, and the arc in disconnection operation is effectively diffused. And thereby the vacuum interrupter having a superior disconnection characteristic can be provided. Moreover, the vacuum interrupter which is superior in mechanical strength of the coil electrode can be provided.

According to the configuration of the vacuum interrupter of the embodiments shown in FIGS. 16–22, since a direction extending the arm part of the coil electrode is substantially in coincidence with the direction of the current flowing through the main electrode in the radial direction at generation of the arc, a uniform magnetic field is generated between both electrodes in the axial direction in a disconnection operation. Consequently, the plasma arc is effectively diffused, and thereby the vacuum interrupter which is superior in the disconnection characteristic can be provided.

According to the configuration of the vacuum interrupter of the embodiments shown in FIGS. 23–29, in a stationary main electrode and a movable main electrode arranged in opposed relationship, respective currents in the radial direction are made to flow in opposing positions of both the electrodes so that the flowing directions are substantially reverse with each other. Consequently, the plasma arc in disconnection operation is effectively diffused, and the vacuum interrupter having a superior disconnection characteristic can a be provided.

According to the configuration of the vacuum interrupter of the embodiments shown in FIGS. 39–42, since the magnetic field in the axial direction having a sufficient intensity to maintain diffusion of the arc is generated on the entire surface of the main electrode on which the arc generates, concentration of the arc in a limited part is prevented. Consequently, the arc is uniformly diffused on the entire surfaces, and the disconnection characteristic is improved.

According to the configuration of the vacuum interrupter of the embodiments shown in FIGS. 43–48, since a high resistance region is disposed in the good conductor placed on the back surface of the main electrode, an eddy current flowing the good conductor is reduced. Consequently, the intensity and distribution of the magnetic field in the axial direction which is generated by the coil part is effectively improved.

According to the configuration of the vacuum interrupter of the embodiments shown in FIGS. 49–56, since a coil cover covers a part having a high electric potential such as an arc-shaped part and a slit part of the coil electrode which deteriorates a withstand voltage characteristic, the part is not exposed between both the main electrodes, and thus the withstand voltage characteristic of the electrodes is totally improved.

BRIEF DESCRIPTION OF THE DRAWINGS

FIG. 11(*b*) is a cross-section of the electrode assembly in the fourth embodiment;

FIG. 12(*b*) is a perspective view of an electrical conducting member in the fifth embodiment;

FIG. 12(*c*) is a cross-section of the electrode assembly in the fifth embodiment;

FIG. 13(*b*) is a cross-section of the electrode assembly of the sixth embodiment;

FIG. 14(*b*) is a cross-section of the example of the electrode assembly in the sixth embodiment;

FIG. 39(*b*) is plan view of the electrode of the vacuum interrupter shown in FIG. 39;

FIG. 40(*b*) is a distribution diagram of a magnetic field between the electrode assemblies in FIG. 40(*a*);

FIG. 42(*b*) is a plan view of the electrode assembly in the seventeenth embodiment;

FIG. 43(*b*) is a plan view of the electrode assembly as shown in FIG. 43(*a*);

FIG. 43(*c*) is a cross-section of the electrode assembly as shown in FIG. 48(*a*);

FIG. 44(*b*) is a cross-section of the electrode assemblies of the vacuum interrupter in the eighteenth embodiment;

FIG. 50(*b*) is cross-section of the electrode assembly which is used to describe the operation of the electrode assembly;

FIG. 52(*b*) is a cross-section of the electrode assembly in the twenty-second and twenty-third embodiments;

FIG. 53(*b*) is a cross-section of another example of the electrode assembly in the twenty-second and twenty-third embodiments;

FIG. 54(*b*) is a plan view of the further example of the electrode assembly in the twenty-second and twenty-third embodiments;

FIG. 54(*c*) is a side view of further example of the electrode assembly in the twenty-second and twenty-third embodiments;

FIG. 56(*b*) is a plan view of the electrode assembly in the twenty-fifth embodiment:

FIG. 56(*c*) is an exploded perspective assembly view of the electrode assembly in the twenty-fifth embodiment.

DESCRIPTION OF THE PREFERRED EMBODIMENT

[First embodiment]

Hereafter, a first embodiment of the vacuum interrupter is elucidated with reference to drawings.

Figure 1:
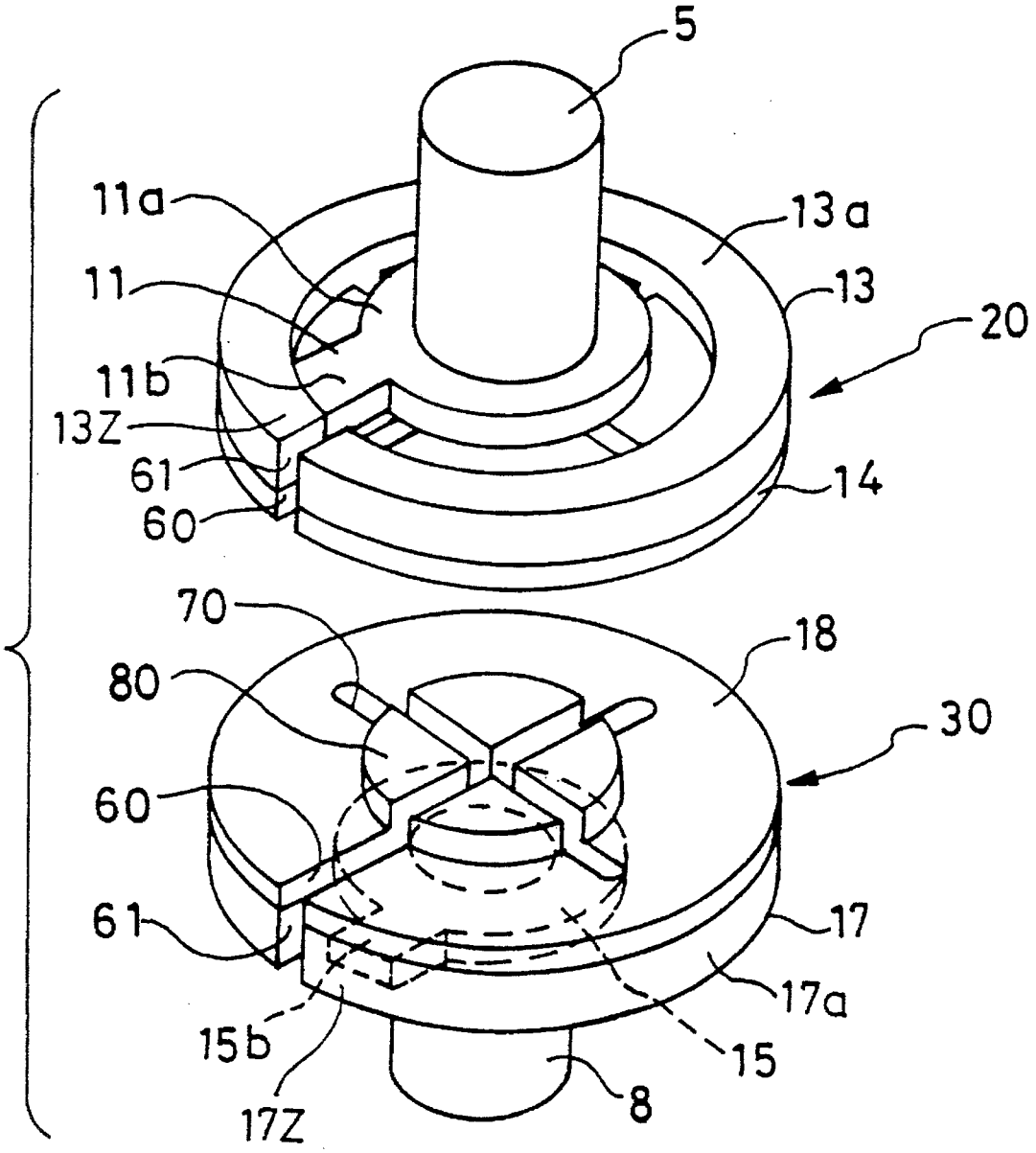
FIG. 1 is a perspective view of a stationary electrode assembly and a movable electrode assembly of a vacuum interrupter in a first embodiment in accordance with the present invention.
Figure 2:
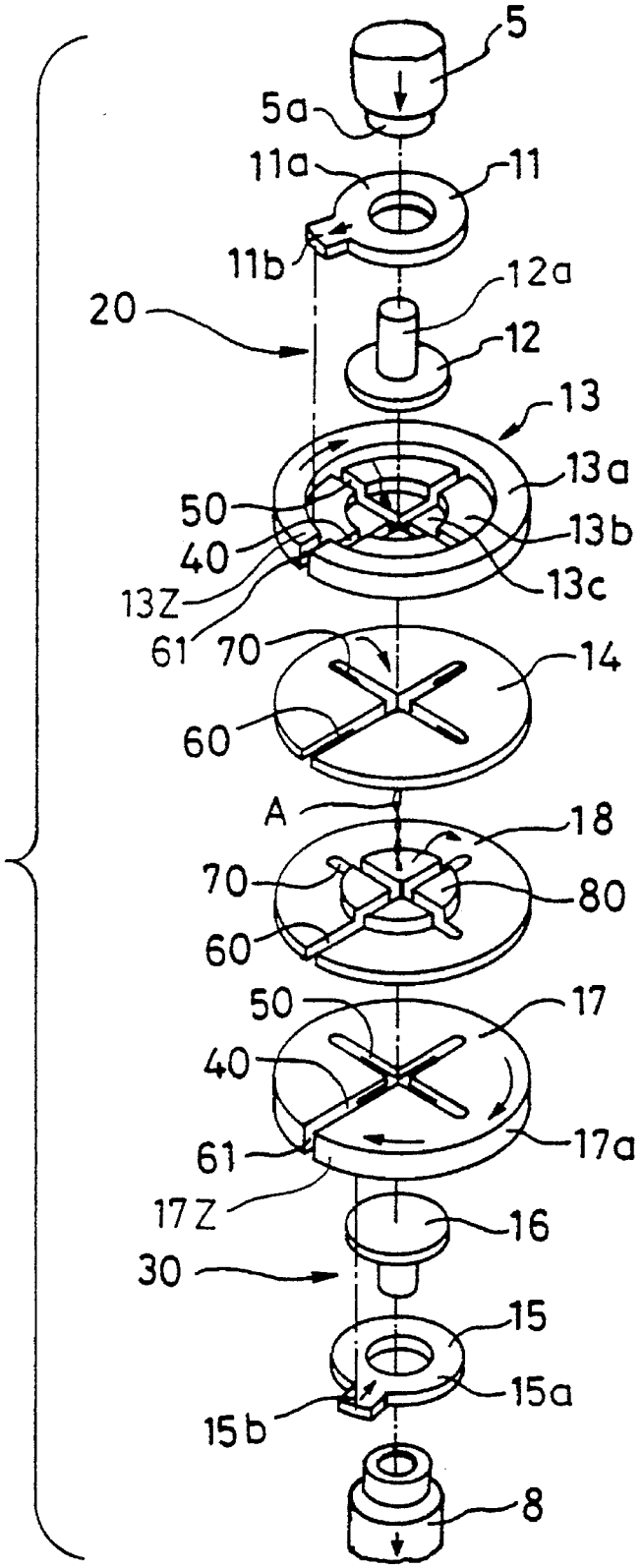
FIG. 2 is an exploded perspective assembly view of the stationary electrode assembly and the movable electrode assembly in FIG. 1.

FIG. 1 is a perspective view illustrating electrode assemblies in the vacuum interrupter of the first embodiment, and FIG. 2 is an exploded perspective assembly view of the electrode assemblies in FIG. 1.

The electrode assemblies of the vacuum interrupter shown in FIG. 1 are arranged in an evacuated envelope and are structured so as to connect or disconnect with each other by an operation mechanism (not shown). The electrode assemblies shown in FIG. 1 comprise a stationary electrode assembly 20 fixed on the evacuated envelope through an insulating member and a movable electrode assembly 30 which moves upward or downward by activation of the operation mechanism (not shown) and connects or disconnects with the stationary electrode assembly 20. The stationary electrode assembly 20 is substantially identical with the movable electrode assembly 30 in structure, and one of them is inverted and is arranged in opposed relationship to the other. Therefore configuration of only the stationary electrode assembly 20 is elucidated in detail. As shown in the exploded perspective assembly view of FIG. 2, the stationary electrode assembly 20 comprises a stationary electrode rod 5, a stationary connection conductor 11, a support member 12, a stationary coil electrode 13 and a stationary main electrode 14; and the movable electrode assembly 30 comprises a movable electrode rod 8, a movable connection conductor 15, a support member 16, a movable coil electrode 17 and a movable main electrode 18.

As shown in FIG. 2, the stationary connection conductor 11 comprises a ring-shaped holding part 11*a* which is put on a boss 5*a* of the stationary electrode rod 5 and an arm part 11*b* extended outward in a radial direction. A gap 61 (cut-part) is formed by cutting out a part of the circumference of a ring-shaped coil part 13*a* placed on the peripheral portion of the stationary coil electrode 13. An end of the arm part 11*b* is electrically connected to the coil part 13*a* at the inside wall of a connecting part 13*z* in the vicinity of the gap 61. A circular pit 13*b* is formed inward from the coil part 13*a* of the stationary coil electrode 13, and a thickness of the circular pit 13*b* in the axial direction is thinner than that of the coil part 13*a* in the axial direction. A straight slot 40 is formed on the circular pit 13*b* in a manner of passing through the center of the circular pit 13*b* and communicating with the gap 61 of the coil part 13*a*. The length of the slot 40 is equal to the inner diameter of the coil part 13*a* or shorter than that. Moreover, another slot 50 intersects perpendicularly with the slot 40 at the center of the circular pit 13*b* and the length of the sloe 50 is equal to the inner diameter of the coil part 13*a* or shorter than that.

As shown in FIG. 2, the support member 12 supports the stationary coil electrode 18 by contacting with a hole 13*c* formed in the circular pit 13*b* of the stationary coil electrode 13. The support member 12 is made of high-resistance material such as stainless steel. A shaft 12*a* of the support member 12 is inserted in a hole of the boss 5*a* of the stationary electrode rod 5.

Slots 60 and 70 having the same shape as the slots 40 and 50 of the stationary coil electrode 13 are formed on the disc-shaped stationary main electrode 14 which is mounted on the surface of the stationary coil electrode 13 facing to the movable electrode assembly 30. The stationary main electrode 14 is fixed on the stationary coil electrode 13 in a manner that the slots 40 and 50 of the stationary coil electrode 13 overlap the slots 60 and 70 of the stationary main electrode 14, respectively.

As shown in FIG. 2, the stationary main electrode 14 and the movable main electrode 18 are provided with salient contacts 80 on the respective central surfaces, and an electric arc is produced on the salient contacts 80 between both the main electrodes. The arm part 11*b* is connected to the coil part 13*a* at the connecting part 13*z*, and in a similar manner, an arm part 15*b* of a movable connection conductor 15 in the movable electrode assembly 30 is electrically connected to a coil part 17*a* of the movable electrode assembly 80 at a connecting part 17*z*. The connecting part 13*z* and the connecting part 17*z* are arranged in the vicinity of opposed sides of a plane passing through both the gaps 61 and the centers of the coil parts 13*a* and 17*a*.

The stationary main electrode 14, the movable main electrode 18 and the salient contacts 80 are made of the following various materials corresponding to a capacity and intended purpose of the vacuum interrupter:

(1) Contact material of a type of Cu—Cr or Cu—Co in a large capacity vacuum interrupter, (2) Contact material of a type of Cu—W or Cu—Cr (50 wt % or more of content) in a high breakdown voltage vacuum interrupter, (3) Contact material containing low melting point material (Bi, Sb, Pb or Te) in the contact material of a type of Cu—Cr or Cu—Co in the case that welding of the contacts must be particularly prevented, (4) Contact material containing low melting point material (Bi, Sb, Pb, Te of 20 wt % and below of content) in the base material of a type of Cu—Cr, or contact material of a type of AgWC (5 wt % and below of Co, Ni or Fe is contained as an addition).

Subsequently, a current flow in generation of an electric arc between both the electrode assemblies in the first embodiment is elucidated with reference to FIG. 2. As shown in FIG. 2, when the electric arc A is generated between the stationary main electrode 14 and the movable main electrode 18, the current flows from the stationary electrode rod 5 to the coil part 13*a* via the stationary connection conductor 11, and reaches an arc generation point. In the movable electrode assembly 30, the current flows from the arc generation point to the radial direction in the movable main electrode 18 and passes the coil part 17*a*. And finally, the current flows from the end part of the coil part 17*a* to the movable connection conductor 15 and reaches the movable electrode rod 8.

As mentioned above, since the current at generation of the arc passes the coil parts 13*a* and 17*a* arranged on the respective circumferential parts of the coil electrodes 13 and 17, the flowing directions of the current are identical with each other on both the coil parts 13*a* and 17*a*, and their paths are substantially circular. Consequently, a magnetic field in the axial direction is generated between the main electrodes in generation of the arc.

Figure 3:
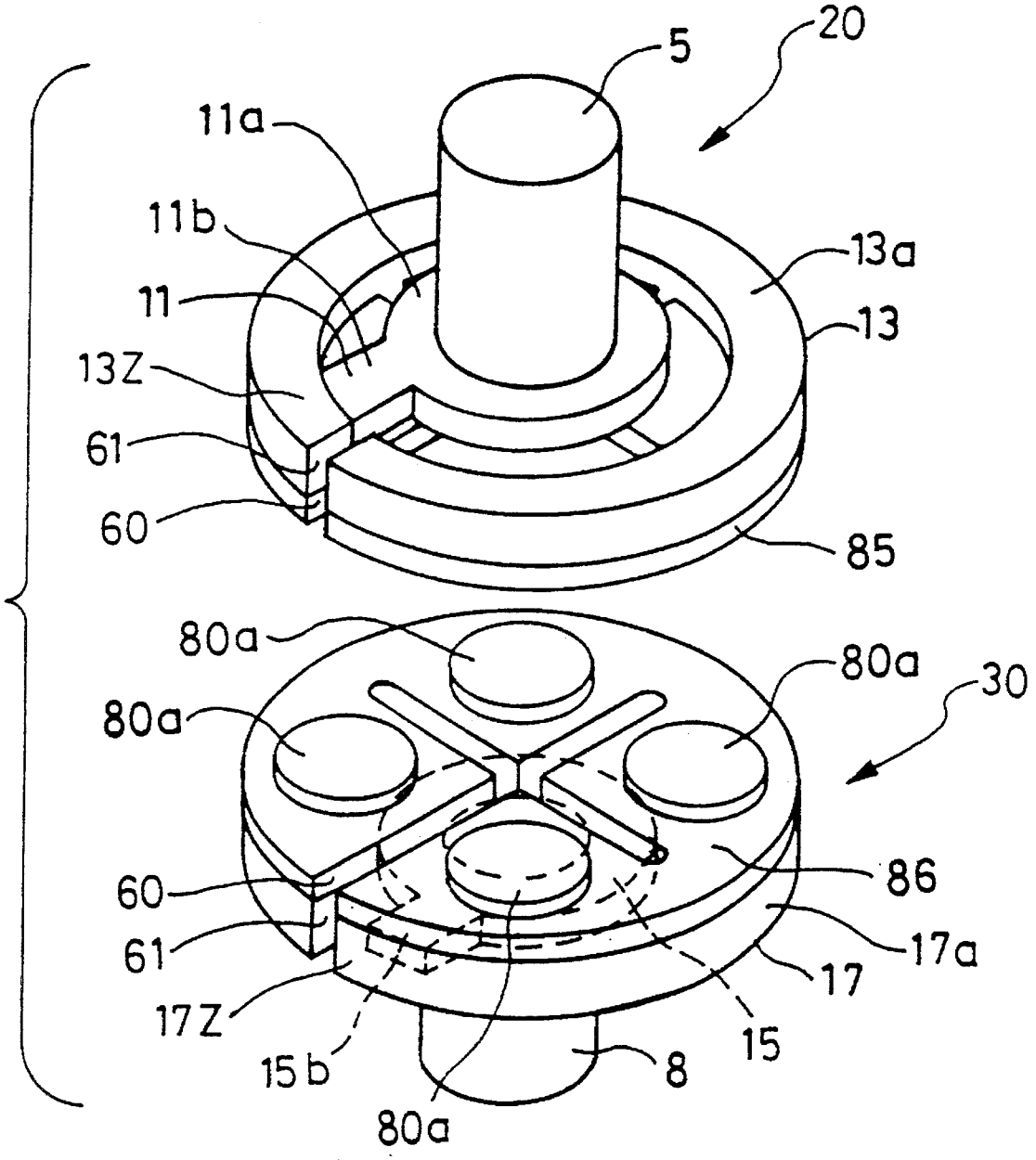
FIG. 3 is a perspective view of an example of the electrode assemblies of the vacuum interrupter in FIG. 1.
Figure 4:
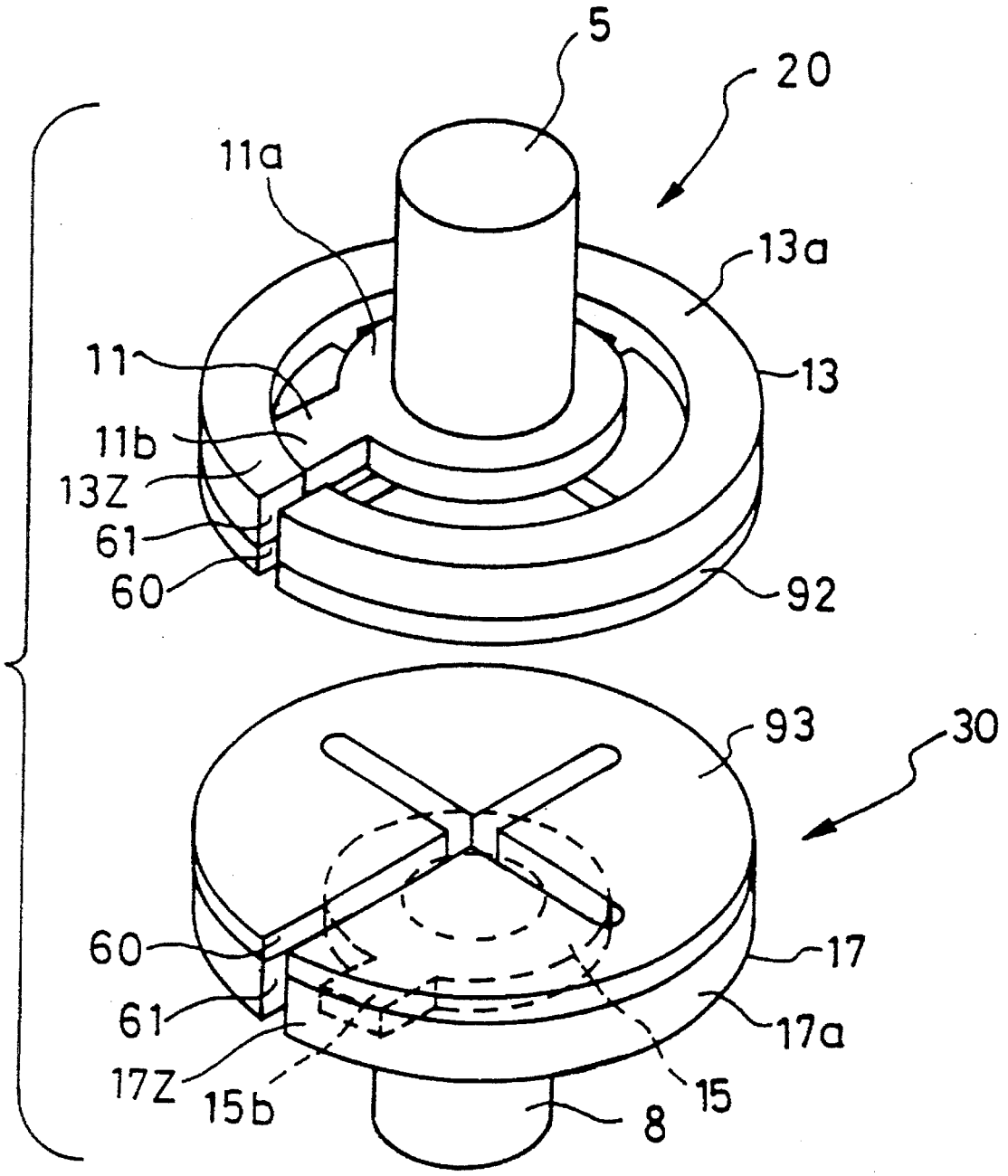
FIG. 4 is a perspective view of another example of the electrode assemblies of the vacuum interrupter in FIG. 1.

FIGS. 3 and 4 are perspective views of examples of the electrodes assemblies in the first embodiment. In FIG. 3, plural salient contacts 80*a* are formed on the surface of the stationary main electrode 85 and a hidden surface of the movable main electrode 86 of the respective electrode assemblies which are opposed with each other, and thereby positions generating the arc are decided between both the electrodes. The electrode assemblies shown in FIG. 4 comprise a disc-shaped stationary main electrode 92 and a disc-shaped movable main electrode 93, and thereby the electrode structure is simplified.

Figure 5:
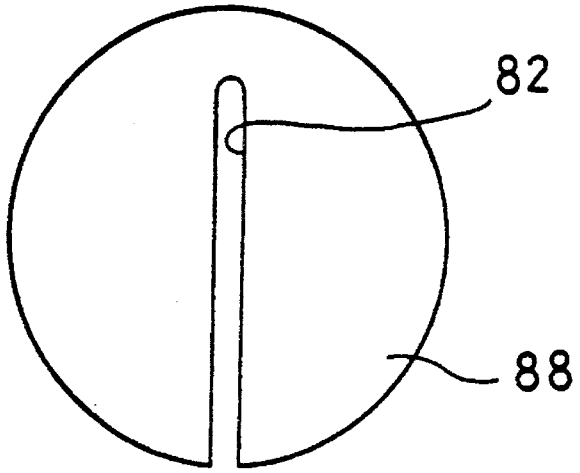
FIG. 5 is a plan view of an example of a main electrode in the electrode assemblies in FIG. 1.
Figure 6:
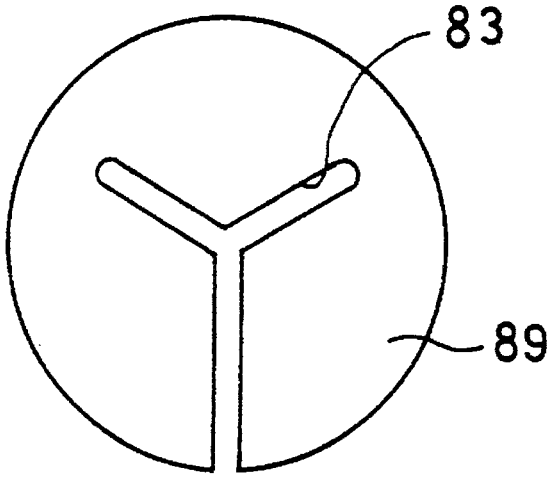
FIG. 6 is a plan view of another example of the main electrode in the electrode assemblies in FIG. 1.
Figure 7:
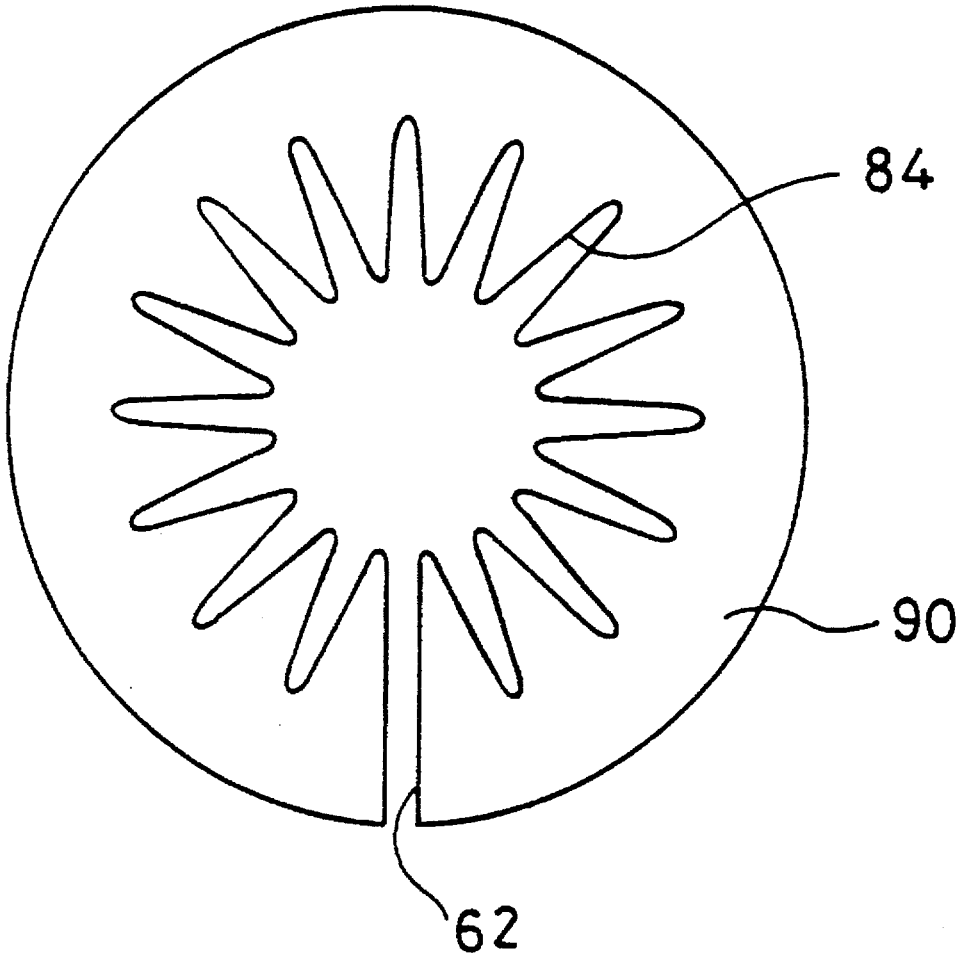
FIG. 7 is a plan view of further example of the main electrode in the electrode assemblies in FIG. 1.

In the above-mentioned first embodiment, though the cross-shaped slots are formed on both the electrode assemblies, the shape of the slots is not limited to the cross in the present invention. Slots shown in FIGS. 5, 6 and 7 may be formed on the electrode assemblies to realize the same effect as the above-mentioned embodiment. FIGS. 5, 6 and 7 are plan views of the shapes of the slots which are formed on the respective main electrodes and coil electrodes, and only the respective main electrodes in both the electrode assemblies are shown in these drawings. In FIG. 5, a straight line-shaped slot 82 is formed on the main electrode 88. In FIG. 6, a Y-shaped slot 83 is formed on the main electrode 89. In FIG. 7, a star-shaped opening is formed on the central part of the main electrode 90. The opening 84 is communicated to the outer circumference of the main electrode 90 through a slot 62 formed in the radial direction of the main electrode 90.

By the above-mentioned configuration of the main electrodes and the coil electrodes, when the electric arc is generated, the current flowing both the main electrodes passes on the substantially circular paths. Consequently, the magnetic field in the axial direction is generated between both the electrodes of the vacuum interrupter having the above-mentioned electrode assemblies, and thereby the plasma arc generated between both the electrodes is efficiently diffused.

[Second embodiment]

Figure 8:
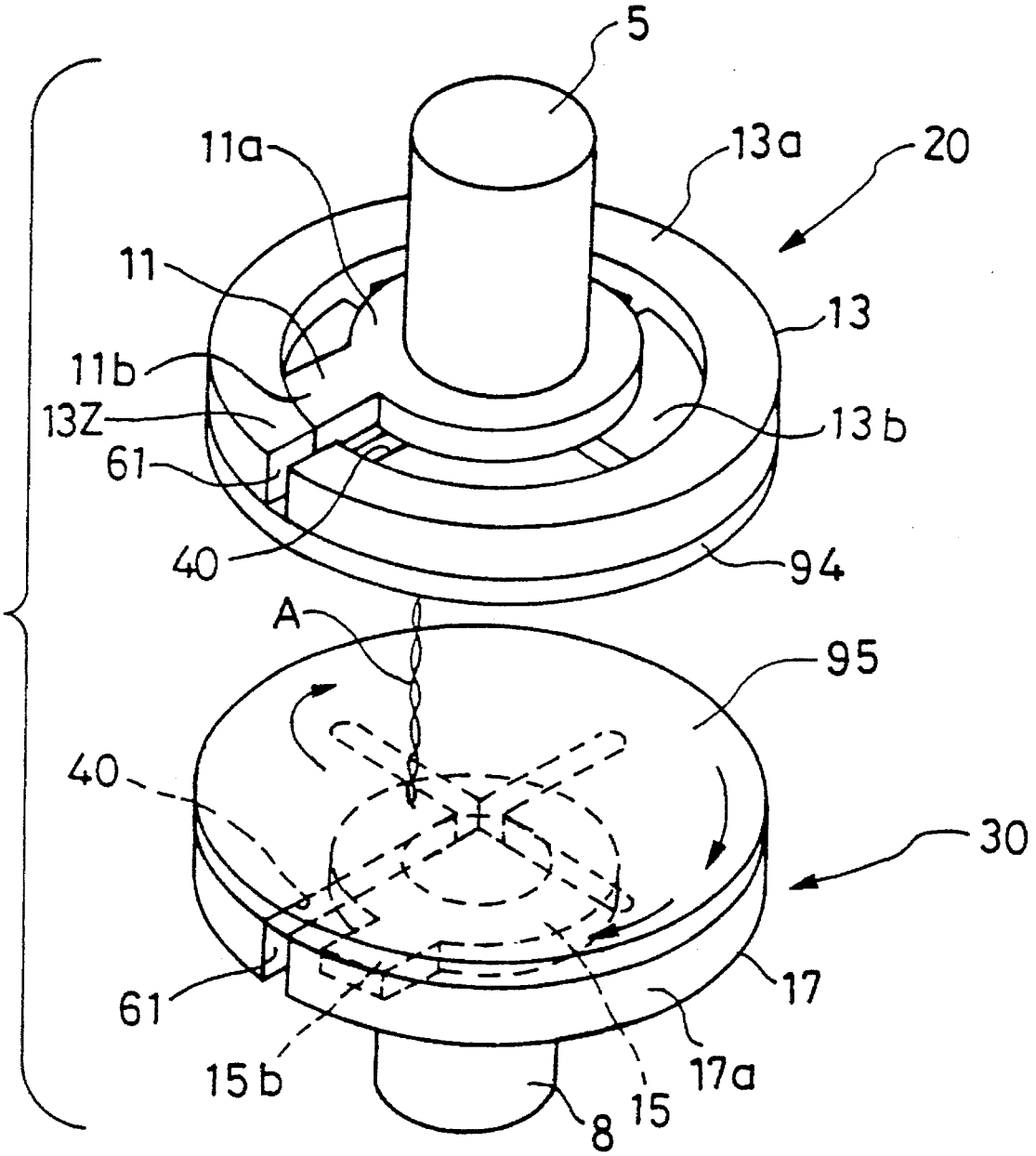
FIG. 8 is a perspective view of electrode assemblies of the vacuum interrupter in a second embodiment in accordance with the present invention.

Hereafter, the second embodiment of the vacuum interrupter is elucidated with reference to FIG. 8.

FIG. 8 is a perspective view of the electrode assembly in the vacuum interrupter of the second embodiment. Referring to FIG. 8, elements having the same structure and function as the elements in the first embodiment are identified by like numerals, and the elucidation is omitted. The vacuum interrupter of the second embodiment shown in FIG. 8 comprises a pair of the stationary electrode assembly 20 and the movable electrode assembly 80 which are identical with each other in configuration and arranged in opposed relationship in the evacuated envelope. The movable electrode assembly 30 is structured so as to connect or disconnect with the stationary electrode assembly 20 in the same manner as the first embodiment.

In the vacuum interrupter of the second embodiment, only the configurations which are different from the above-mentioned first embodiment are elucidated hereafter.

Respective main electrodes 94 and 95 of the stationary electrode assembly 20 and the movable electrode assembly 30 in the second embodiment are made of substantially flat disc-shaped metal plates without a slot. The main electrodes 94 and 95 are mounted on the opposing surfaces of the coil electrodes 13 and 17 having a slot. Moreover, edge parts of the opposing surfaces of the disc-shaped main electrodes are formed to curved surfaces, and concentration of an electric field is relaxed between both the main electrodes. The main electrodes 94 and 95 in the second embodiment are made of the same material as the main electrodes in the first embodiment.

A current flow in generation of the electric are between both the electrode assemblies is elucidated with reference to FIG. 8. When the arc A is generated between the stationary main electrode 94 and the movable main electrode 94, the current flows in the coil parts 13*a* and 17*a* located at the peripheral portion of the respective coil electrodes 13 and 17 having a low resistance. Therefore, the current flows on circular paths of the respective electrode assemblies, and the magnetic field in the axial direction is generated between both the electrodes. The plasma arc generated between both the electrodes is efficiently diffused by the magnetic field. Since the main electrodes 94 and 95 in the second embodiment are flat-shaped and formed to the curved surfaces on the edge parts of the surfaces, the vacuum interrupter having a high withstand voltage is realizable.

[Third embodiment]

Figure 9:
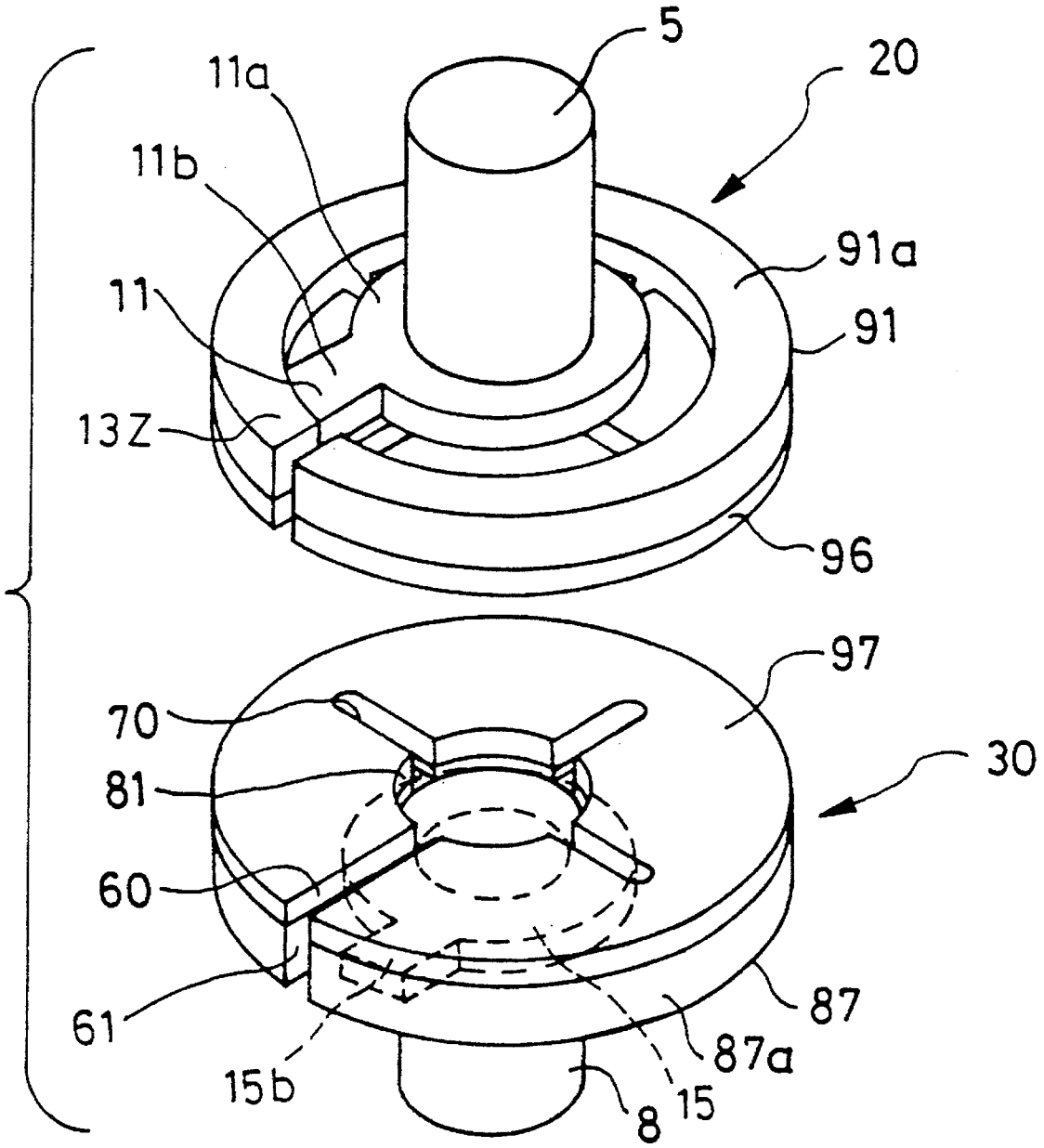
FIG. 9 is a perspective view of the electrode assemblies of the vacuum interrupter in a third embodiment in accordance with the present invention.

The third embodiment of the vacuum interrupter is elucidated with reference to FIG. 9 hereafter.

FIG. 9 is a perspective view of the electrode assemblies in the vacuum interrupter of the third embodiment. Referring to FIG. 9, elements having the same structure and function as the elements in the first embodiment are identified by like numerals and the description is omitted. The vacuum interrupter in the third embodiment in FIG. 9 comprises a pair of the stationary electrode assembly 20 and the movable electrode assembly 30 which are substantially identical with each other and are arranged in opposed relationship in the evacuated envelope. The movable electrode assembly 30 is structured so as to connect or disconnect with the stationary electrode assembly 20.

In the vacuum interrupter in the third embodiment, only the configurations which are different from the first embodiment are elucidated hereafter.

The main electrodes 96 and 97 and the coil electrodes 91 and 87 in the respective electrode assemblies are provided with openings 81 at the central parts of the main electrodes 96 and 97 and the coil electrodes 91 and 87 in addition to the radial slots 60 and 70 passing through the central parts. The diameters of support members (not shown in FIG. 9) for mechanically supporting the main electrodes 96 and 97 and the coil electrodes 91 and 87 are larger than the diameters of the openings 81 in order to close the openings 81. The current flow in generation of the electric arc between both the electrode assemblies in the third embodiment is elucidated hereafter with reference to FIG. 9.

Since the openings 81 are formed at the central part of the main electrodes 96 and 97 and coil electrodes 91 and 87 in the third embodiment, the electric arc is not generated at the central part, but is generated in the vicinity of the circumferential part of the main electrodes 96 and 97. Therefore, the current flows rapidly to the coil parts 91 *a* and 87*a* which are disposed on the back face of the circumferential parts of the main electrodes 96 and 97, and the current path becomes substantially circular in the main electrodes 96 and 97. Consequently, a uniform magnetic field in the axial direction is generated between both the electrodes, and the plasma arc is effectively diffused.

[Fourth embodiment]

Figure 10:
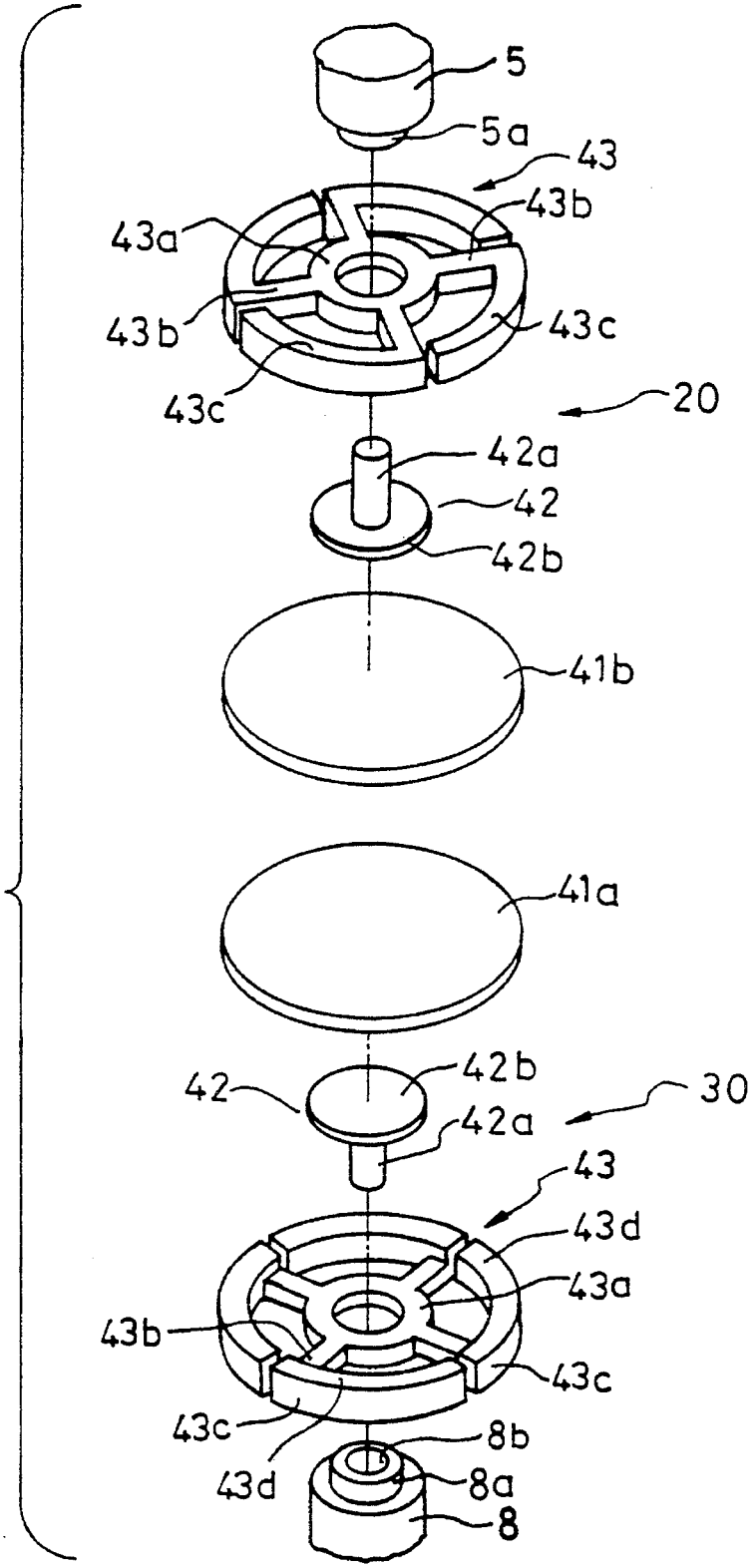
FIG. 10 is an exploded perspective assembly view of an electrode assembly of the vacuum interrupter in a fourth embodiment in accordance with the present invention.

FIG. 10 is an exploded perspective assembly view of the electrode assembly of the vacuum interrupter in the fourth embodiment.

Referring to FIG. 10, coil electrodes 43 made of conductive material are provided with ring-shaped holding parts 43*a* at the central parts which are put on the bosses 5*a* and 8*a* of the electrode rods 5 and 8. Four arms 43*b* are extended from the holding part 43*a* to the radial direction. Arc-shaped coil parts 43*c* are connected to the ends of the respective arms 43*b* and are arranged in a circle. The coil parts 43*c* protrude in the axial direction and contact with the back surface of the respective disc-shaped main electrodes 41 at the entire circumferential surfaces 43*d*.

Support members 42 mechanically support the back surfaces of the respective main electrodes 41. The support members 42 are made of high resistance material such as stainless steel, and rod parts 42*a* are inserted in a supporting hole 8*b* of the electrode rods 8 and are fixed thereby. A disc-shaped supporting part 42*b* supports the central part of the main electrodes 41.

Figure 11A:
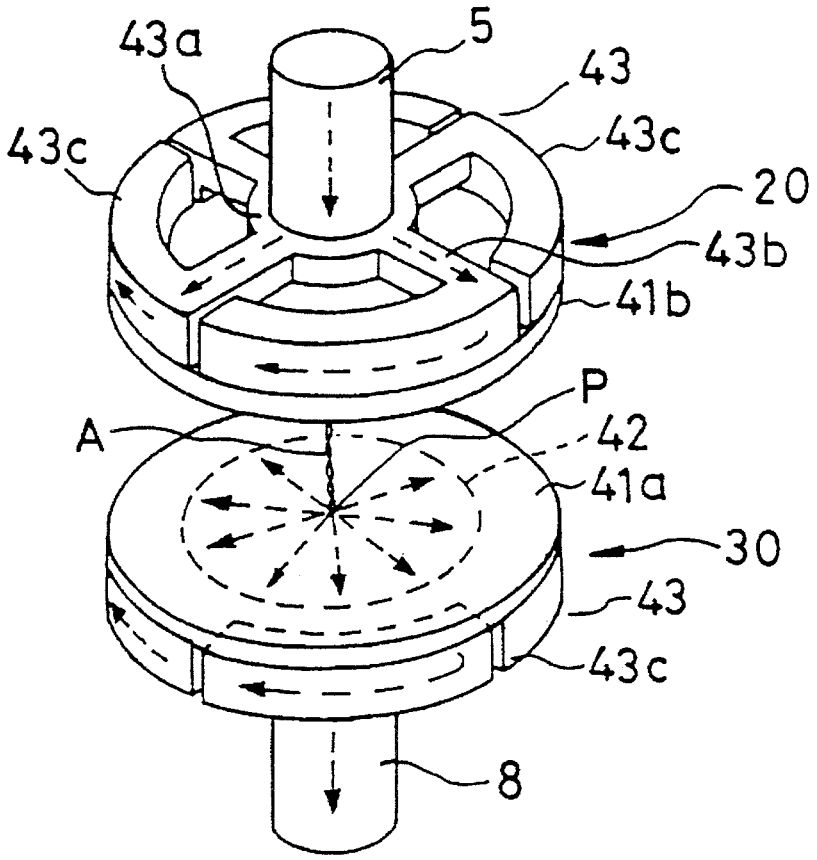
FIG. 11(*a*) is a perspective view of the electrode assemblies in the fourth embodiment.
Figure 11B:
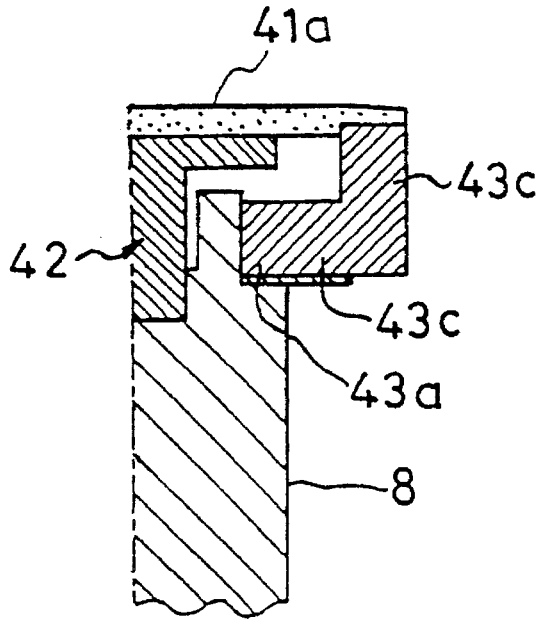

Operation of the vacuum interrupter in the fourth embodiment is elucidated with reference to FIG. 11(*a*).

FIG. 11(*a*) is a perspective view showing disconnection state of the electrode assemblies. Currents flow from an arc spot P generated on the main electrode 41a to the circumference of the main electrode in radial direction as shown by dotted lines. When the currents reach the coil part 43*c* of the coil electrode 43, the current flows in the coil part 43*c* which is lower in resistance than the main electrode 41*a*, and reaches the electrode rod 8 through the arm parts 43*b* and the holding part 43*a* of the coil electrode 43 shown in FIG. 11(*b*). The current flows in the directions shown by dotted lines with arrow in the other main electrode 41*b*. Consequently, the magnetic field in the axial direction is generated between both the main electrodes in a similar manner to the above-mentioned embodiments, and thereby the arc is diffused.

According to the fourth embodiment, (1) First, since the upper surfaces 43*d* of the coil parts 43*c* are closely contacted with the respective main electrodes 41*a* and 41*b*, respectively, distances from the coil parts 43*c* of the coil electrodes to the surfaces of the main electrodes are reduced. Consequently, the intensity of the magnetic field in the axial direction between both the electrodes is enhanced with respect to the prior art. Moreover, leakage of the magnetic flux is reduced by the above-mentioned structure, and thereby the distribution of the magnetic field is improved. Since the magnetic field in the axial direction having a high intensity and an improved distribution can be generated, the effect for diffusing the arc to the entire surfaces is enhanced, and disconnecting ability is also improved.

(2) Additionally, since the entire upper surfaces of the coil parts 43*c* are contacted with the back surfaces of the main electrodes 41*a* and 41*b*, the mechanical strength is enhanced.

[Fifth embodiment]

Figure 12:
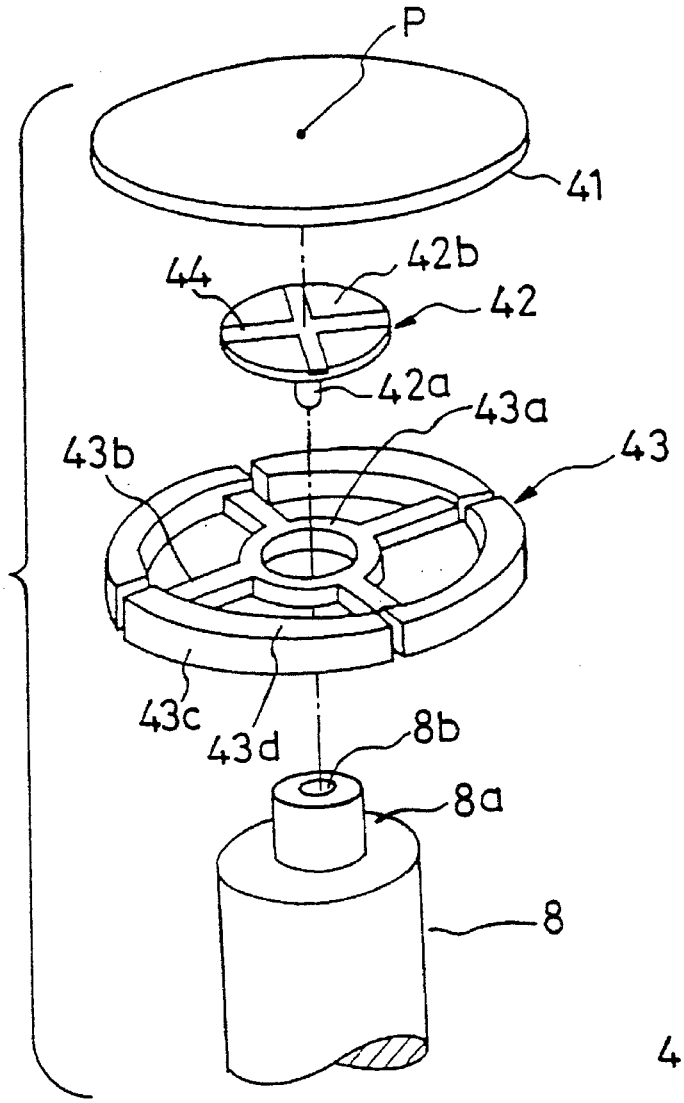
FIG. 12(*a*) is an exploded perspective assembly view of an electrode assembly In a fifth embodiment in accordance with the present invention.
Figure 12:
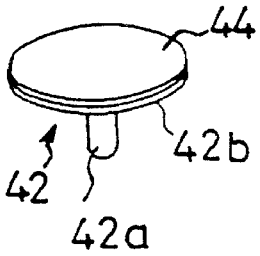
Figure 12:
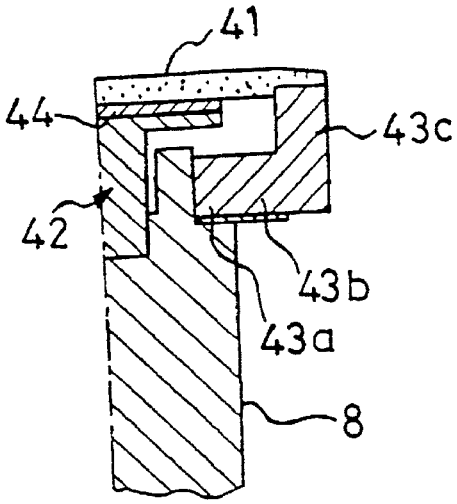

In the case that a cross-shaped good conductivity member 44, for example, is formed on the upper surface 44*b* of the support member 42 as shown in FIG. 12(*a*) in the fourth embodiment, the main part of the current from the arc spot P flows to the ends of the coil parts 43*c* through the cross-shaped good conductive member 44 formed on the upper surface of the support member 42. Subsequently, the current flows to the electrode rod 8 through The arm parts 48*b* of the coil electrode 43 and the holding part 43*a*.

The good conductivity member 44 formed on the upper surface of the support member 42 serves to lead the arc current generated on the main electrode 41 to the end of the coil part 43*c* as much as possible. Consequently, the current flowing the coil part 43*c* is increased, and the intensity of the magnetic field is increased.

The good conductivity member 44 may be formed in other shapes which can effectively causes the current to flow to the coil part 43*c* other than the cross. For example the member 44 may be Formed in a disk-shape as shown in FIG. 12(*b*). The good conductivity member 44 serves to reduce the resistance between both the electrode assemblies and to suppress the current which leaks to the electrode rod 8 through the main electrodes 41 and the support members 42. FIG. 12(*c*) is a partial cross-section of assembled movable electrode assembly 43.

[Sixth embodiment]

Figure 13A:
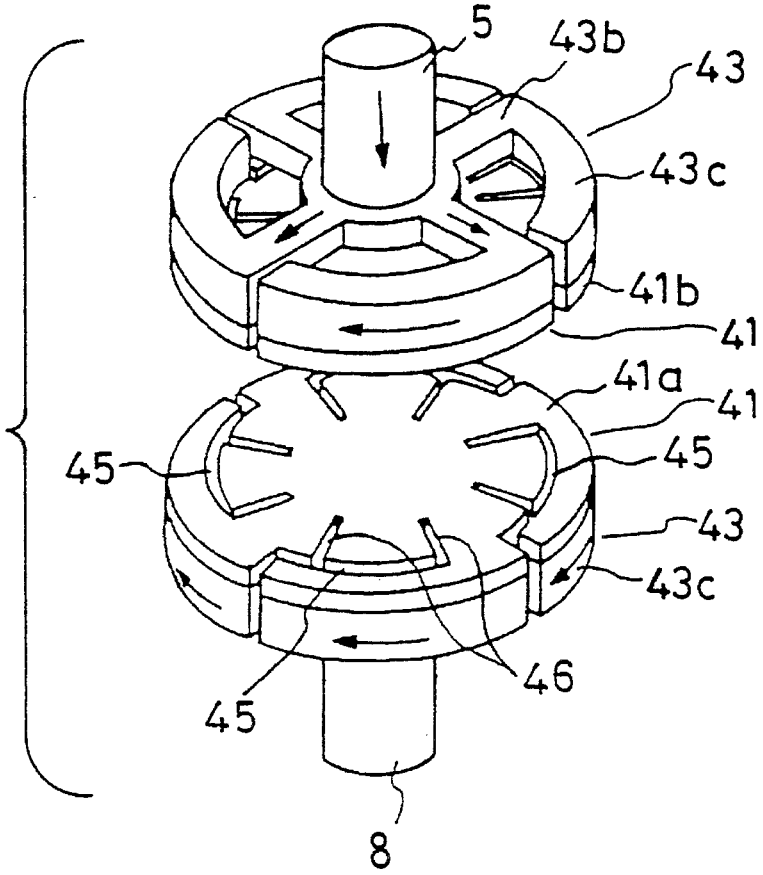
FIG. 13(*a*) is a perspective view of electrode assemblies of a sixth embodiment in accordance with the present invention.
Figure 13B:
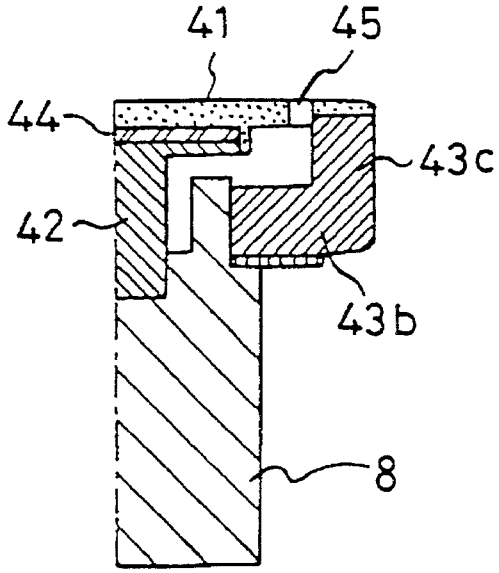

FIG. 13(*a*) is a perspective view of the electrode assemblies of the vacuum interrupter in the sixth embodiment.

Referring to FIG. 13(*a*), high resistance parts 45 are slots or fillers made of high resistance material such as stainless steel filled in the slots and are disposed inward from the circumference of the main electrode 41 along the circumference. The high resistance parts 45 are formed along the arm parts 43*b* of the coil electrodes 43 extending to the radial directions and the arm parts 43*c* extending along the circumference, and are terminated at the positions which are shorter than the arm length of the arm parts 43*c*. Moreover, other high resistance parts 46 are formed in the radial directions of the main electrode 41. The high resistance parts 46 are made of high resistance material such as stainless steel or may be substituted with slits. Other configurations in the sixth embodiment is identical with that of the fourth embodiment, and therefore elucidation is omitted.

In operation of the sixth embodiment, the high resistance parts 45 formed along the circumference serve to cause the current to flow along the coil part 43*c* as much as possible. The intensity of the magnetic field generated by the coil electrodes 43 is enhanced, and uniformity of the magnetic field is improved.

When the magnetic field in the axial direction is generated by the coil electrodes, an eddy current is generated on the main electrode 41 by the magnetic field. Consequently, a magnetic field having the reverse direction is generated by the eddy current, and the intensity of the magnetic field in the axial direction is reduced. The high resistance parts 46 in the radial directions of the sixth embodiment serve to prevent the reduction of the magnetic field in the axial direction due to the eddy current which is generated on the main electrode 41.

Figure 14A:
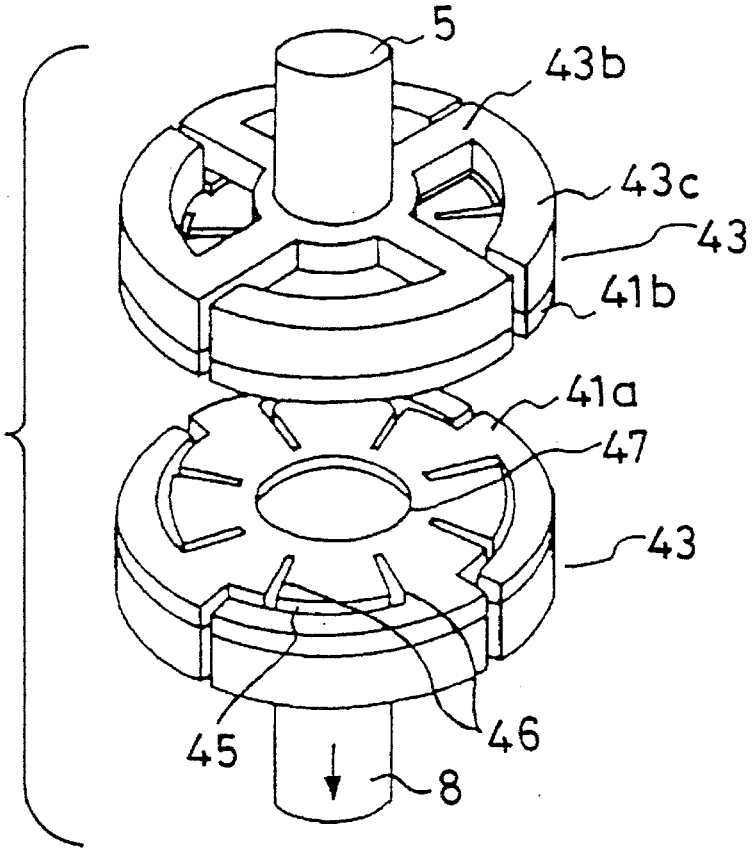
FIG. 14(*a*) is a perspective view of electrode assemblies of an example of the sixth embodiment.
Figure 14B:
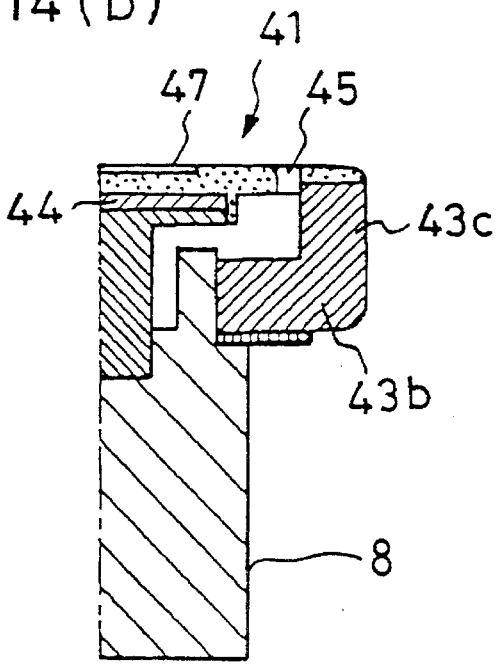

(Other examples FIGS. 14(*a*) and 14(*b*)

Figure 15:
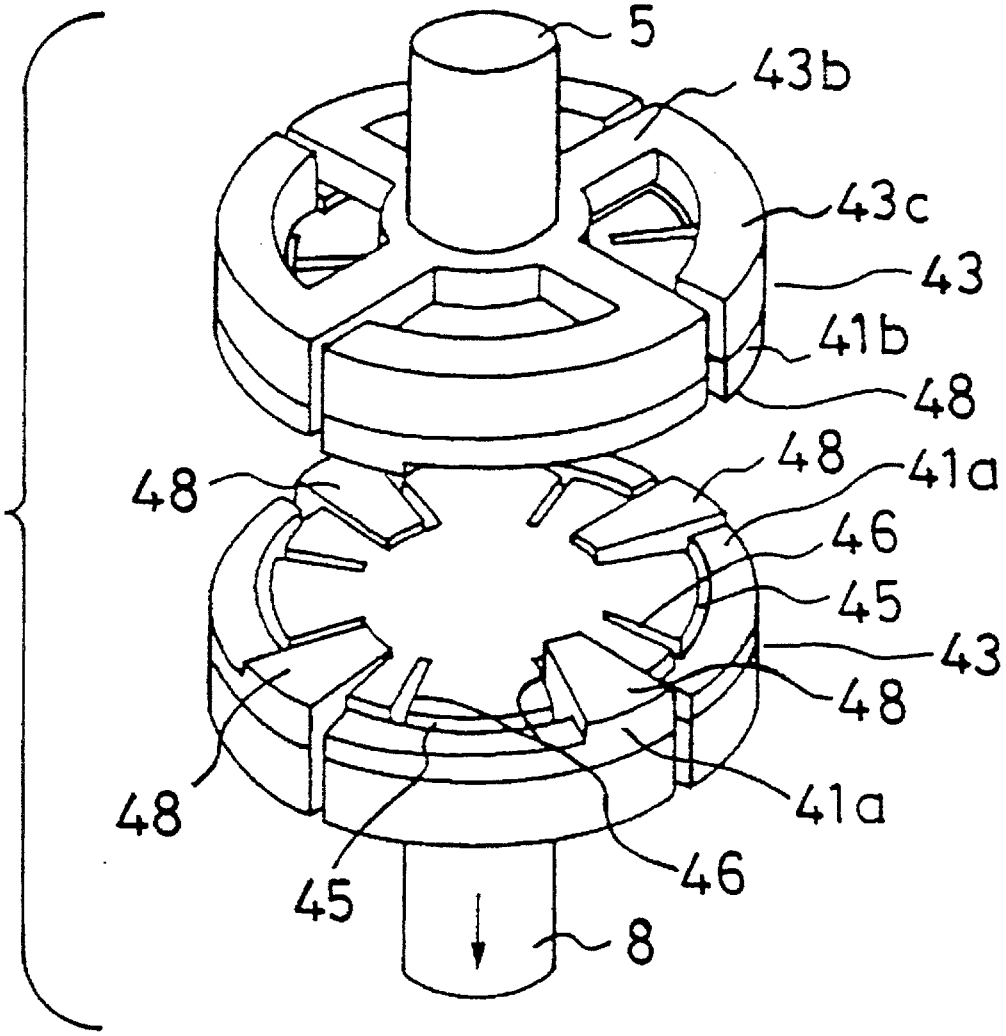
FIG. 15 is a perspective view of electrode assemblies of another example of the sixth embodiment.

In the vacuum interrupter of other example in the sixth embodiment, as shown in FIG. 14(*a*), reentrants 47 are formed on the central contact surfaces of the main electrodes 41*a* and 41*b* so as to reduce the resistance between both the electrode assemblies and to make it easy to move the arc. FIG. 14(*b*) is a partial cross-section of the electrode assembly in the example. Protrusions 48 may be formed on the main electrodes 41*a* and 41*b* as shown in FIG. 15 to obtain the same effect as the reentrants 47 in FIG. 14(*a*).

In the sixth embodiment, though four arm parts 43*b* and four coil parts 43*c* are formed on the coil electrode 43, the number of the arm parts 43*b* and the coil parts 43*c* of the coil electrode 43 may be changed in order to vary the intensity of the magnetic field in accordance with the change of operation condition or contact material of the vacuum interrupter. In the above-mentioned case, the same effect is realizable.

[Seventh embodiment]

The seventh embodiment is directed to the vacuum interrupter of which the magnetic field in the axial direction between both the electrodes is uniformed, and the plasma arc generated between both the electrodes is effectively diffused. The seventh embodiment of the vacuum interrupter in accordance with the present invention of claim 8 is elucidated with reference to drawings.

Figure 16:
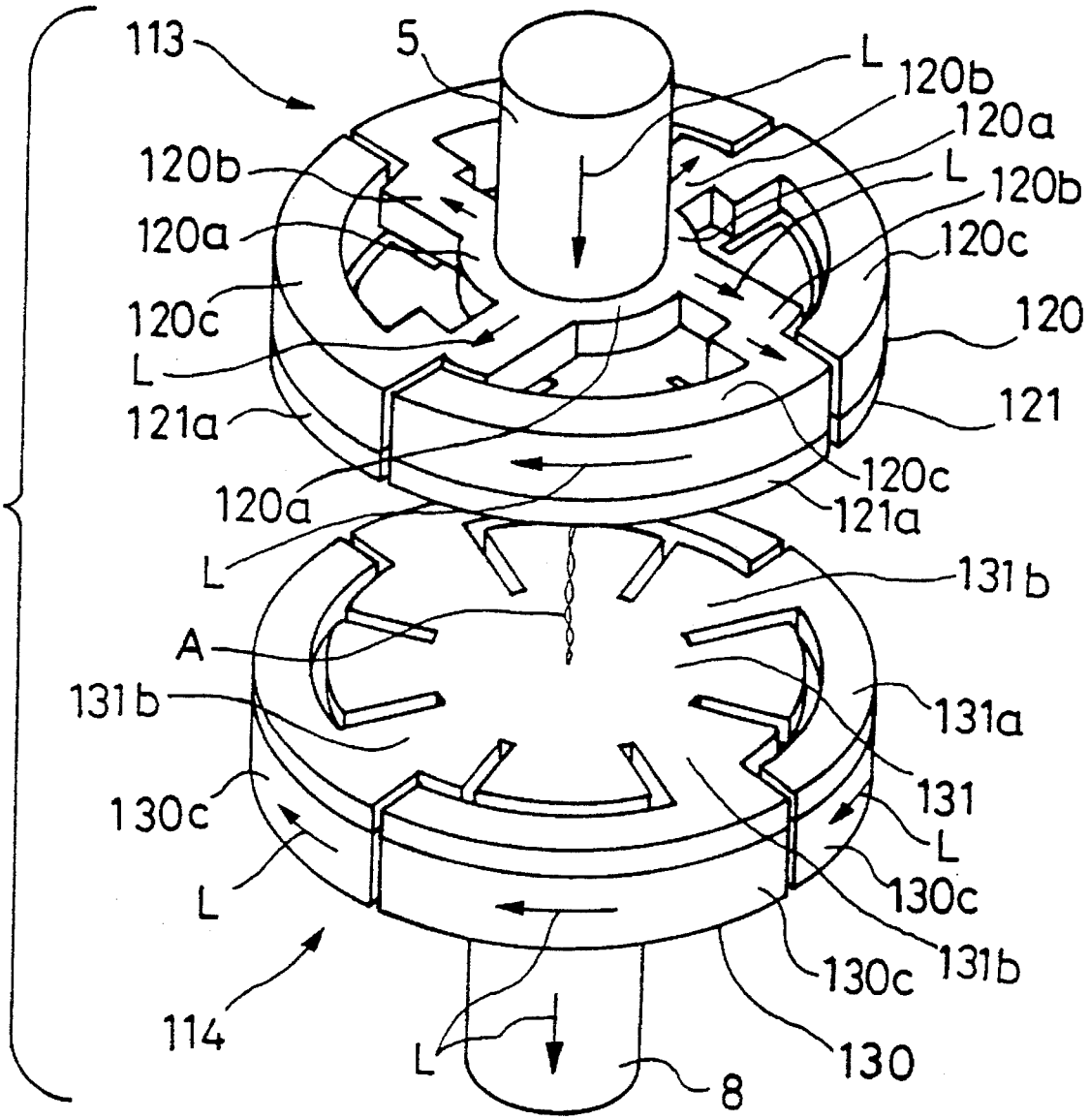
FIG. 16 is a perspective view of electrode assemblies of The vacuum interrupter in a seventh embodiment in accordance with the present invention.
Figure 17:
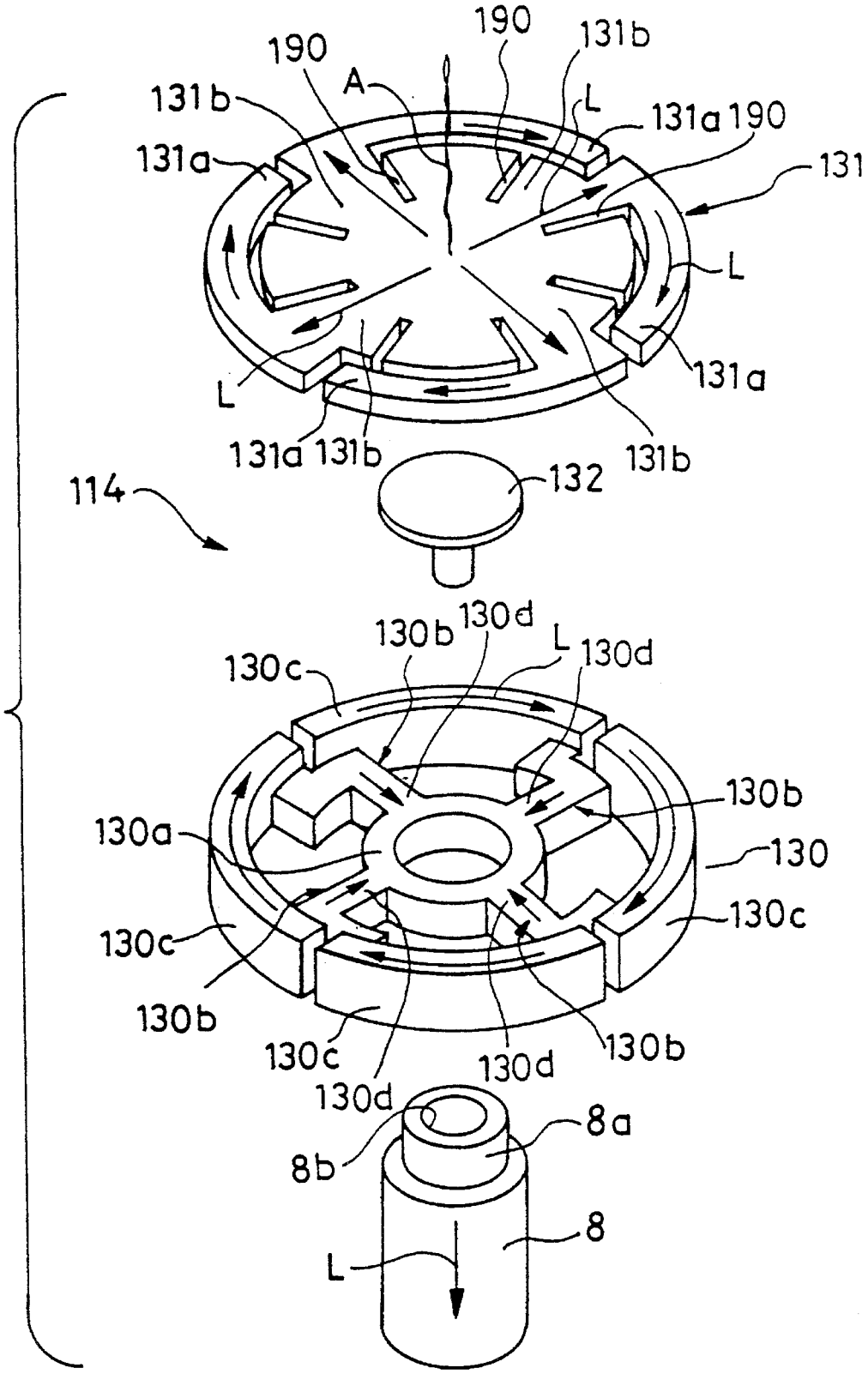
FIG. 17 is an exploded perspective assembly view of the movable electrode assembly in FIG. 16.
Figure 18:
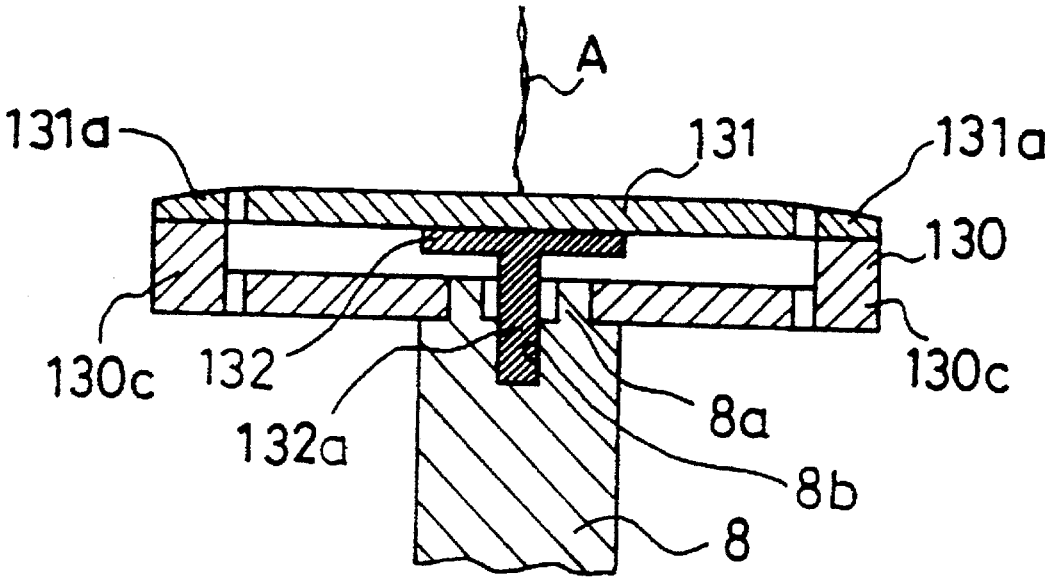
FIG. 18 is a cross-section of relevant parts of the movable electrode assembly in FIG. 17.

FIG. 16 is a perspective view of the electrode assemblies in the vacuum interrupter of the seventh embodiment, and FIG. 17 is an exploded perspective assembly view of a movable electrode assembly 114 in the electrode assemblies shown in FIG. 1B. FIG. 18 is a cross-section of the movable electrode assembly 114 shown in FIG. 17.

The electrode assemblies of the vacuum interrupter shown in FIG. 16 are arranged in the evacuated envelopes, and are operated to connect or disconnect by an operation mechanism (not shown). The electrode assemblies shown in FIG. 16 comprise the stationary electrode assembly 113 fixed on the evacuated envelope through an insulating member and the movable electrode assembly 114 which is operated to connect or disconnect with the stationary electrode assembly 113 by up and down operation of the operation mechanism. The configuration of the stationary electrode assembly 113 is substantially identical with the configuration of the movable electrode assembly 114. As shown in the exploded perspective assembly view of FIG. 17, the movable electrode assembly 114 comprises the movable electrode rod 8, a coil electrode 130, a main electrode 131 and a support member 132.

As shown in FIG. 17, the coil electrode 130 is provided with a ring-shaped holding part 130*a* which is put on the boss 8*a* of the movable electrode rod 8 at the central part. Four arm parts 130*b* extend from the holding parts 130*a* in the radial direction. The arm parts 130*b* are bent substantially perpendicularly at two positions, and the end faces of the arm parts 130*b* are connected to respective arc-shaped coil parts 130*c*. Straight parts 130*d* of the arm parts 130*b* extended from the holding part 130*a* in the radial directions are directed to the ends of the coil parts 130*c*. The four coil parts 180c connected to the respective arm part 130*b* are arranged substantially on the same circumference. The upper surfaces of these coil parts 130*c* are protrude upwardly from the upper surfaces of the holding parts 130*a* or the arm parts 130*b*, and are made to contact the back surface of the disc-shaped main electrode 131 at the entire surface.

As shown in FIG. 18, the support member 132 mechanically supports the main electrodes 131 by contacting the back surface of the main electrode 131. The support member 132 is made of high resistance material such as stainless steel. In the support member 132, a rod-shaped shaft part 132*a* in the axial direction is inserted in a support hole 8*b* formed in the end part 8*a* of the movable electrode rod 8 and is fixed thereby.

In FIG. 17, four arc-shaped arms 131*a* are formed on the disc-shaped main electrode 131 which is mounted on the coil electrode 130. The four arc-shaped arms 131*a* are formed substantially on the same circumference. These arc-shaped arms 131*a* are positioned so as to overlap on the respective upper surface of the coil part 130*c* of the coil electrode 130. Moreover, slots 190 are formed on the main electrode 131 in the radial directions, and thereby guide parts 131*b* are formed so as to communicate from the central part of the arc generating point to the arc-shaped arms 131*a*.

Figure 19:
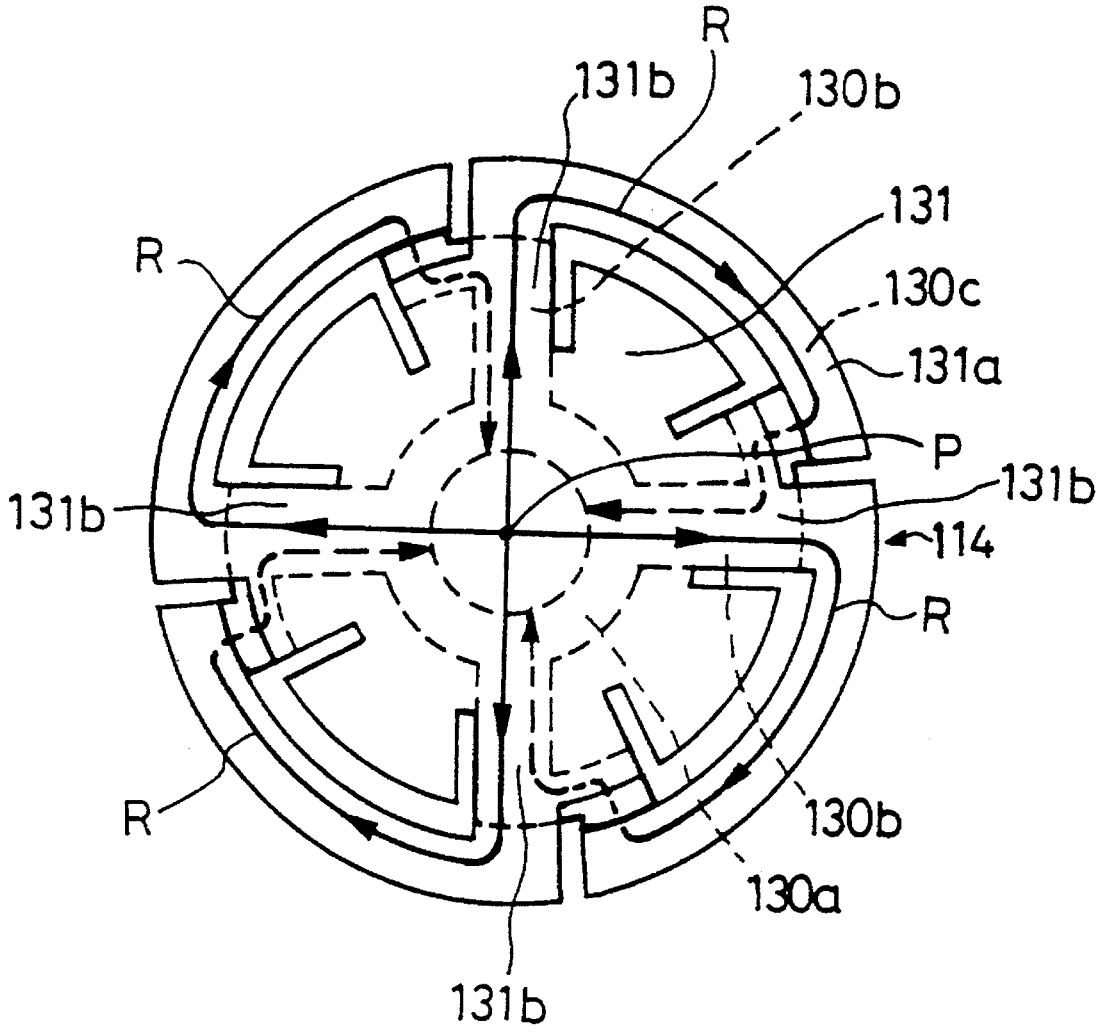
FIG. 19 is a plan view of the movable electrode assembly in FIG. 17.

In the electrode assemblies of the vacuum interrupter in the seventh embodiment configured as mentioned above, the current flow in generation of the arc is elucidated with reference to FIG. 19. FIG. 19 is a plan view showing the main electrode 131 of the movable electrode assembly 114 in FIG. 17 and the coil electrode 130 placed on the back surface thereof.

In the disconnection operation of the movable electrode assembly 114 from the stationary electrode assembly 113, a case where that the arc A is generated in the vicinity of a central part of the main electrode 131 shown in FIG. 16, the current flows through the main electrode 131 and the coil electrode 130 along the current paths R and reaches the movable electrode rod 8. Namely, the current flows in the radial directions through the guide parts 131*b* of the main electrode 131, and reaches the movable electrode rod 8 through the circumferential parts 131*a* of the main electrode 131, the coil parts 130*c* of the coil electrode 130, the arm parts 130*b* and the holding parts 130*a*.

On the other hand, in the stationary electrode assembly 113, as shown by an arrow L in FIG. 16, the current flows from the stationary electrode rod 5 to the guide parts 131*b* of the main electrode 121 through the holding parts 120*a* of the coil electrode 120, the arm parts 120*b*, the coil parts 120*c* and the circumferential parts 121*a* of the main electrode 121. The current in the main electrode 121 flows through the guide parts 131*b* in the radial directions there of and reaches a generation point of the arc A.

As shown in a plan view of the movable electrode assembly 114 of FIG. 19, the currents flowing in generation of the arc in the radial directions of the guide parts 131*b* of the main electrode 131 Flow substantially in the reverse directions to the currents flowing the arm parts 130*b* of the coil electrode 130 placed on the back surface, and the current values are substantially identical with each other. Therefore, the magnetic field generated by the current flowing the guide parts 131*b* of the main electrode 131 in the radial directions is countervailed by the magnetic field generated by the current flowing the arm parts 130*b* of the coil electrode 130. In a similar manner, the magnetic Field generated by the current flowing the guide part of the main electrode 121 of the stationary electrode assembly 113 in the radial directions is countervailed by the magnetic field generated by the current flowing the arm parts 120*b* of the coil electrode 120.

As mentioned above, the magnetic field generated by the current flowing the main electrodes 121 and 131 in the respective radial directions in generation of the arc is countervailed by the magnetic field generated by the current flowing the arm parts 120*b* and 130*b* of the respective coil electrodes 120 and 130. Consequently, a uniform magnetic field is generated between both the main electrodes in the axial direction by the current flowing the coil parts 120*c* and 130*c* of the coil electrodes 120 and 130 and the circumferential parts 121*a* and 131*a* of the main electrodes 121 and 131. And thereby the plasma arc generated in the disconnection operation is effectively diffused.

[Eighth embodiment]

Hereafter, the eighth embodiment of the vacuum interrupter is elucidated with reference to drawings.

Figure 20:
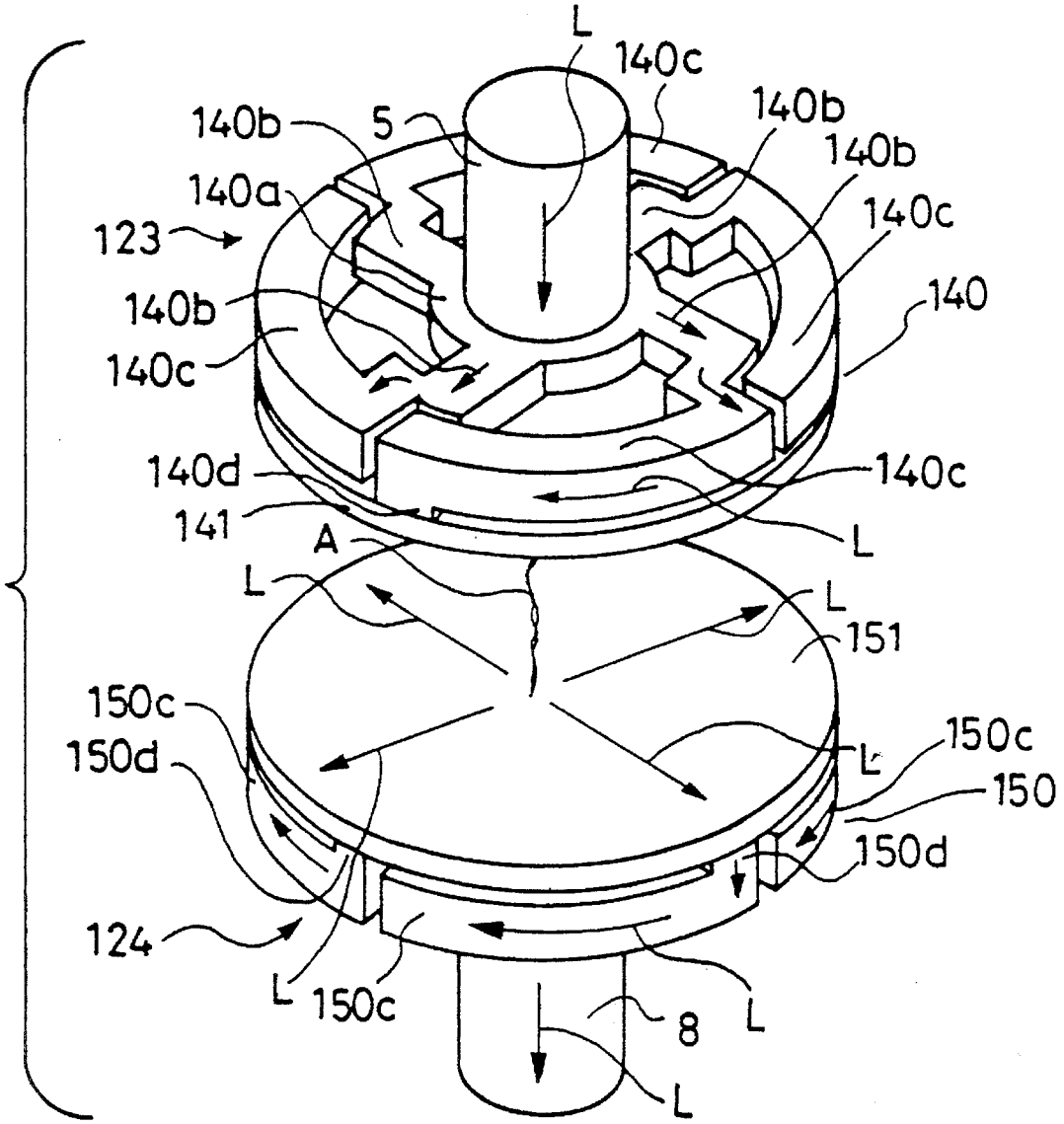
FIG. 20 is a perspective view of electrode assemblies of the vacuum interrupter in an eighth embodiment in accordance with the present invention.
Figure 21:
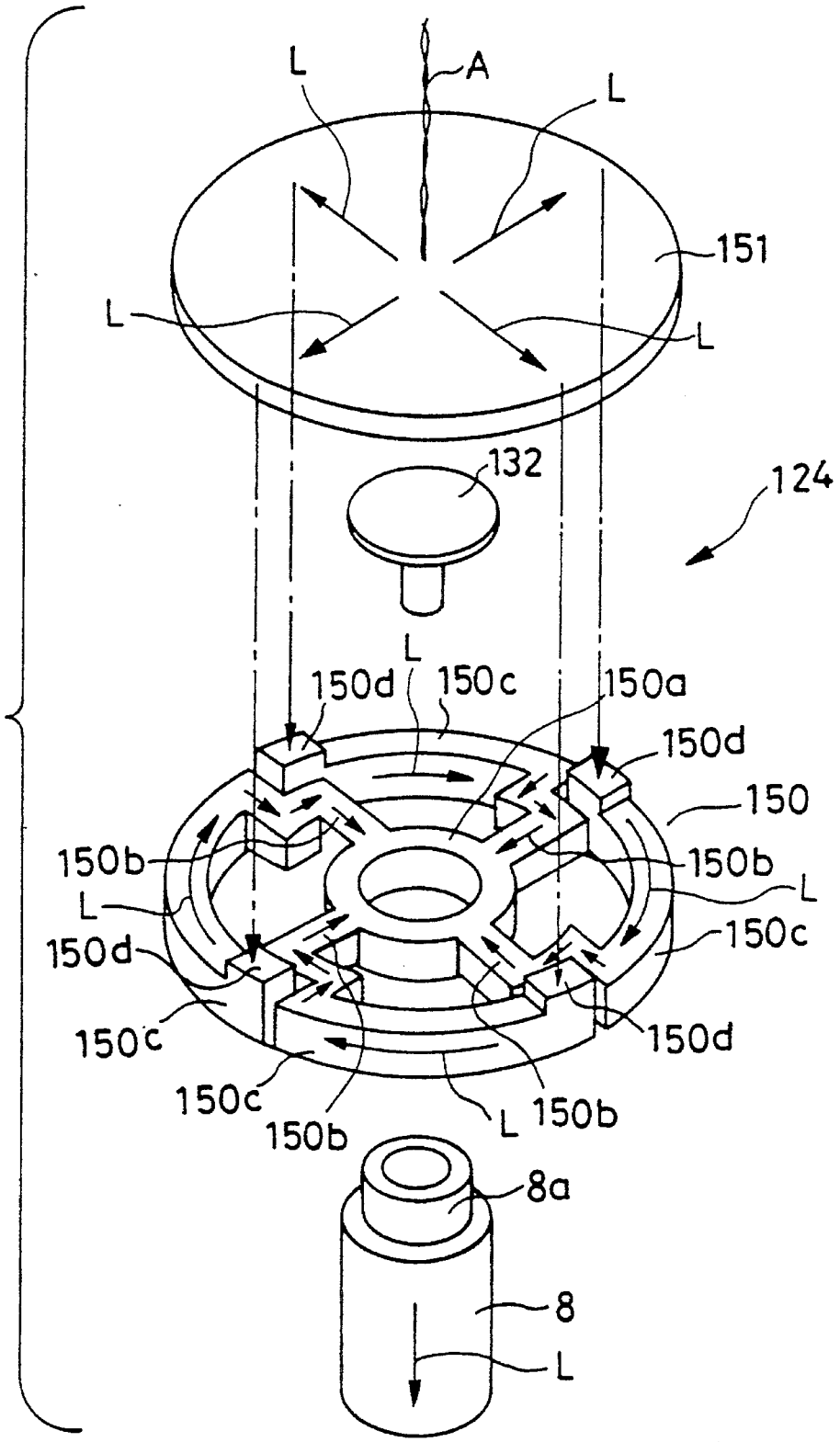
FIG. 21 is an exploded perspective assembly view of the movable electrode assembly in the eighth embodiment shown in FIG. 20.

FIG. 20 is a perspective view showing the electrode assemblies of the vacuum interrupter in the eighth embodiment and FIG. 21 is an exploded perspective assembly view of the movable electrode assembly 124 in FIG. 20. In each figure, elements having the same structure and function as the elements in the seventh embodiment are identified by like numerals, and the elucidation is omitted.

In FIG. 20, a stationary electrode assembly 123 and a movable electrode assembly 124 arranged in opposed relationship in the evacuated envelope are substantially made to the same structure and are configured to connect or disconnect with each other. As shown in FIG. 21, the movable electrode assembly 124 comprises the movable electrode rod 8, the support member 132, a coil electrode 15O and a main electrode 151.

The coil electrode 150 is provided with a ring-shaped holding part 150*a* which is put on the boss 8*a* of the movable electrode rod 8 at the central part. Four arm parts 150*b* are extended from the holding part 150*a* in the radial directions. In a similar manner of the seventh embodiment, the arm parts 150*b* are bent at substantially right angle at two positions and are connected to respective coil parts 150*c*. Four coil parts 150*c* connected to the respective arm parts 150*b* are arranged on the same circumference.

As shown in FIG. 21, a salient contact part 150*d* is formed on the end part of each coil part 150*c*, and the contact parts 150*d* contact the back surface of the main electrode 151.

Each arm part 150*b* extended from the holding part 150*a* of the coil electrode 150 is positioned in the direction of the contact part 150*d* connected to other arm part 150*b*. Consequently, the holding part 150*a* is connected to the coil part 150*c* through the bent part.

The main electrode 151 which contacts the contact parts 150*d* of the coil electrode 150 is disc-shaped. The material of the main electrode 151 is selected in accordance with the capacity and the intended purpose of the vacuum interrupter in a similar manner of the main electrode 131 in the seventh embodiment.

In-the electrode assemblies of the vacuum interrupter in the eighth embodiment configured as mentioned above, a current flow in generation of the arc is elucidated with reference to FIGS. 20 and 21.

When the movable electrode assemblies 124 are disconnected from the stationary electrode assembly 123, the arc A is generated at a position on the main electrode 151 shown by FIGS. 20 and 21, and the current flows on the main electrode 151 and the coil electrode 150 in the directions shown by arrows L. Namely, the current flows in the radial directions on the main electrode 151 and successively, flows to the movable electrode rod 8 through the contact parts 150*d*, the coil parts 150*c*, the arm parts 150*b* and the holding part 150*a*.

On the other hand, in the stationary electrode assembly 123, the current in generation of the arc flows from the stationary electrode rod 5 to the stationary main electrode 141 through the holding part 140*a*, the arm parts 140*b*, the coil parts 140*c* and the contact parts 140*d*, and successively flows on the main electrode 141 in the radial directions.

As shown in FIG. 21, the current flowing on the main electrode 151 in a disconnection operation flows through the coil parts 150 and the arm parts 150*b* through the contact parts 150*d*. At this time, since the directions of the current flowing the arm parts 150*b* are substantially equal to the directions of the current flowing the main electrode 151 in the radial directions, the magnetic field generated by the current flowing the main electrode 151 in the radial directions is substantially negated by the magnetic field by the current flowing the arm parts 150*b* of the coil electrode 150. Moreover, in the stationary electrode assembly 123, the magnetic field by the current flowing the main electrode 141 in the radial directions is substantially countervailed by the magnetic field by the current flowing the arm parts 140b of the coil electrodes 140.

As mentioned above, a uniform magnetic field in the axial direction is generated between both the main electrodes in the disconnection operation by making the extended directions of the respective arm parts 140*b* and 150*b* of the coil electrodes 140 and 150 substantially coincide with the directions of the current flowing the main electrodes 141 and 151 in generation of the arc. Consequently, the plasma arc generated in the disconnection operation is effectively diffused.

[Ninth embodiment]

Hereafter, the ninth embodiment of the vacuum interrupter is elucidated with reference to drawings.

Figure 22:
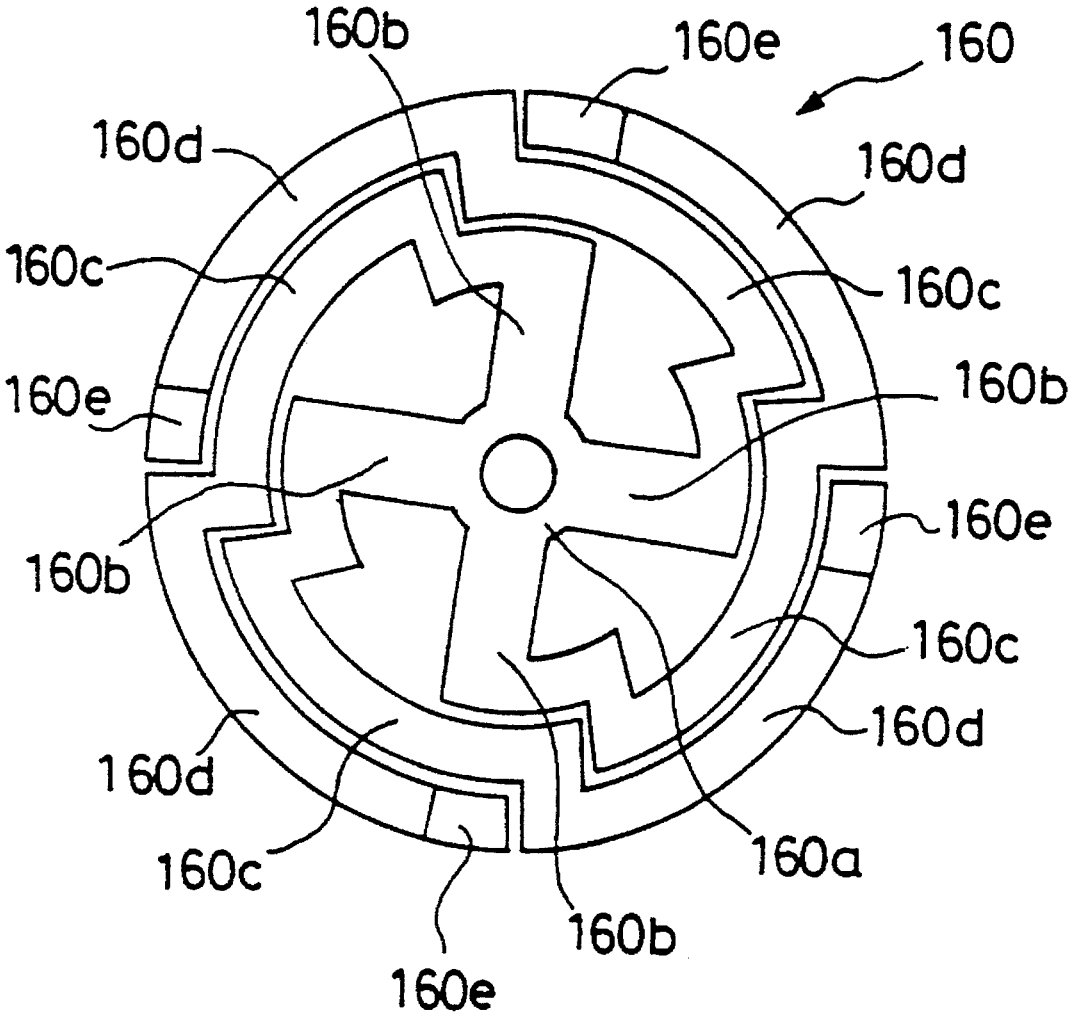
FIG. 22 is a plan view of a coil electrode of the vacuum interrupter in a ninth embodiment in accordance with the present invention.

FIG. 22 is a plan view of the coil electrode 160 of the electrode assembly of the vacuum interrupter in the ninth embodiment. In the ninth embodiment, elements with the exception of the coil electrode 160 are identical with the elements in the electrode assembly of the vacuum interrupter in the eighth embodiment.

As shown In FIG. 22, the coil electrode 160 in the ninth embodiment is provided with a ring-shaped holding part 160*a* which is put on the movable electrode rod at the central part, and four arm parts 160*b* extended from the holding part 160*a* in the radial direction. Furthermore, the coil electrode 160 is provided with first coil parts 160c connected to the arm parts 160*b* through bent parts and second coil parts 160*d* connected to the ends of the first coil parts 160*c* through other bent parts. Four first coil parts 160*c* and four second coil pares 160*d* are substantially arranged on the same circumference. Each coil part of the coil electrode 160 is formed by two arc-shaped arms connected by the bent parts. Consequently, double ring-shaped coil parts are formed on the circumferential portion of the coil electrode 160.

Contact parts 160*e* are protruded at the respective end parts of the second coil parts 160*d* in a manner similar to the coil parts 150*c* in the eighth embodiment. The contact parts 160*e* contact the back surface of the main electrode. Moreover, the arm parts 160*b* extended from the holding parts 160*a* are directed to the contact parts 160*e* of other arm parts 160*b*.

As mentioned above, since the extending directions of the arm parts 160*b* of the coil electrode 160 are substantially in coincidence with the directions of the current on the main electrode in generation of the arc, and the coil electrode 160 is formed by the double ring-shaped coil parts, a uniform magnetic field having a large intensity is generated in the axial direction, and the plasma arc is effectively diffused.

Incidentally, in the above-mentioned seventh, eighth and ninth embodiments, though the coil electrode has four arm parts, the number of the arm parts is not limited to four, but plural arm parts may be formed on the coil electrode in the seventh, eighth and ninth embodiments in order to obtain the same effect.

[Tenth embodiment]

Hereafter, the tenth embodiment of the vacuum interrupter is elucidated with reference to drawings.

Figure 23:
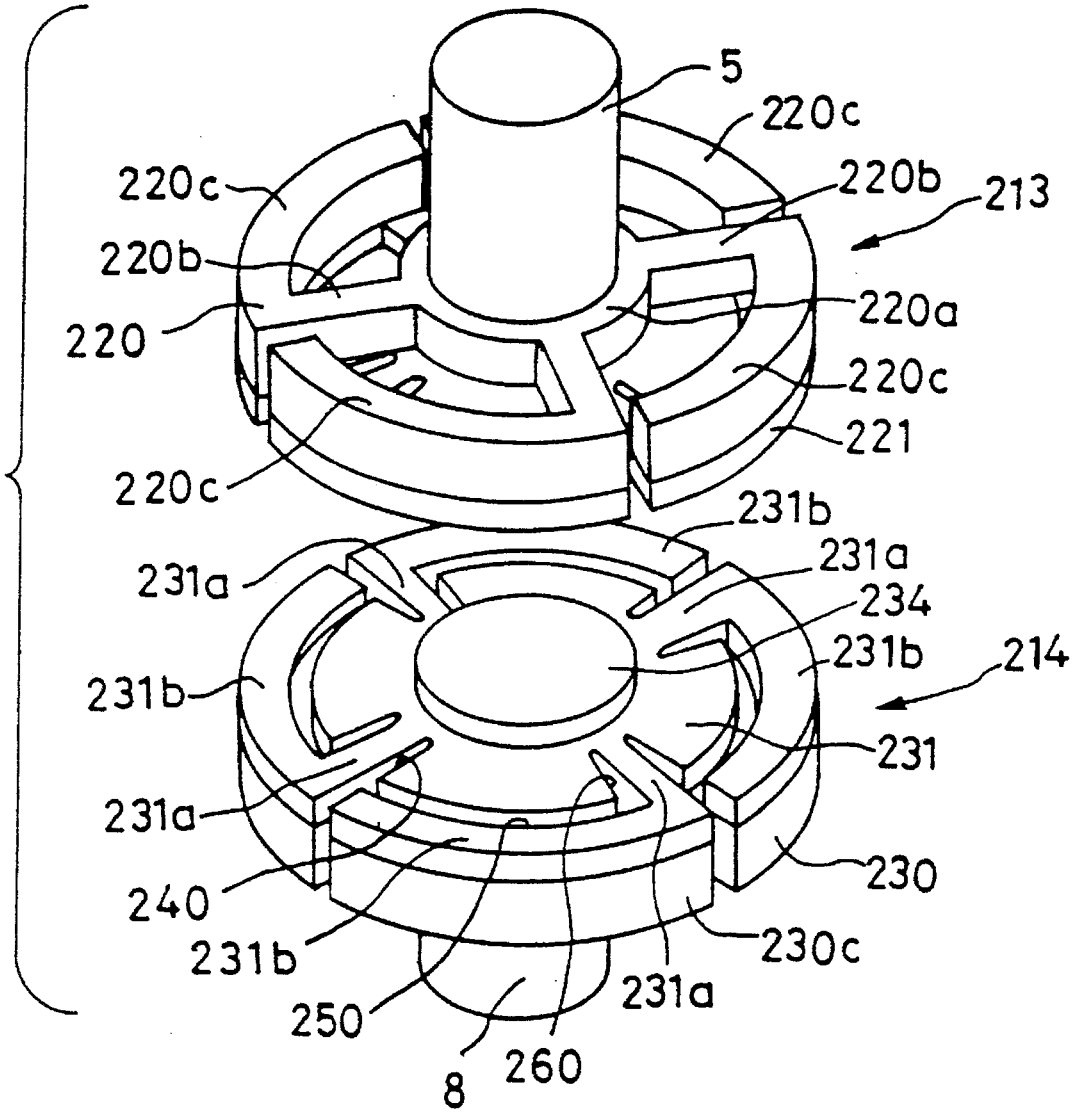
FIG. 23 is a perspective view of electrode assemblies of the vacuum interrupter in a tenth embodiment in accordance with the present invention.
Figure 24:
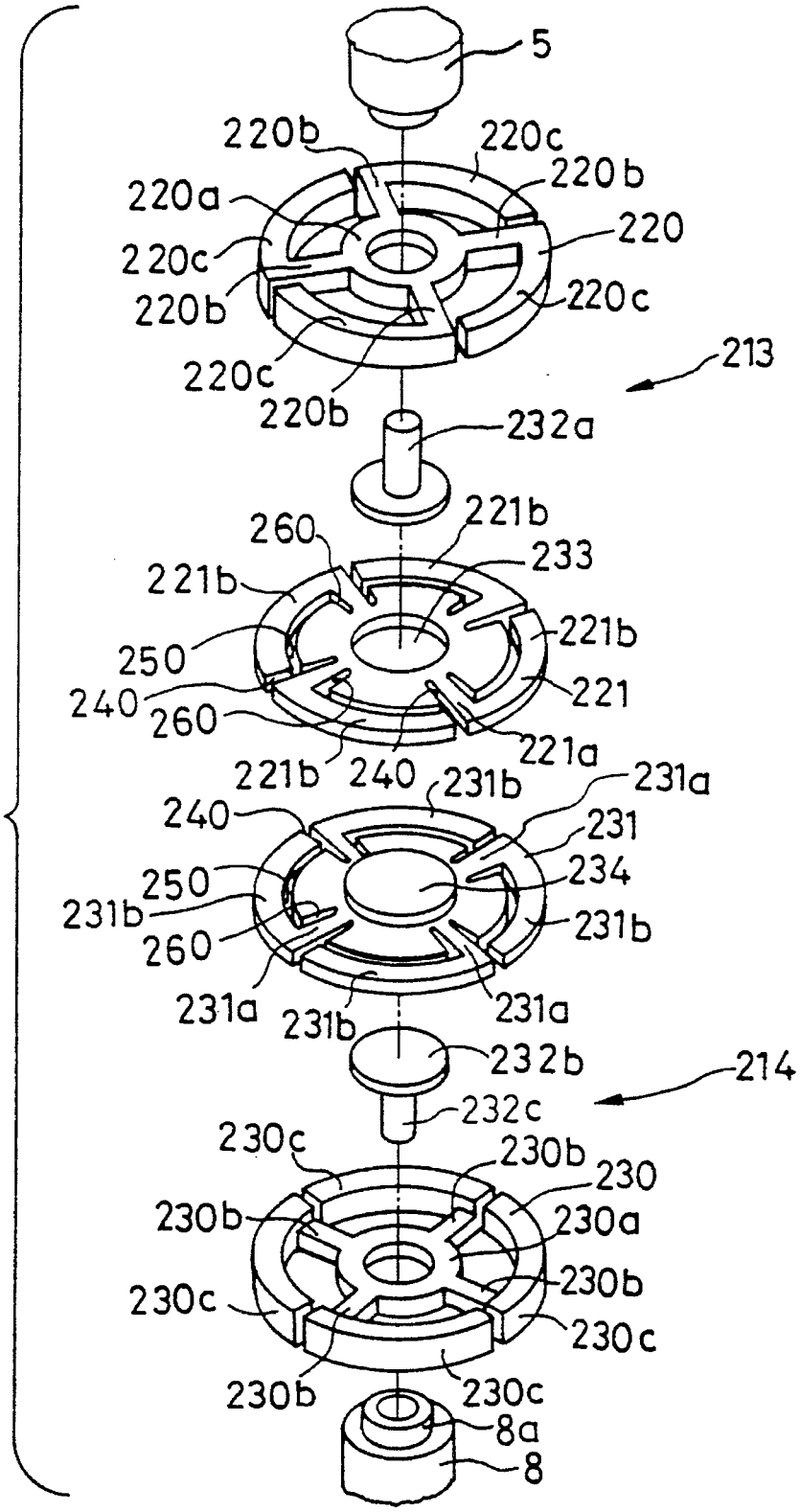
FIG. 24 is an exploded perspective assembly view of the electrode assemblies in FIG. 23.

FIG. 23 is a perspective view of the electrode assemblies of the vacuum interrupter in the tenth embodiment, and FIG. 24 is an exploded perspective assembly view of the electrode assemblies in FIG. 23.

The electrode assemblies of the vacuum interrupter shown in FIG. 23 are enclosed in the evacuated envelope, and are connected or disconnected with each other by an operation mechanism (not shown).

The electrode assemblies comprise a stationary electrode assembly 213 fixed on the evacuated envelope through an insulating member, a movable electrode assembly 214 which is moved upward to connect or downward to disconnect with the stationary electrode assembly 213 by the operation mechanism. The configuration of the stationary electrode assembly 213 is substantially identical with the configuration of the movable electrode assembly 214. As shown in the exploded perspective assembly view of FIG. 24, the stationary electrode assembly 213 comprises the stationary electrode rod 5, a stationary coil electrode 220, a stationary main electrode 221 and a support member 232*a*. The movable electrode assembly 214 comprises the movable electrode rod 8, a movable coil electrode 230, a movable main electrode 231 and a support member 232*b*.

The movable coil electrode 230 of the movable electrode assembly 214 is provided with a ring-shaped holding part 230*a* at the central part which is put on the boss 8*a* of the movable electrode rod 8. Four arm parts 230*b* are extended in the radial directions from the holding part 230*a*. The end surfaces of the arm parts 230*b* are connected to ends of respective arc-shaped coil parts 230*c*, and these four coil parts 230*c* are arranged substantially on the same circumference. The upper surfaces of the coil parts 230*c* shown in FIG. 24 are protruded upward from the holding parts 230*a* and the arm parts 230*b* so as to contact the back surface of the disc-shaped movable main electrode 231 at their entire surfaces.

As shown in FIG. 24, the movable main electrode 231 comprises first slots formed from the circumference to the vicinity of the center part, second slots 250 formed along the circumference and third slots 260 communicated with the ends of the first slots 250 and formed in the radial direction directed to the center part. Consequently, first arms 231*a* extending from the center part to the respective radial directions and arc-shaped second arms 231*b* connected to the respective first arms 231*a* are formed on the movable main electrode 231. These four second arms 231*b* are arranged on the same circumference of the movable main electrode 231.

A salient contact 234 is formed on the central part of the surface of the movable main electrode 231 opposing to the stationary main electrode 221. The salient contact 234 is a place to allow generation of the arc between the stationary main electrode 221 and the movable main electrode 231.

The movable main electrode 231 of the movable electrode assembly 214 is mechanically supported by a support member 232*b* which is inserted in a hole 233 (not shown) formed on the central lower face of the movable main electrode 231. A shaft 232*c* of the support member 232*b* is inserted in the movable electrode rod 8 to support the movable electrode assembly 214. The movable main electrode 231 is supported by a detent member (not shown) so as to prevent rotation of the movable main electrode 231 with respect to the stationary main electrode 221. Consequently, the movable main electrode 231 and the stationary main electrode 221 are arranged so as to always oppose at the respective predetermined positions.

The support member 232*b* is made of a high resistance material such as stainless steel, and thereby a current flowing directly between the movable main electrode 231 and the movable electrode rod 8 is restricted in generation of the arc.

On the other hand, the stationary electrode assembly 213 substantially has the same structure as the movable main electrode assembly 214, and they are arranged in point symmetry. The first arms 221*a* of the stationary main electrode 221 and the first arms 231*a* of the movable main electrode 231 are extended in substantially the same directions.

Figure 25:
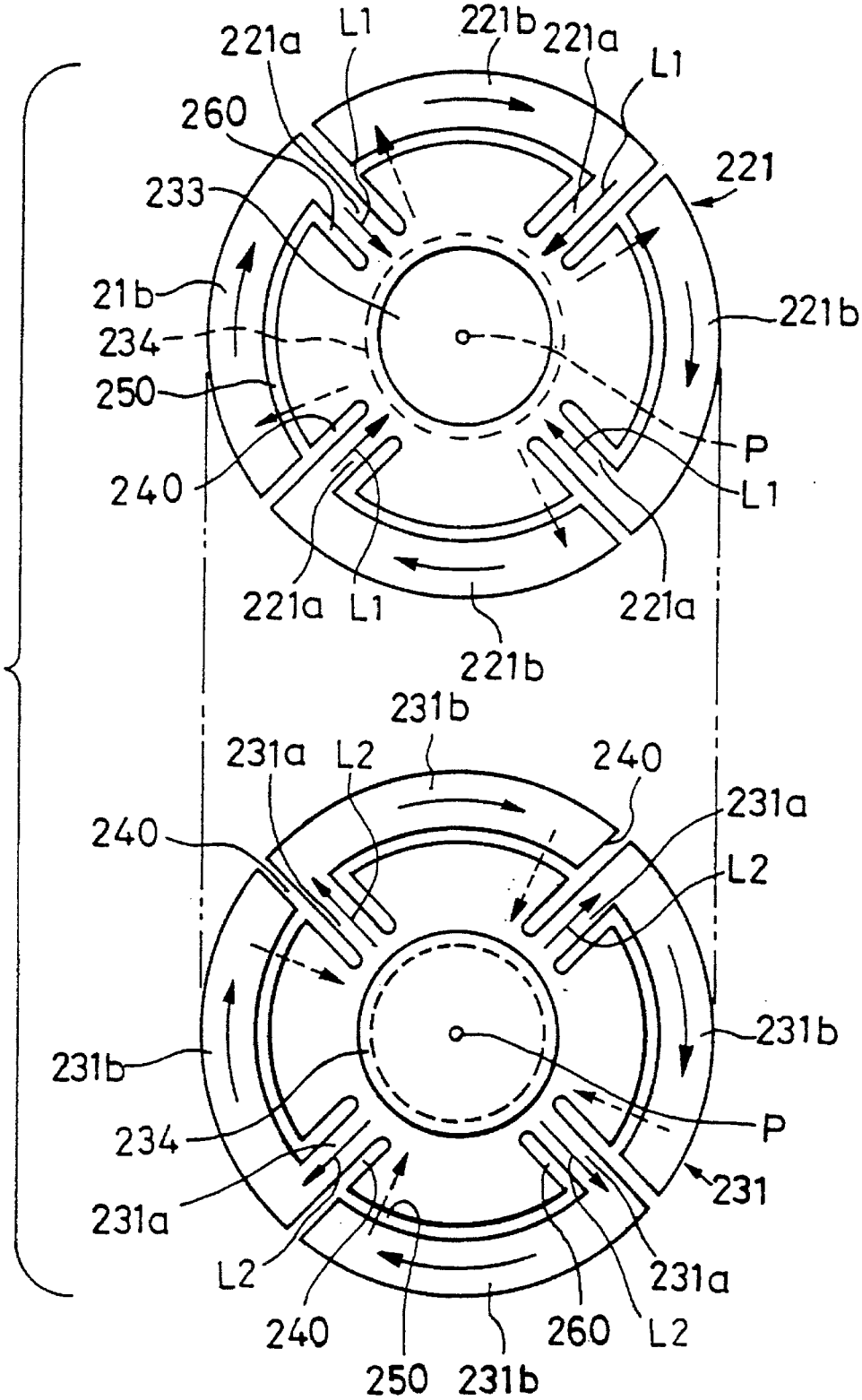
FIG. 25 is a plan view of the electrode assemblies shown in FIG. 23 illustrating flowing directions of currents.

Subsequently, in the vacuum interrupter of the tenth embodiment configured as mentioned above, a current flow in the electrode assemblies in generation of the arm is elucidated with reference to FIG. 25. FIG. 25 is a plan view of the stationary main electrode 221 and the movable main electrode 231 with illustration of the current flow. The plan view of the stationary main electrode 221 and the movable main electrode 231 is observed from the stationary electrode rod 5 in FIG. 24. Referring to FIG. 25, points A are generation points of the arc, and arrows represent the directions of the current. In the current flow on the stationary main electrode 221 shown in an upper portion of FIG. 25, the current passed through the arm parts 220*b* of the stationary coil electrode 220 shown in FIG. 24 mounted on the back face of the stationary main electrode 221 flows on the second arms 221*b* of the stationary main electrode 221 along the circumference. The current passed through the second arms 221*b* flows to the arc generation point A through the first arms 221*a* in the radial direction. Subsequently, in the movable main electrode 231 shown in a lower portion of FIG. 25, the current flows from the arc generation point A to the first arms 231*a* in the radial directions, and flows to the second arms 231*b* formed along the circumference. The current passed through the second arms 231*b* of the movable main electrode 231 flows to the movable electrode rod 8 through the arm parts 230*b* of the movable coil electrode 230 (shown in FIG. 24) mounted on the back face of the movable main electrode 231.

As shown in FIG. 25, the currents represented by arrows L1 (hereinafter is referred to as currents L1) flowing through the stationary main electrode 221 in the radial directions and the currents represented by arrows L2 (hereinafter is referred to as currents L2) flowing through the movable main electrode 231 in the radial directions flow on the paths which are arranged in opposed relationship with each other. Respective directions of the currents L1 and currents L2 are inverted with each other on both the paths. Therefore, the magnetic field generated by the currents L1 flowing the stationary main electrode 221 in the radial directions are countervailed by the magnetic field generated by the currents L2 flowing the movable main electrode 231 in the radial directions. Consequently, a uniform magnetic field is generated between both the electrodes in the axial direction by the current flowing the second arms 221*b* of the stationary main electrode 221 and the second arms 231*b* of the movable main electrode 231 along the circumference. The plasma arc generated between both the electrodes in disconnection operation is effectively diffused by the uniform magnetic field.

[Eleventh embodiment]

Figure 26:
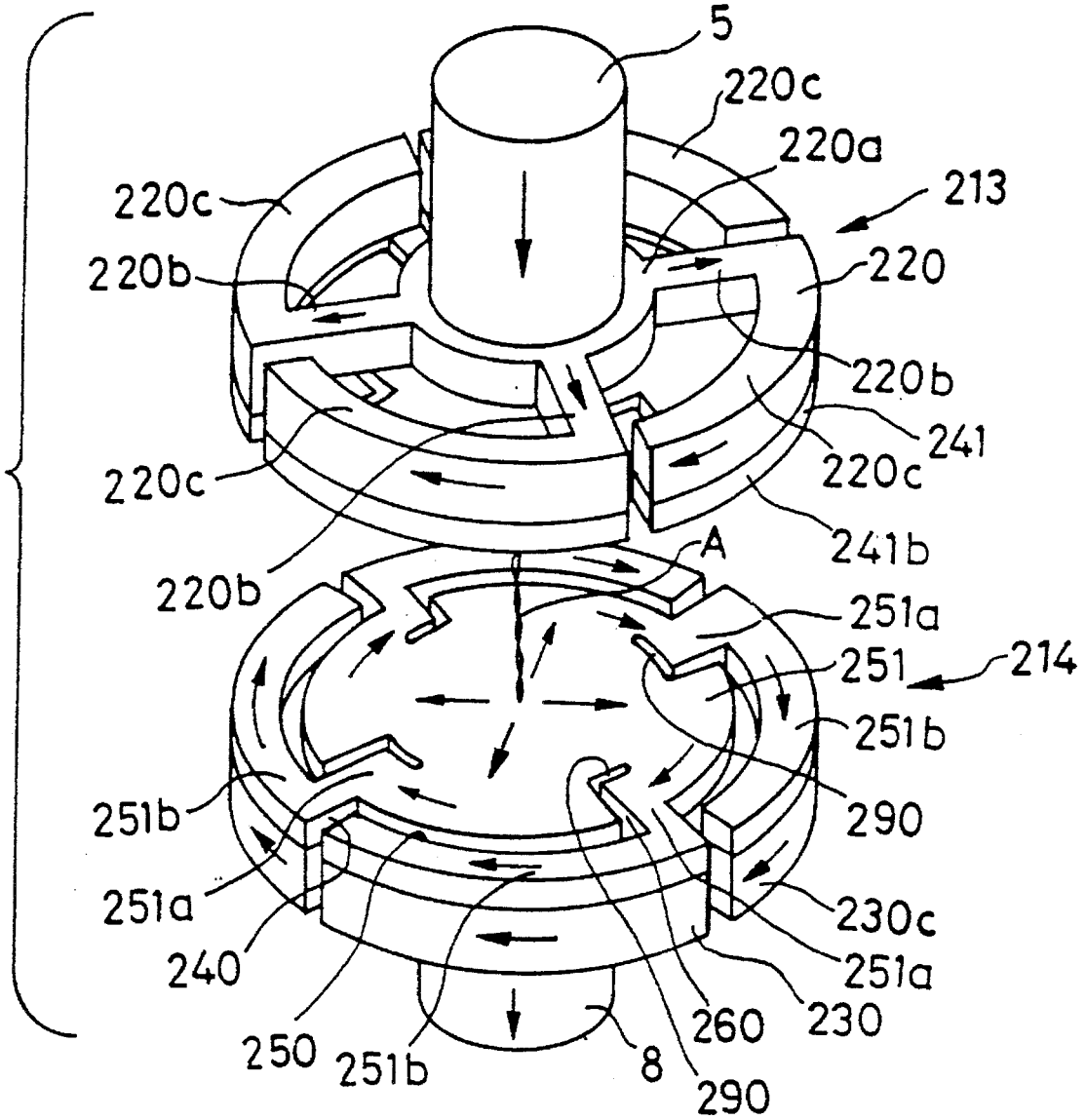
FIG. 26 is a perspective view of electrode assemblies of the vacuum interrupter in an eleventh embodiment in accordance with the present invention.

Hereafter, eleventh embodiment of the vacuum interrupter is elucidated with reference to FIG. 26.

FIG. 26 is a perspective view of the electrode assemblies of the vacuum interrupter in the eleventh embodiment. Referring to FIG. 26 elements having the same structure and function as the elements in the tenth embodiment are identified by like numerals, and the elucidation is omitted.

The stationary electrode assembly 213 and the movable electrode assembly 214 shown in FIG. 26 have substantially the same structure and are arranged in the evacuated envelope in opposed relationship to connect or disconnect with each other. The stationary electrode assembly 213 and the movable electrode assembly 214 are located in point symmetry. The stationary electrode assembly 213 and the movable electrode assembly 214 in the eleventh embodiment have the same configuration as that of the tenth embodiment. The stationary electrode assembly 213 comprises the stationary electrode rod 5, the stationary coil electrode 220, a stationary main electrode 241 and a support member (not shown in FIG. 26). The movable electrode assembly 214 comprises the movable electrode rod 8, the movable coil electrode 230, a movable main electrode 251 and a support member (not shown in FIG. 26).

As shown in FIG. 26, the movable main electrode 251 comprises second slots 250 formed along the circumference connected to the first slots 240 formed in the circumferential part in the radial direction, and third slots 260 formed in the directions of the center from the ends of the second slots 250 and fourth slots 290 formed along the circumference connected to the third slots 260. Consequently, first bent arms 251*a* and arc-shaped second arms 251*b* connected to the first arms 251*a* are formed on the movable main electrode 251. Four arc-shaped second arms 251*b* are formed on the same circumference of the movable main electrode 251.

Figure 27:
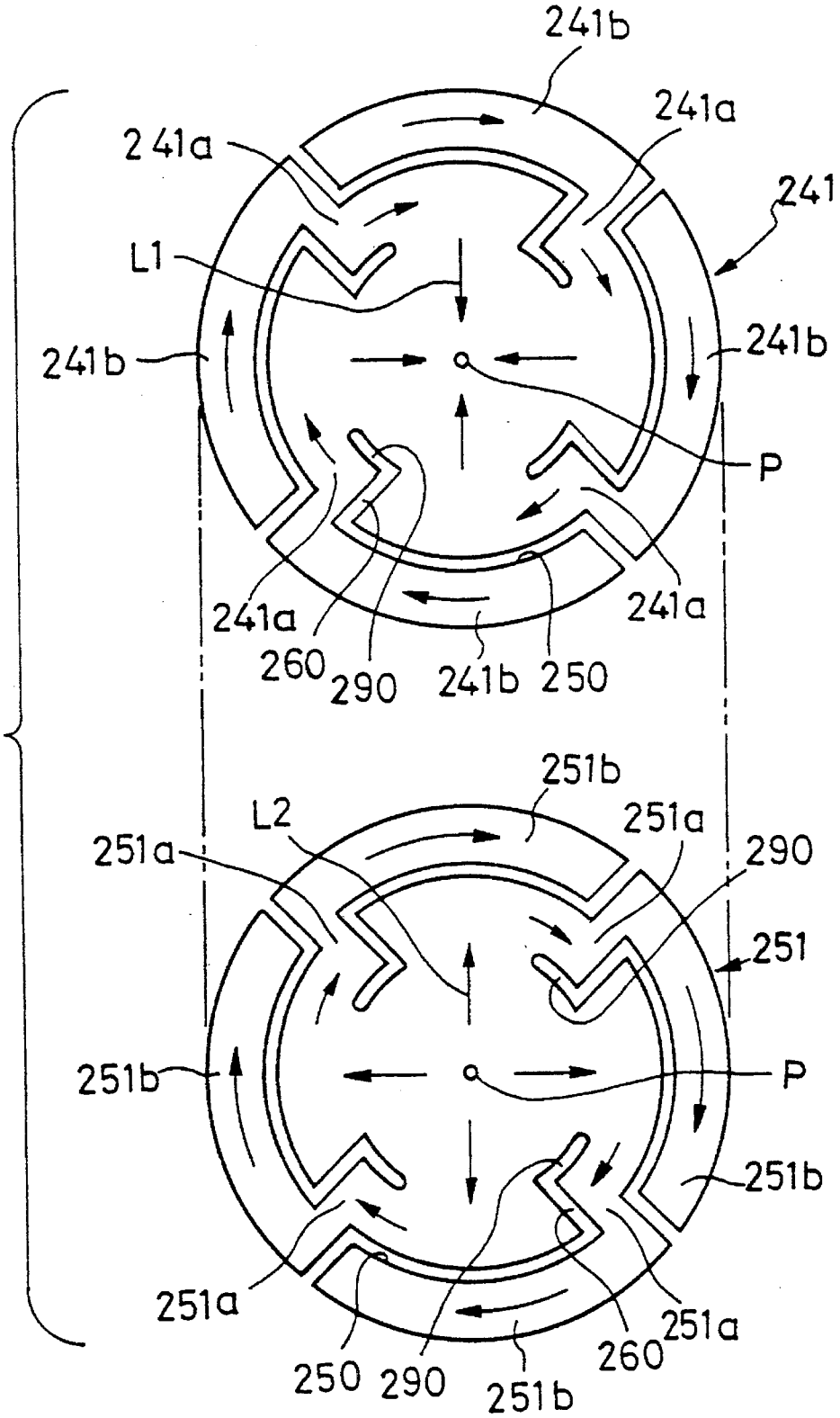
FIG. 27 is a plan view of the electrode assemblies shown in FIG. 26 illustrating flowing directions of currents.

The current flow in generation of the arc in the electrode assemblies in the eleventh embodiment is elucidated with reference to FIG. 27. FIG. 27 is a plan view of the stationary main electrode 241 and the movable main electrode 251 for representing the directions of current in generation of the arc. In FIG. 27, the stationary main electrode 241 and the movable main electrode 251 are observed from the stationary electrode rod 5 as shown in FIG. 26. Points P designate the arc generation points and arrows represent the direction of the current.

When the movable electrode assembly 214 is disconnected from the stationary electrode assembly 213 in FIG. 26 and the arc is generated at the position shown by the point P in FIG. 27, the current flows through the paths shown by arrows L1 in the stationary main electrode 241 and the paths shown by arrows L2 in the movable main electrode 251 in the radial directions. The currents L1 flowing the stationary main electrode 241 in the radial directions and the currents L2 flowing the movable main electrode 251 in the radial directions flow through the paths which are arranged in opposed relationship. Since the directions of the currents L1 and the currents L2 are inverted with each other, the magnetic field generated by the currents L1 flowing the stationary main electrode 241 in the radial directions are substantially countervailed by the magnetic field generated by the currents L2 flowing the movable main electrode 251 in the radial directions. Moreover, since the current flows the first arms 241*a* of the stationary main electrode 241 and the first arms 251*a* of the movable main electrode 251 along the circumference, the intensity of the magnetic field in the axial direction is enhanced between both the electrodes.

According to the eleventh embodiment, plural slots are formed on the stationary main electrode 241 and the movable main electrode 251, and the current paths flowing both the electrodes in the radial directions are regulated in a predetermined regions. Moreover, the movable main electrode 251 is opposed to the stationary main electrode 241 in a predetermined positional relationship with respect to the axes of both the electrodes. Consequently, a uniform magnetic field is generated between both the electrodes in the axial direction in disconnection operation, and the plasma arc generated between both the electrodes is effectively diffused.

Figure 28:
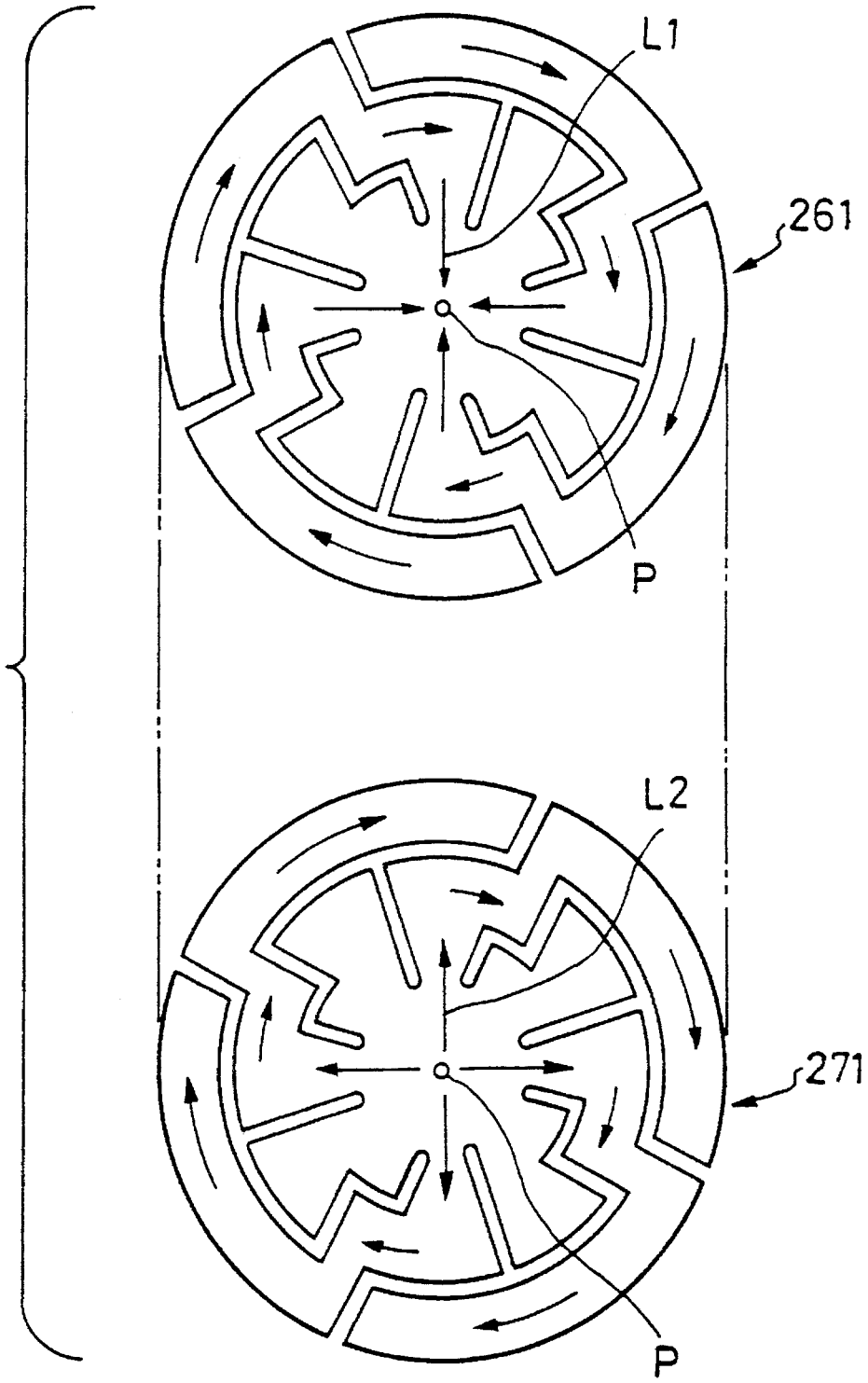
FIG. 28 is a plan view of an example of the electrode assemblies in the eleventh embodiment shown in FIG. 26.

FIG. 28 is a plan view of a stationary main electrode 261 and a movable main electrode 271 of other example in the eleventh embodiment. In the example, slots 261*a* and 271*a* having shapes shown in FIG. 28 are formed on the stationary main electrode 261 and the movable main electrode 271, respectively. Consequently, the current paths flowing the stationary main electrode 261 and the movable main electrode 271 in the radial directions are limited to desired narrow regions. Therefore, the directions of the currents flowing through the stationary main electrode 261 in the radial directions are made flow in inverse directions to the directions of the current flowing through the movable main electrode 271 in the radial directions. The magnetic field generated by the current flowing in both the electrodes in the radial directions are perfectly countervailed with each other, and thereby a uniform magnetic field in the axial direction is generated between both the electrodes.

[Twelfth embodiment]

Figure 29:
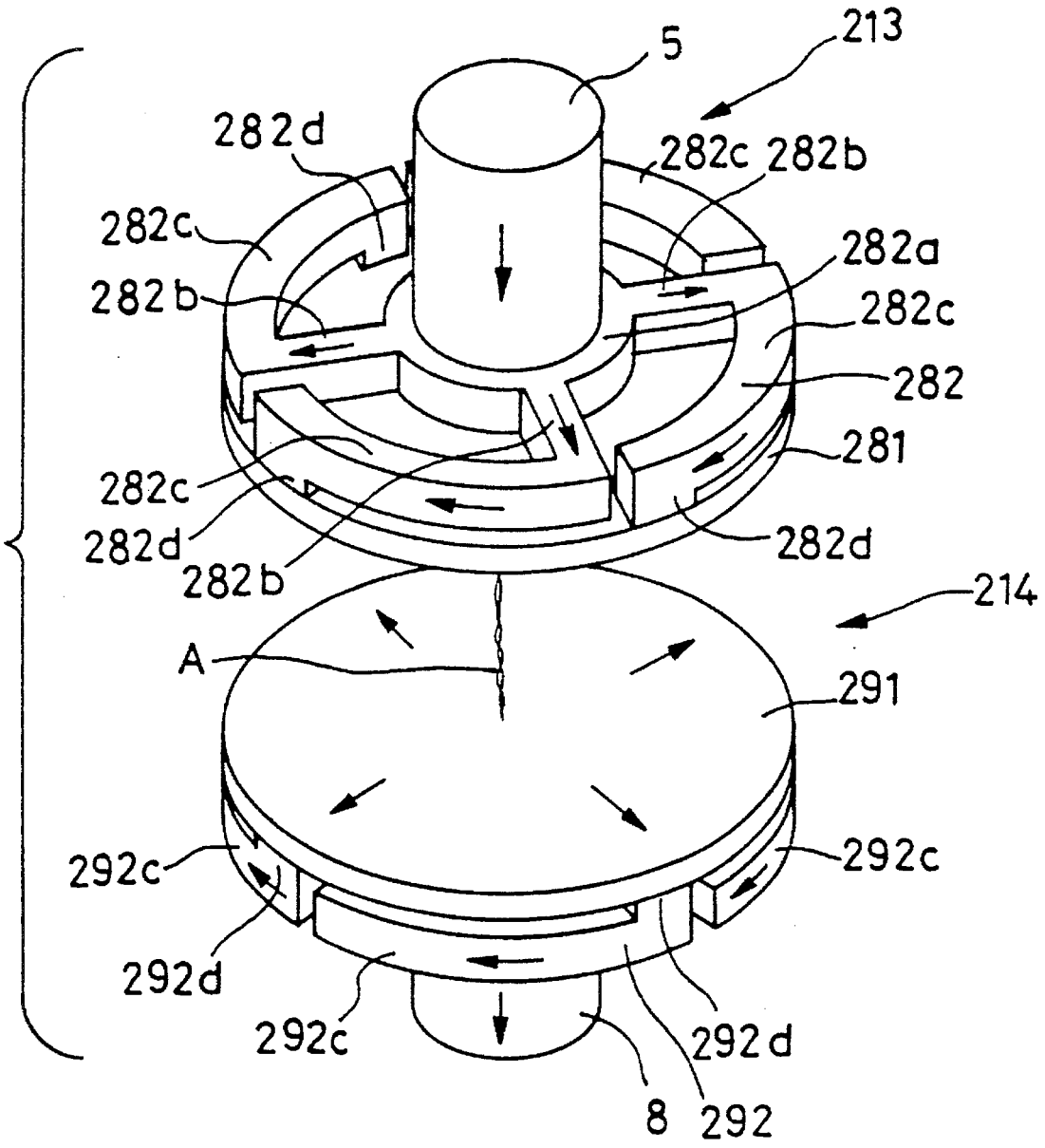
FIG. 29 is a perspective view of electrode assemblies of the vacuum interrupter in a twelfth embodiment in accordance with the present invention.

Hereafter, the twelfth embodiment of the vacuum interrupter is elucidated with reference to FIG. 29.

FIG. 29 is a perspective view of the electrode assemblies of the vacuum interrupter in the twelfth embodiment. Referring to FIG. 29, elements having the same structure and function as the elements in the tenth embodiment are identified by like numerals and the elucidation is omitted.

A stationary electrode assembly 213 and a movable electrode assembly 214 shown in FIG. 29 are arranged in the evacuated envelope in opposed relationship, and have substantially the same structure. The stationary electrode assembly 213 and the movable electrode assembly 214 are configured to connect or disconnect with each other, and are arranged in point symmetry.

As shown in FIG. 29, the stationary coil electrode 282 comprises a ring-shaped holding part 282*a* which is put on the stationary electrode rod 5 at the center part, four arm parts 282*b* extended from the holding part 282*a* in radial directions and four coil parts 282*c* connected to the respective arm parts 282*b*. A connect part 282*d* which protrudes in the direction of the movable electrode assembly 214 1s formed on the end part of each coil part 282*c* of the stationary coil electrode 282. The connect part 282*d* is electrically connected to the stationary main electrode 281. On the other hand, in a manner similar to the stationary coil electrode 282, a connect part 292*d* of the movable coil electrode 29 which protrudes in the direction of the stationary electrode assembly 213 is formed on the end part of each coil part 292*c* thereof. The connect part 292*d* is electrically connected to the movable main electrode 291.

As mentioned above, since the connect parts 282*d* of the stationary coil electrode 282 and the connect parts 292*d* of the movable coil electrode 292 protrude in opposed relationship to one another, the current in generation of the arc flows substantially in reverse radial directions with each other at the respective opposing positions of the stationary main electrode 281 and the movable main electrode 291. Therefore, the magnetic field generated by the current flowing through the stationary main electrode 281 in the radial directions and the magnetic field generated by the current flowing through the movable main electrode 291 in the radial directions are substantially countervailed.

By configuring the stationary electrode assembly 213 and the movable electrode assembly 214 as mentioned above, the current flowing through the stationary main electrode 281 and the movable main electrode 291 in substantially radial directions in generation of the arc are countervailed, and a uniform magnetic field in the axial direction is generated between both the electrodes by the current flowing through the respective coil parts of both the coil electrodes, and thereby the plasma arc effectively diffused.

Incidentally, in the tenth, eleventh and twelfth embodiments mentioned above, though the stationary coil electrode and the movable coil electrode comprise four arm parts, the number of the arm parts is not limited to four in the present invention. A similar effect to the above-mentioned embodiments may be realized by the coil electrodes having plural arm parts.

[Thirteenth embodiment]

In the vacuum interrupter, a high withstand voltage characteristic is required to withstand a voltage due to a shock wave other than the voltage in the frequency of an electric utility. For this reason, the vacuum interrupter must be configured so as to maintain the high withstand voltage characteristic between the stationary electrode and the movable electrode. In the conventional vacuum interrupter having the electrodes for generating the magnetic field in the axial direction, since the outer diameter of the main electrode is substantially equal to the outer diameter of the coil electrode, a radius of curvature in the circumferential part of the main electrode must be increased in order to improve the withstand voltage characteristic. In order to increase the radius of curvature, a thickness of the main electrode must be increased, and thus there is a difficulty to miniaturize the vacuum interrupter.

The inventions of the thirteenth through sixteenth embodiment are directed to obtain the vacuum interrupter improved in the withstand voltage characteristic between both the electrodes and having a superior disconnection characteristic.

Hereafter, the thirteenth embodiment of the vacuum interrupter is elucidated with reference to drawings.

Figure 30:
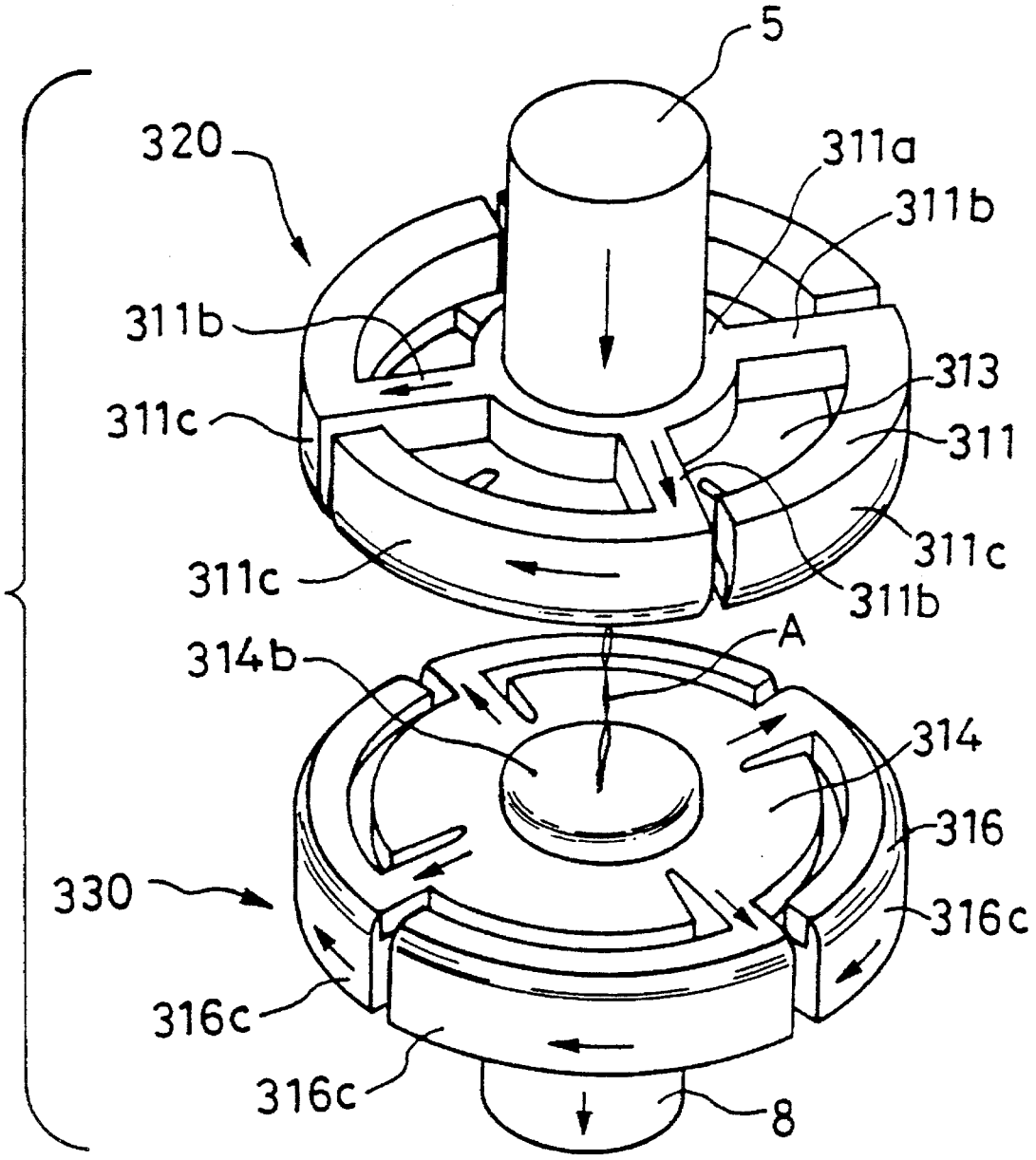
FIG. 30 is a perspective view of electrode assemblies of the vacuum interrupter in a thirteenth embodiment in accordance with the present invention.
Figure 31:
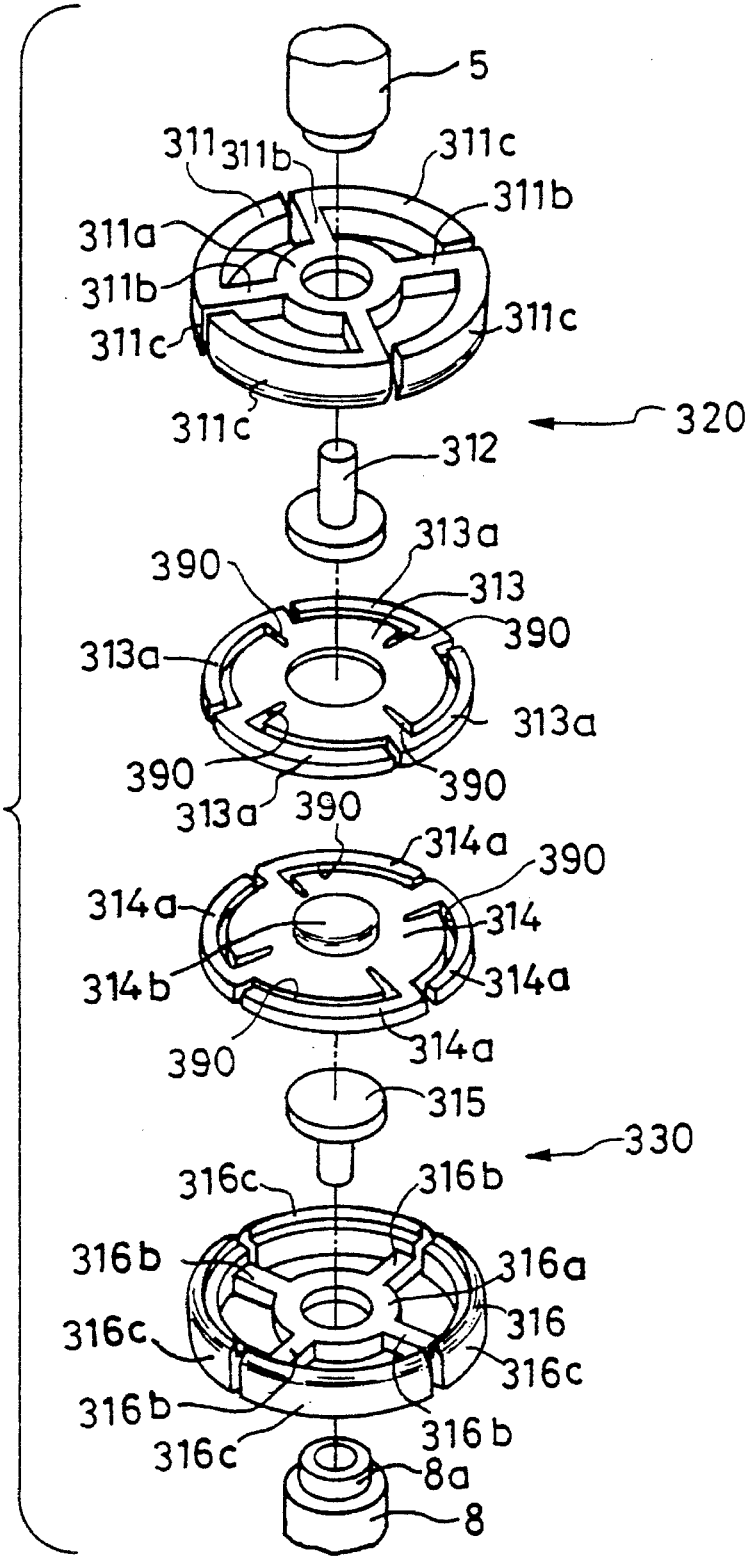
FIG. 31 is an exploded perspective assembly view of the electrode assemblies shown in FIG. 30.
Figure 32:
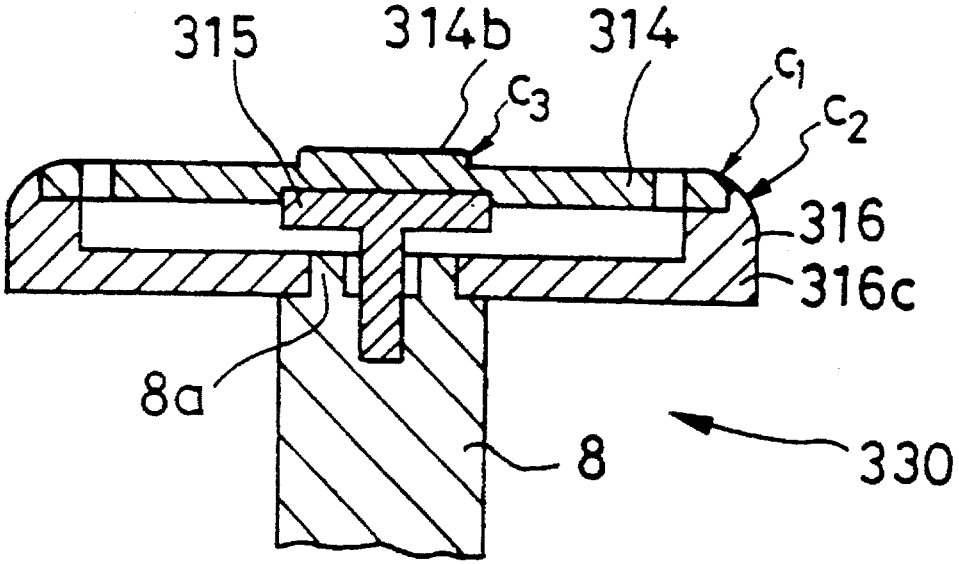
FIG. 32 is a cross-section of relevant parts of the movable electrode assembly shown in FIG. 30.

FIG. 30 is a perspective view of the electrode assemblies of the vacuum interrupter in the thirteenth embodiment, and FIG. 31 is an exploded perspective assembly view of the electrode assemblies in FIG. 30. FIG. 32 is a cross-section of a movable electrode assembly 330 in FIG. 30.

Both the electrode assemblies of the vacuum interrupter shown in FIG. 30 are arranged in the evacuated envelope, and are configured to connect or disconnect with each other by the operation mechanism (not shown). The electrode assemblies comprise a stationary electrode assembly 320 fixed on the evacuated envelope through an insulating member and a movable electrode assembly 330 which is connected or disconnected with the stationary electrode assembly 320 by moving upward or downward by activation of the operation mechanism. The configuration of the stationary electrode assembly 320 is substantially identical with that of the movable electrode assembly 330, and one of them is inverted and is arranged in opposed relationship to the other. As shown in the exploded perspective assembly view of FIG. 31, the stationary electrode assembly 320 comprises the stationary electrode rod 5, a stationary coil electrode 311, a support member 312 and a stationary main electrode 313, and the movable electrode assembly 330 comprises the movable electrode rod 8, a movable coil electrode 316, a support member 315 and a movable main electrode 314.

As shown in FIG. 31, the stationary coil electrode 311 comprises a ring-shaped holding part 311*a* put on the stationary electrode rod 5 at the center part, four arm parts 311*b* extended from the holding part 811*a* in the radial directions and coil parts 311*c* connected to the respective arm parts 311*b*. The movable coil electrode 316 comprise a ring-shaped holding part 316*a* put on the boss 8*a* of the movable electrode rod 8 at the center part, and four arm parts 316*b* extended from the holding part 316*a* to the radial directions. The end surface of each arm part 316*b* is connected to an end of each arc-shaped coil part 316*c*, and these coil parts 316*c* are substantially arranged on the same circumference. As shown in FIG. 31, a circular stepped pit is formed on the upper surface (the face opposed to the stationary electrode assembly 320) of the coil parts 316*c*, and in which the movable main electrode 314 is inserted.

The movable main electrode 314 is provided with four arc-shaped circumference parts 314*a* separated from the movable main electrode 314 by respective slots 390. These circumferential pares 314*a* of the main electrode 314 is inserted in the stepped pie formed on the upper surface of the coil part 316*c* of the movable coil electrode 316. Moreover, a salient contact 314*b* which serves as an arc generation position is formed on the center part of the surface of the movable main electrode 314 opposing to the stationary main electrode 313.

FIG. 32 is a cross-section of the movable electrode assembly 330, showing the state that the movable main electrode 314 is inserted in the movable coil electrode 316. As shown in FIG. 32, the circumferential part of the surface of the movable main electrode 314 opposing to the stationary main electrode 313 is made to a curved surface having a radius of curvature $c_1$. Moreover, the circumferential part opposing to stationary main electrode 313 of the coil part 316*c* of the movable coil electrode 316 is made to a curved surface having a radius of curvature $C_2$. In a similar manner, the circumferential edge of the salient contact 314*b* is made to a curved surface of a radius of curvature $C_3$. The radius of curvature $c_2$ of the circumferential part of the coil parts 316*c* is made to be equal to the radius of curvature $c_1$ of the circumferential part of the movable main electrode 314 or to be larger than the radius of curvature $c_1$.

The stationary coil electrode 311 and the movable coil electrode 316 are made of alloy of Cu or Ag including Cu, Cu+Cr as main material.

As shown in FIG. 31, the support member 315 is made of high resistance material such as stainless steel and mechanically supports the movable main electrode 314 by contacting the lower surface of the movable main electrode 314. A dot-shaped shaft 315*a* extending in the axial direction of the support member 315 is inserted in a support hole formed on the boss 8*a* of the movable electrode rod 8 and is fixed thereby.

Subsequently, in the electrode assemblies of the thirteenth embodiment configured as mentioned above the current flow in generation of the arc is elucidated with reference to FIG. 30.

When the movable electrode assembly 330 is disconnected from the stationary electrode assembly 320, an arc A is generated between a salient contact formed on a hidden surface of the stationary main electrode 313 and the salient contact 314*b* of the movable main electrode 314. At this time, the current flows from the stationary electrode rod 5 to the arc generation point of the stationary main electrode 313 through the stationary coil electrode 311, for example.

Subsequently, in the movable electrode assembly 330, the current flows from the arc generation point to the movable electrode rod 8 through the movable main electrode 314 and the movable coil electrode 316. Consequently, since the current flows along the circumference of the coil parts 311*c* of the stationary electrode assembly 320 and the coil parts 316*c* of the movable electrode assembly 330, the magnetic field in the axial direction is generated between both the electrodes, and the plasma arc generated in the disconnection operation is diffused and is arc-extinguished.

In the vacuum interrupter of the thirteenth embodiment, an electric field on the circumferential parts of the electrode assemblies 320 and 330 is relaxed by means of the curved part formed on the circumferential parts of the main electrodes and the coil electrodes. Moreover, since the coil parts 311*c* and 316*c* of the respective coil electrodes 311 and 316 are configured so as to oppose directly, the magnetic field in the axial direction is effectively generated between both the electrodes. Consequently, the vacuum interrupter of the thirteenth embodiment is superior in the withstand voltage characteristic and disconnection characteristic and is usable for a switch in a high voltage circuit.

[Fourteenth embodiment]

Figure 33:
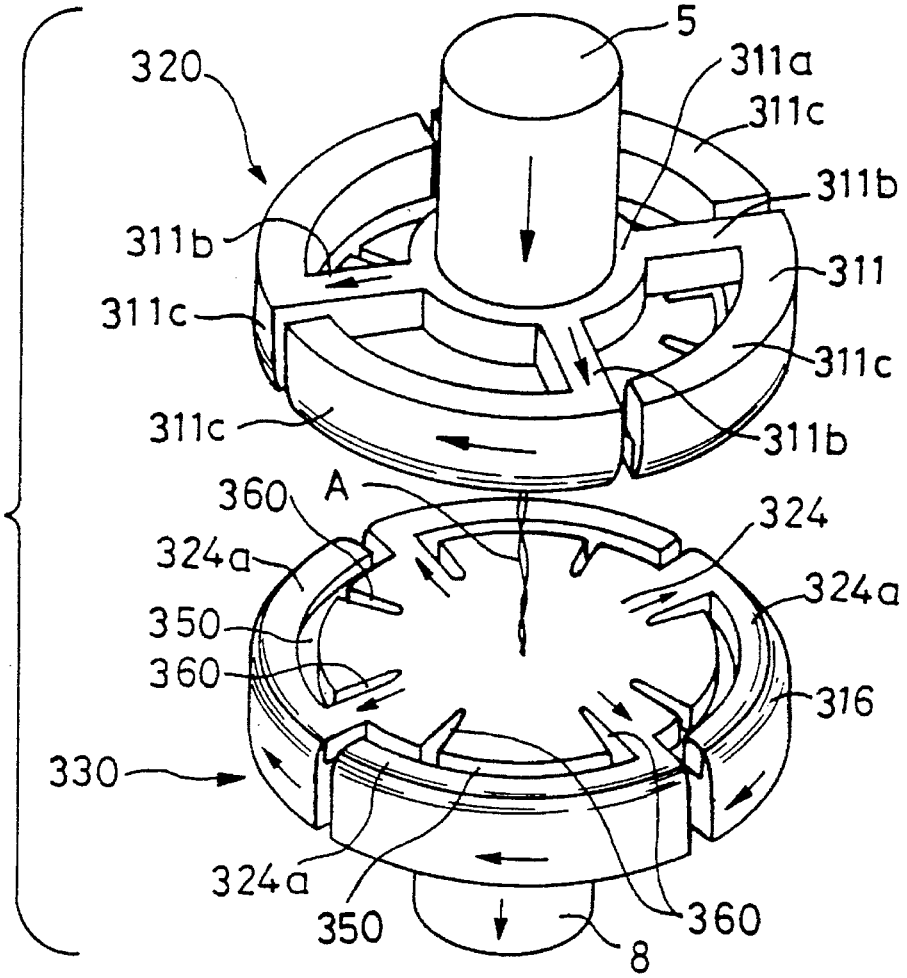
FIG. 33 is a perspective view of electrode assemblies of the vacuum interrupter in a fourteenth embodiment in accordance with the present invention.
Figure 34:
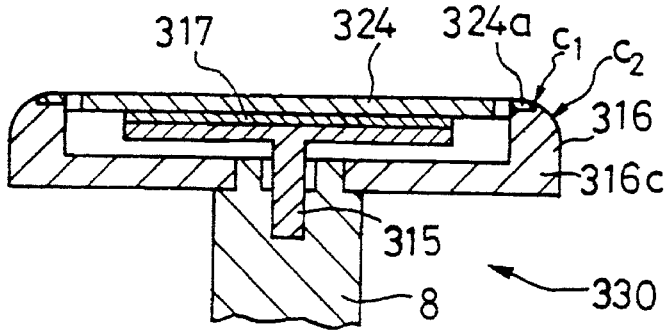
FIG. 34 is a cross-section of the movable electrode assembly shown in FIG. 33.

Hereafter, the fourteenth embodiment of the vacuum interrupter is elucidated with reference to drawings. FIG. 33 is a perspective view of the electrode assemblies of the vacuum interrupter in the fourteenth embodiment, and FIG. 34 is a cross-section of a movable electrode assembly 330 in the electrode assemblies of FIG. 33. In FIGS. 33 and 34, elements having the same structure and function as the elements in the thirteenth embodiment are identified by like numerals and the elucidation is omitted.

The stationary electrode assembly 320 and the movable electrode assembly 330 shown in FIG. 33 are arranged in the evacuated envelope in opposed relationship and have substantially the same structure. The movable electrode assembly 330 is configured to connect or disconnect with the stationary electrode assembly 320, and they are arranged in point symmetry. As shown in FIGS. 33 and 34, the movable electrode assembly 880 comprises the movable coil electrode 316 having curved circumferential part and a movable main electrode 324 having plural slots 360 in the radial directions. Furthermore, the movable main electrode 324 is provided with slots 350 along the circumference. The movable main electrode 324 is inserted in the circular stepped pit of the movable coil electrode 316 in a similar manner shown in FIG. 33. The plural slots 360 formed on the movable main electrode 324 in the radial directions regulate the direction of the current to desired directions in the movable main electrode 324 in generation of the arc. Consequently, a uniform magnetic field in the axial direction is generated between both the electrodes by the current flowing along the circumference of the coil parts 316*c* of the movable coil electrode 316.

In the cross-section of FIG. 34, a cross-shaped conducting member or a disk-shaped conducting member 317 is formed on the upper surface of the support member 315 contacting the movable main electrode 324. The conducting member 317 is made of a good conductor and serves to effectively lead the current flowed in the movable main electrode 324 to the circumferential part 324*a* of the movable main electrode 324. The current in generation of the arc is effectively led to the circumferential parts of both the electrodes and the coil parts of both the coil electrodes by contacting the conducting member 317 to the back face of the movable main electrode 324. Thereby the intensity of the magnetic field in the axial direction is enhanced between both the electrodes.

As shown in FIG. 34, the radius of curvature $c_2$ of the circumferential parts of the coil parts 316*c* is made to be equal to or more than the radius of curvature $c_1$ of the circumferential parts 324*a* of the movable main electrode 324. In the vacuum interrupter of the fourteenth embodiment configured as mentioned above, since the concentration of electric field on the opposed surfaces of both the electrode assemblies is relaxed and the coil parts of both the coil electrodes are made to directly oppose with each other, the vacuum interrupter in the fourteenth embodiment is superior in the withstand voltage characteristic and the disconnection characteristic.

[Fifteenth embodiment]

Figure 35:
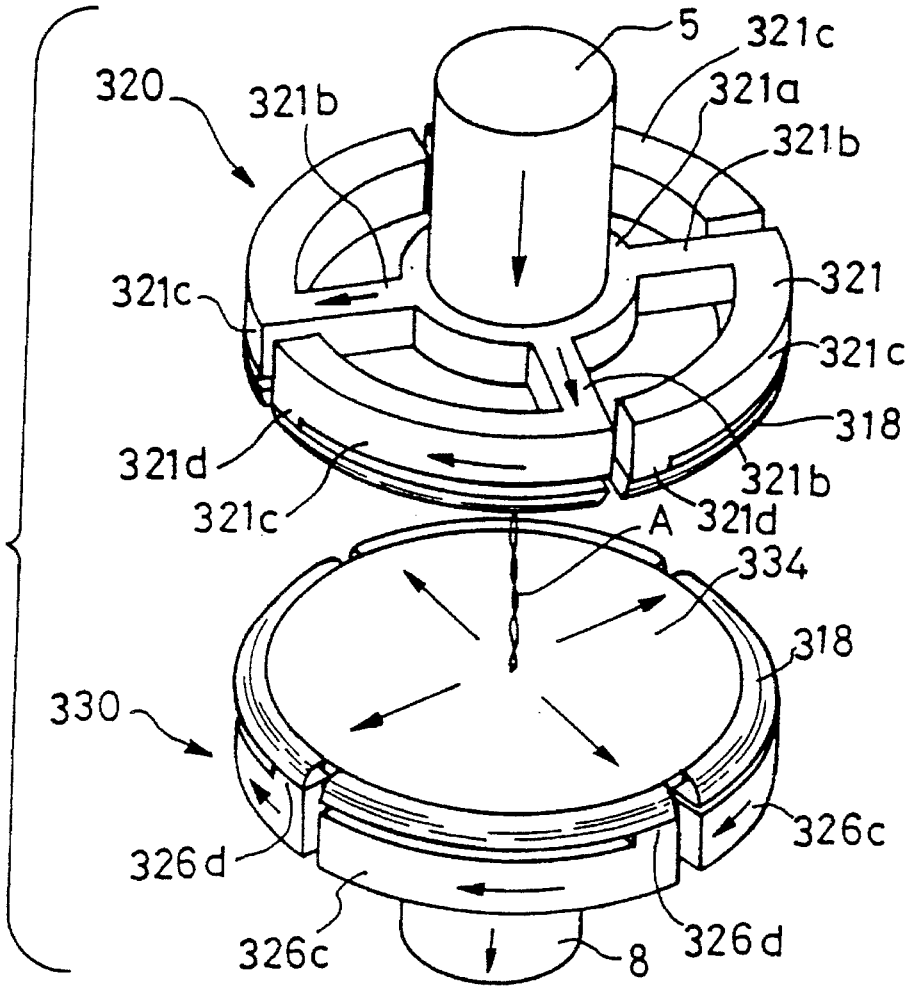
FIG. 35 is a perspective view of electrode assemblies of the vacuum interrupter in a fifteenth embodiment in accordance with the present invention.
Figure 36:
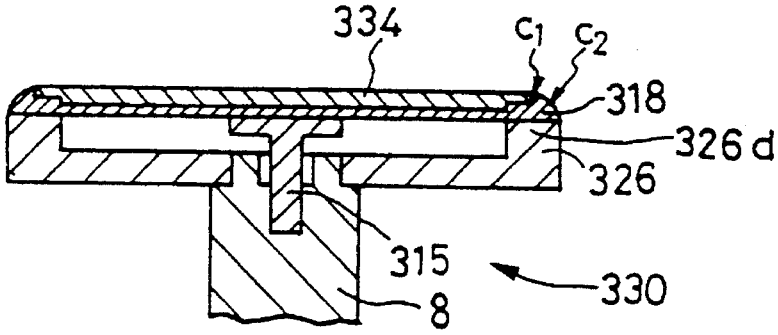
FIG. 36 is a cross-section of a movable electrode assembly shown in FIG. 35.

Hereafter, the fifteenth embodiment of the vacuum interrupter is elucidated with reference to figures. FIG. 35 is a perspective view of the electrode assemblies in the fifteenth embodiment, and FIG. 36 is a cross-section of a movable electrode assembly 330 in the electrode assemblies of FIG. 35. Referring to FIGS. 35 and 36, elements having the same structure and function as the elements in the thirteenth embodiment are identified by like numerals and the elucidation is omitted.

Referring to FIG. 35, the stationary electrode assembly 320 and the movable electrode assembly 330 and have substantially the same configuration and are arranged in the evacuated envelope in opposed relationship. The movable electrode assembly 330 is configured to connect or disconnect with the stationary electrode assembly 320, and the stationary electrode assembly 320 and the movable electrode assembly 330 are arranged in point symmetry.

As shown in FIG. 35, the stationary coil electrode 321 comprises a ring-shaped holding part 321*a* put on the stationary electrode rod 5 at the center part, four arm parts 321b extended from the holding part 321*a* in the radial directions and coil parts 321*c* connected to the respective arm parts 321*b*. Contact parts 321*d* formed at the ends of the coil parts 321*c* of the stationary coil electrode 321 protrude to electrically contact a holding conductor 318 fixed on the back surface (upper surface in FIG. 35) of the stationary main electrode.

FIG. 36 is a cross-section of the movable electrode assembly 330 configured in a manner similar to the stationary electrode assembly 320. As shown in FIG. 36, a holding conductor 318 made of a good conductor is fixed on the back surface (lower surface in FIG. 35) of the movable main electrode 334. Contact parts 326*d* formed at the end parts of the coil parts 326*c* of the movable coil electrode 326 are electrically connected to the holding conductor 318. The radius of curvature $c_2$ of the circumferential part of the holding conductor 318 is made to be equal to or more than the radius of curvature $c_1$ of the circumferential part of the movable main electrode 334. In the vacuum interrupter of the fifteenth embodiment configured as mentioned above, since the concentration of electric field on the opposing surfaces of both the electrode assemblies is relaxed, and the holding conductors 318 of the good conductor formed on both the coil electrodes are directly opposed, the magnetic field in the axial direction is effectively generated between both the electrodes.

[Sixteen embodiment]

Figure 37:
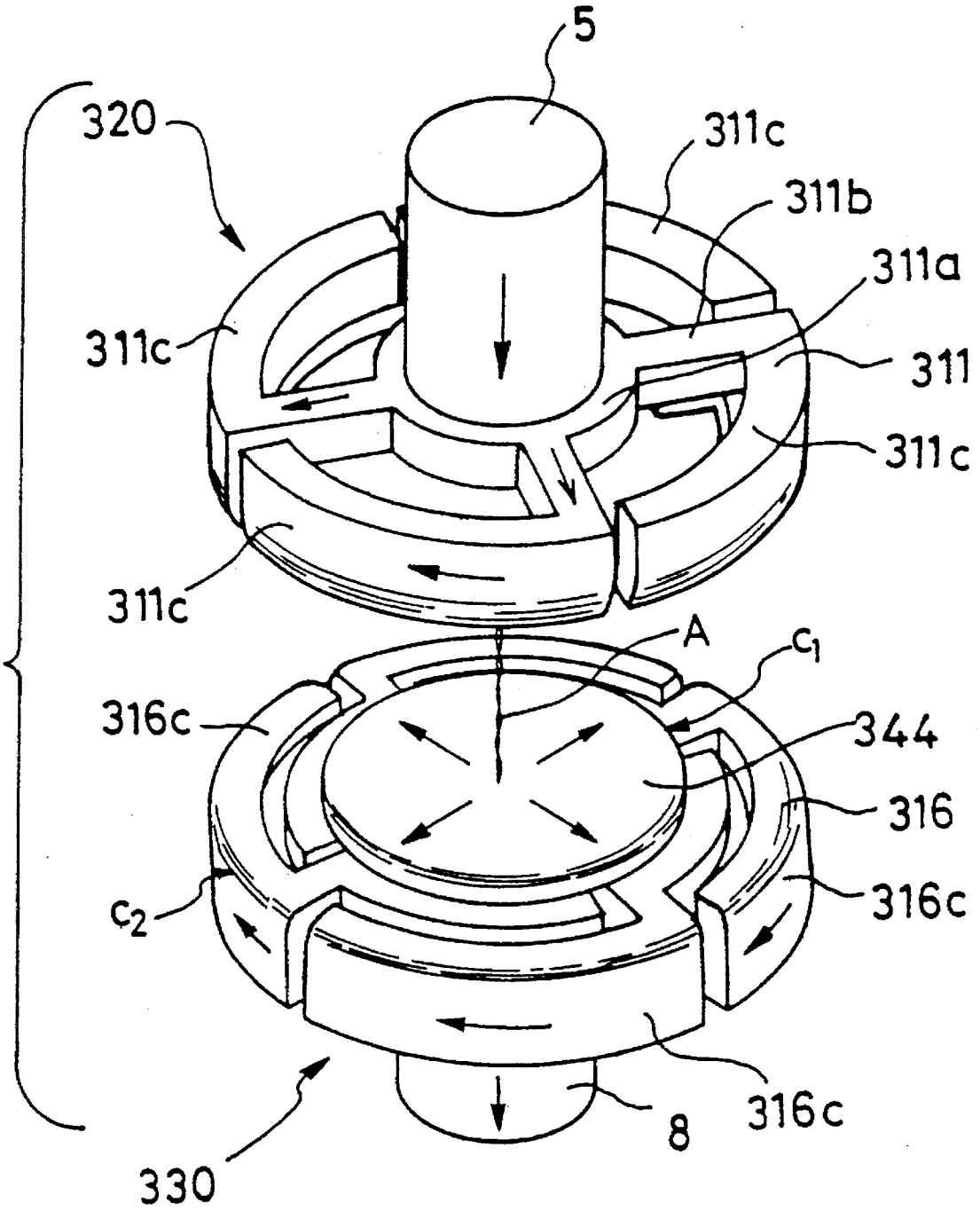
FIG. 37 is a perspective view of electrode assemblies of the vacuum interrupter in a sixteenth embodiment in accordance with the present invention.

Hereafter, the sixteenth embodiment of the vacuum interrupter is elucidated with reference to drawings. FIG. 37 is a perspective view of the electrode assemblies of the vacuum interrupter in the sixteenth embodiment. Referring to FIG. 37, elements having the same structure and function as the elements of thirteenth embodiment are identified by like numerals and the elucidation is omitted. The stationary electrode assembly 320 and the movable electrode assembly 330 shown in FIG. 37 have substantially the same structure and are arranged in the evacuated envelope in opposed relationship. The movable electrode assembly 330 is configured to connect or disconnect with the stationary electrode assembly 320. The stationary electrode assembly 320 and the movable electrode assembly 330 are arranged in point symmetry.

As shown in FIG. 37, a disk-shaped movable main electrode 344 is mounted on the surface opposing to the stationary electrode assembly 320 of the movable coil electrode 316. The diameter of the movable main electrode 344 is made to be smaller than the inner diameter of the coil parts 316*c* of the movable coil electrode 316. Moreover, the radius of curvature $c_2$ of the circumferential part of the surface opposing to the stationary coil electrode 311 of the movable coil electrode 316 is made to be equal to or larger than the radius of curvature $c_1$ of the circumferential part of the movable main electrode 344. Consequently, in a manner similar to the embodiments as mentioned above, the concentration of the electric field on the opposed surfaces of both the electrode assemblies is relaxed in the sixteenth embodiment.

Figure 38:
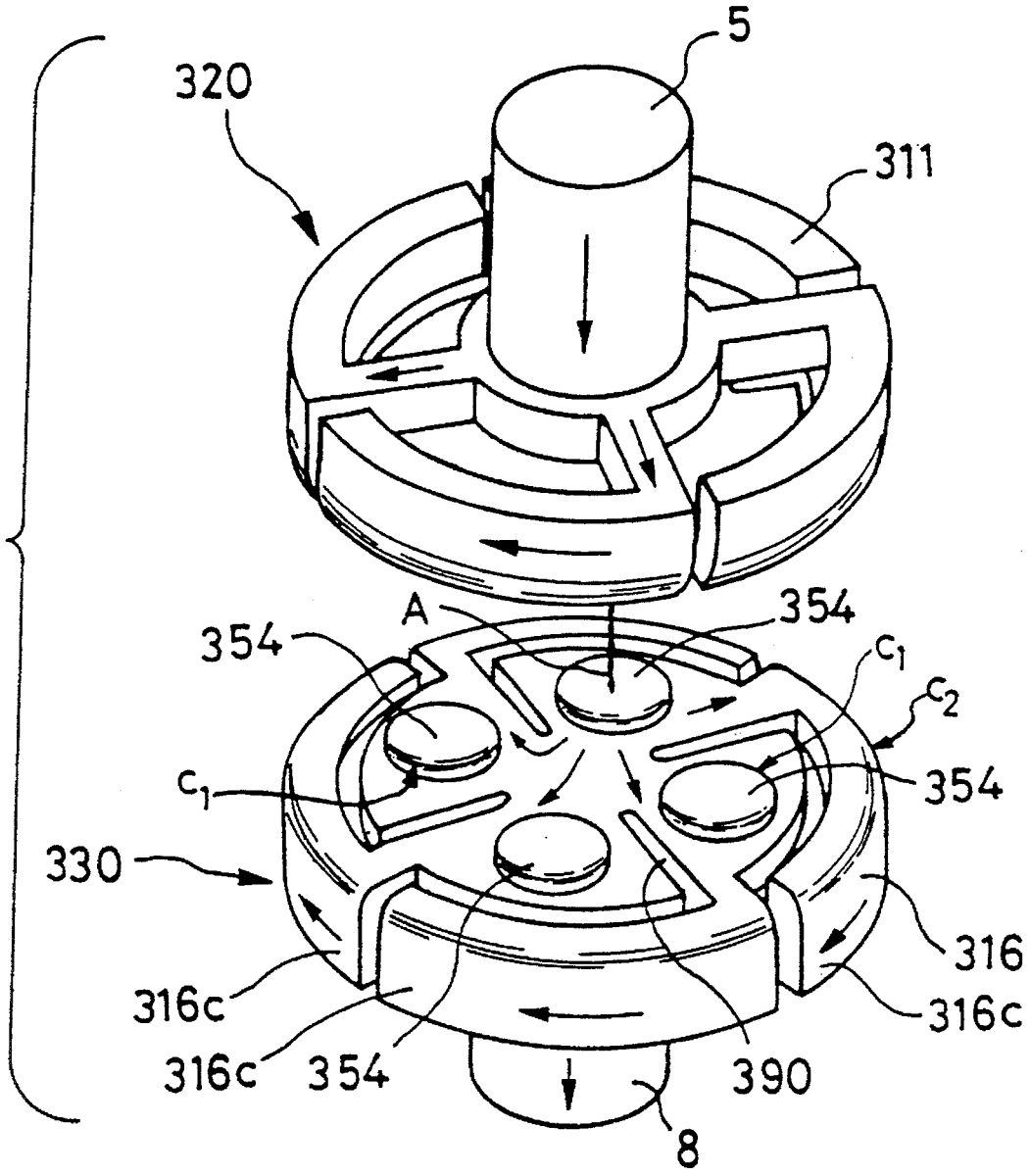
FIG. 38 is a perspective view of the electrode assemblies of an example of the sixteenth embodiment.

FIG. 38 is a perspective view of an example of the electrode assemblies of the vacuum interrupter in the sixteenth embodiment. In the example, plural movable main electrodes 354 are formed on the opposed surfaces of both the coil electrodes 311 and 316, and these plural movable main electrodes 354 are substantially separated by the slots 390 with each other. As shown in FIG. 38, the radius of curvature $c_2$ of the circumferential part on the opposing surfaces of the movable coil electrode 316 is made to be equal to or larger than the radius of curvature $c_1$ of the circumferential part of the movable main electrode 354.

In the vacuum interrupter in the sixteenth embodiment configured as mentioned above, the electric field on the opposing surfaces of both the electrode assemblies is relaxed, and the magnetic field in the axial direction is effectively generated between both the electrodes.

[Seventeenth embodiment]

In the conventional vacuum interrupter, the magnetic field generated by the coil parts is not uniform on the entire surface of the main electrode. Namely, the magnetic field in vertical direction generated by the coil parts is distributed in the radial directions. The intensity of the magnetic field is large in the central part and small in the circumferential part. Particularly, if there is a part which does not reach a desired intensity of the magnetic field which is required to diffuse the arc in the circumferential part, concentration of the are in a limited part is liable to be to occur.

The invention of the seventeenth embodiment is directed to prevent the concentration of the arc and to improve the disconnection characteristic by forming the main electrodes so as to generate a uniform magnetic field in the vertical direction on the entire surfaces of the main electrodes.

(Precondition)

Figure 39:
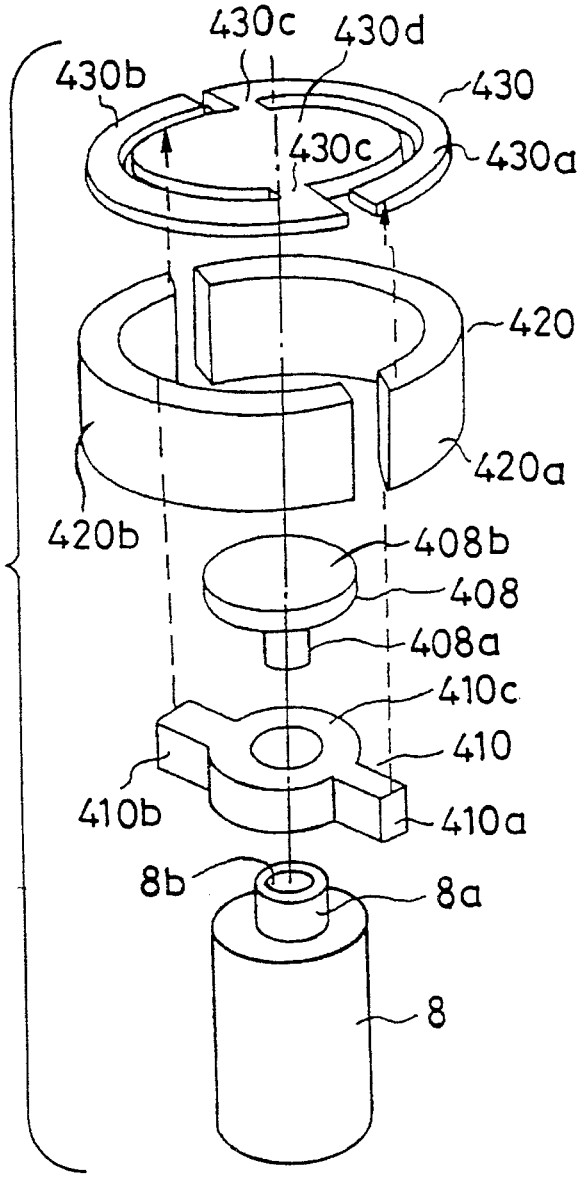
FIG. 39(*a*)is an exploded perspective assembly view of the electrode assembly of the vacuum interrupter in accordance with the present invention.
Figure 39:
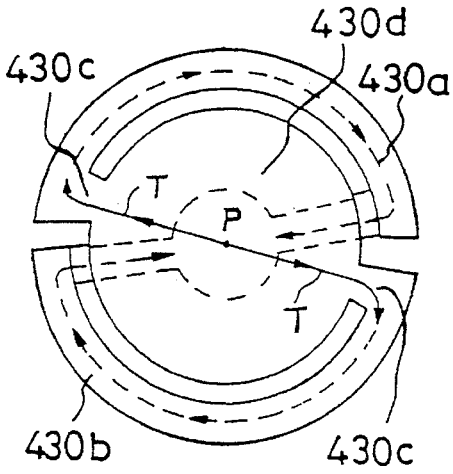

First, FIG. 39(*a*) is an exploded perspective assembly view of the electrode configuration of the vacuum interrupter which is the precondition of the seventeenth embodiment.

Referring to FIG. 39(*a*), an arm-shaped connecting member 410 is put on the boss 8*a* of the electrode rod 8. The arm-shaped connecting member 410 is provided with a ring part 410*c* to be put on the boss 8*a* and arm parts 410*a* and 410*b* extended outward from the circumferential part of the ring part 410*c* in the radial directions.

Moreover, a coil electrode 420 composed of two arc-shaped conductors 420*a* and 420*b* is fixed to the arm-shaped connecting member 410. The arm part 410*a* is connected to an end of the arc-shaped conductor 420*a*, and the arm part 410*b* is connected to an end of the arc-shaped conductor 420*b*, and thereby a coil current flows in the same direction along the circumference. A main electrode 430 is connected to the upper surface (surface opposing to the stationary electrode assembly) of the coil electrode 420, and the upper surface of the arc-shaped conductor 420*a* of the coil electrode 420 contacts The lower surface of the arc-shaped coil part 430*a* of the main electrode 430. Furthermore, the upper surface of the arc-shaped conductor 420*b* contacts the lower surface of the arc-shaped coil part 430*b*. The arc-shaped coil parts 430*a* and 430*b* of the main electrode 430 are communicated to the central part 430*d* of the main electrode 430 through respective connecting parts 430*c*.

Moreover, a shaft 408*a* of the support member 408 is inserted in the support hole 8*b* of the electrode rod 8. A disc-shaped support part 408*b* of the support member 408 supports the central part 430*d* of the main electrode at the lower surface.

In the vacuum interrupter configured as mentioned above, as shown in a plan view of FIG. 39(*b*), in the case that an arc is generated at a point P on the surface of the main electrode in interruption of the current, the current flows from the point P to the central part 430*d* in the radial directions along current paths T, and flows to the coil parts 430*a* and 430*b* through the connecting part 430*c*. Subsequently, most of the current flows to the arc-shaped conductors 420*a* and 420*b* of the coil electrode made of low resistance material which is lower in resistance than the material of the main electrode. Finally, the current flows to the electrode rod 8 through the arm parts 410*a* and 410*b*. Consequently, the magnetic field in the vertical direction (axial direction) is generated by the current flowing the arc-shaped conductors 420*a* and 420*b* of the coil electrode, and thereby the arc voltage across both the electrodes is reduced and concentration of the arc is prevented.

(Suitable range of intensity of the magnetic field)

Figure 40A:
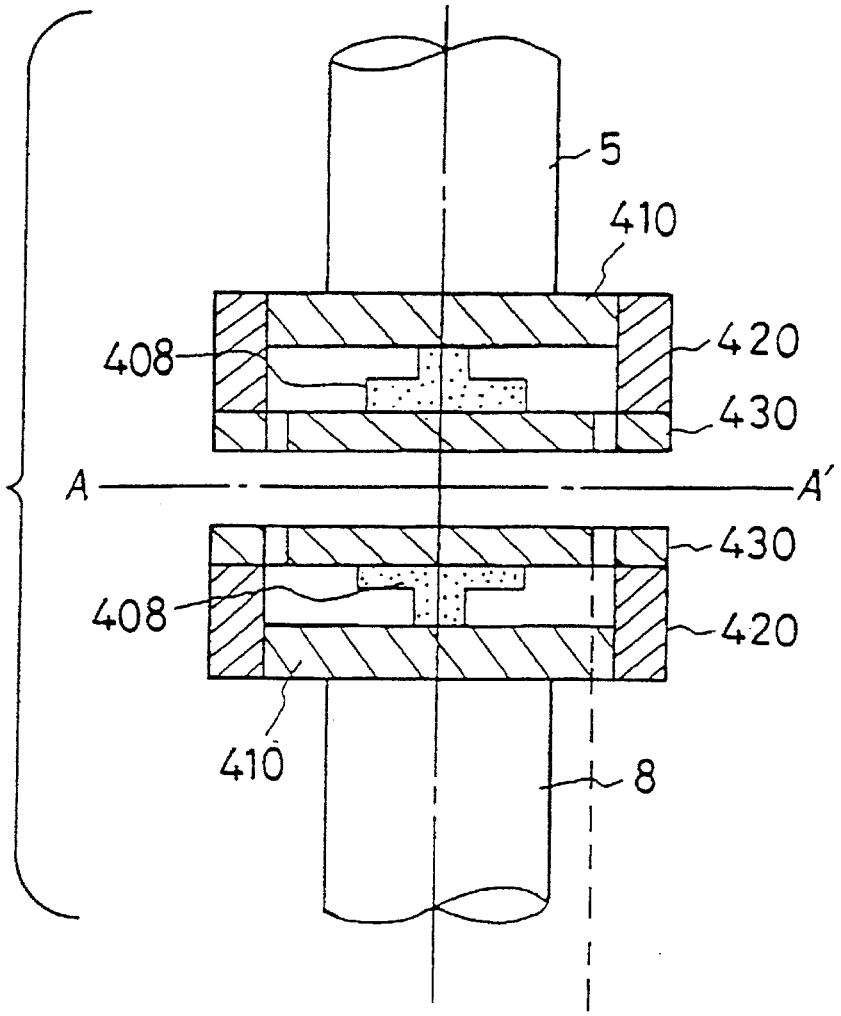
FIG. 40(*a*) is a cross-section of the electrode assemblies including the electrode assembly shown in FIG. 39(*a*)
Figure 40B:
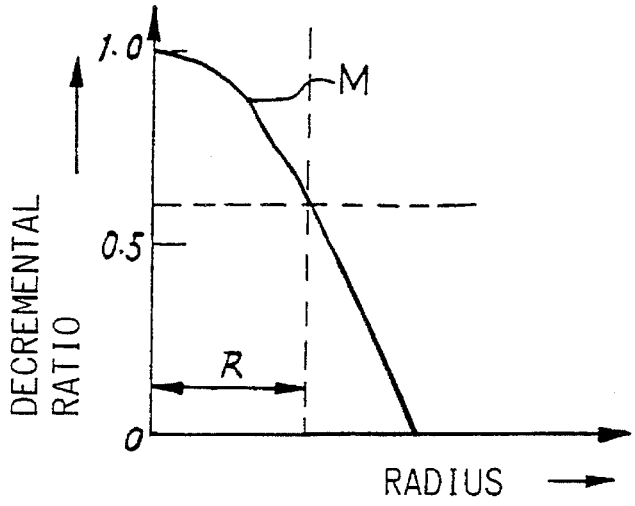

FIG. 40(*a*) is a cross-section of a side view of the vacuum interrupter using the electrodes as shown in FIG. 39(*a*), and FIG. 40(*b*) is a diagram representing the intensity of the magnetic field in the radial direction of the electrodes. Referring to FIG. 40(*b*), the abscissa designates a radius from the center of the electrode, and the ordinate designates a decremental ratio of the intensity of the magnetic field.

As shown in FIG. 40(*b*), the intensity of the magnetic field in the central part generated by the current flowing the coil electrode 420 and the coil parts 430*a* and 430*b* of the main electrode is larger than that of the peripheral part as shown by a curve M in FIG. 40(*b*). The intensity of the magnetic field which is required to diffuse the arc (hereinafter is referred to as suitable magnetic field) is maintained in the range of radius shown by a radius R in FIG. 40(*b*).

In the seventeenth embodiment, the main electrodes which serve as an arc diffusing part are arranged in the range (within the range R) generating the magnetic field which is larger in intensity than the suitable magnetic field.

The range generating the suitable magnetic field is elucidated as to an actual example hereafter. The intensity of the magnetic field in the vertical direction varies mainly by the outer diameter of the electrode, the shape of the coil electrode, the number of winding and the distance between both the electrodes. For example, in the case that the outer diameter of the electrode is 80 mm, and the distance between both the electrodes is 5 mm, the magnetic field in the vertical direction of 54 gauss or more per 1 kA (measured value) is generated in a region D (hatched part) as shown in FIG. 41.

Figure 41:
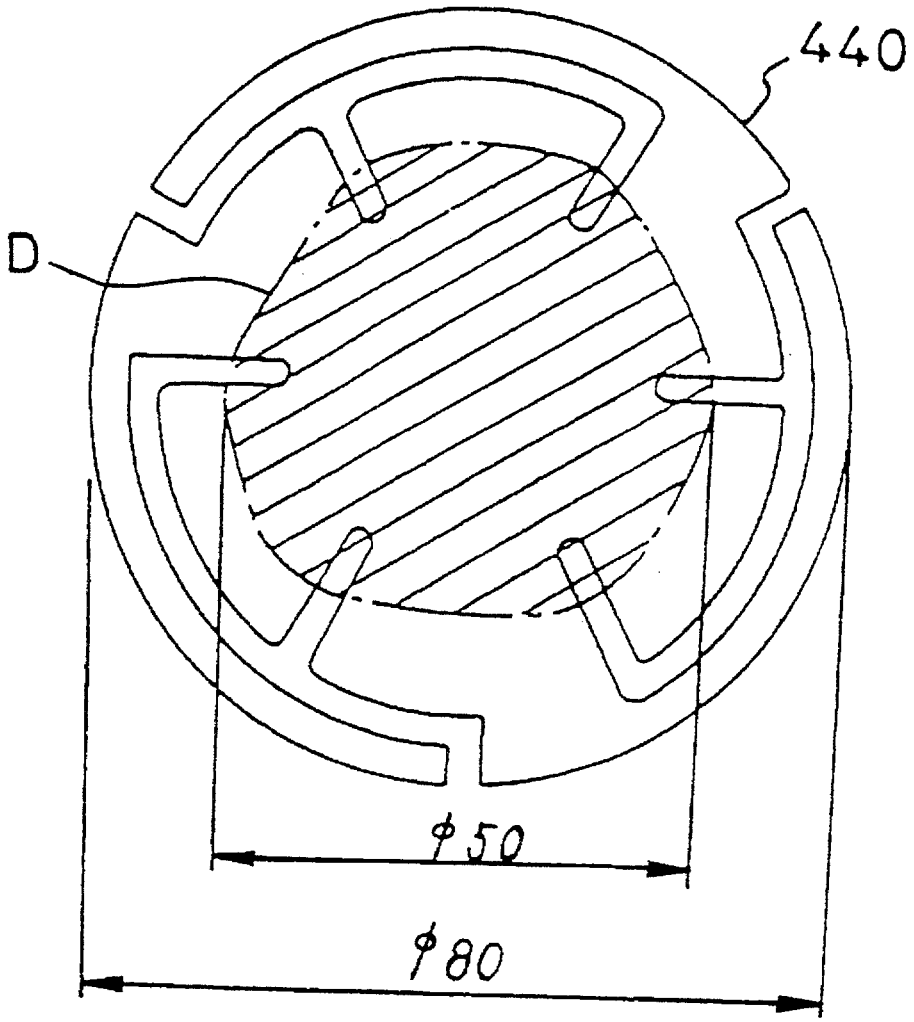
FIG. 41 is a plan view of the electrode representing a region having a suitable intensity of the magnetic field.

Though the suitable magnetic field varies by the material of the main electrodes (contact material), the region D shown in FIG. 41 is a suitable-magnetic-field-region with respect to the contact material which is suitable in the magnetic field exceeding 54 gauss.

(Configuration of the seventeenth embodiment)

Figure 42:
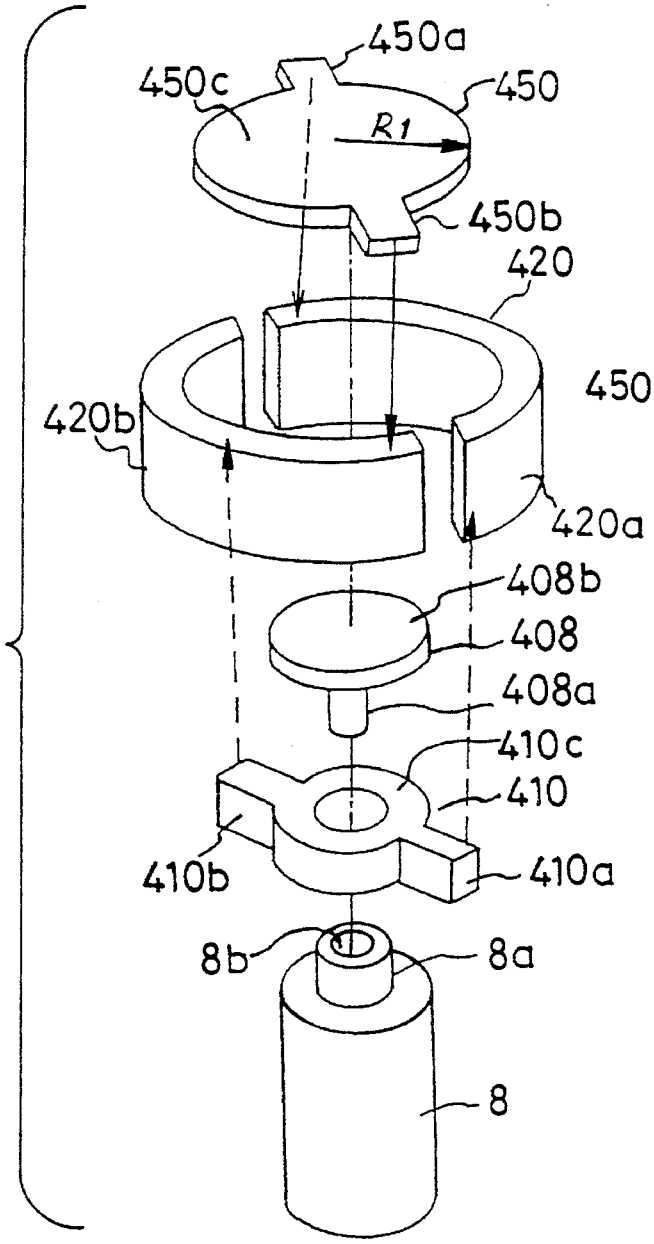
FIG. 42(*a*) is an exploded perspective assembly view of an electrode assembly of the vacuum interrupter in a seventeenth embodiment in accordance with the present invention.
Figure 42:
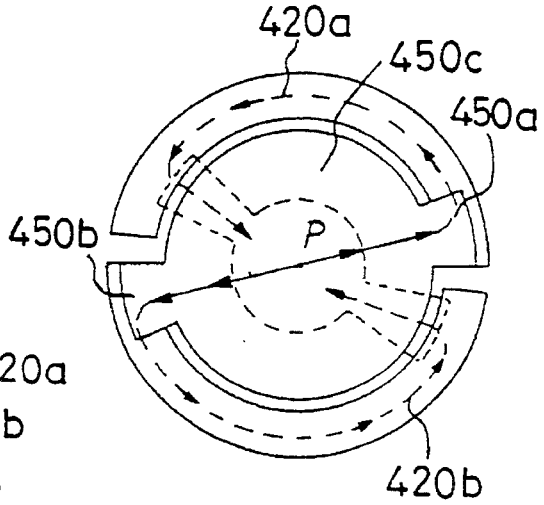

FIG. 42(*a*) is an exploded perspective assembly view of the electrode configuration of the vacuum interrupter, and FIG. 42(*b*) is a plan view of the movable electrode assembly in the seventeenth embodiment.

Referring to FIG. 42(*a*), a main electrode 450 comprises a central part 450*c* which serves as an arc diffusion part and arm parts 450*a* and 450*b* extended outward from the central part 450*c* in the radial direction. Back surfaces (lower surfaces) of the arm parts 450*a* and 450*b* are connected to upper surfaces of the arc-shaped conductors 420*a* and 420*b* of the coil electrode 420. A radius R1 of the central part 450*c* of the main electrode is set within the above-mentioned suitable intensity of magnetic field (within the range represented by a relation $0 \leqq R1 \leqq R$ in FIG. 40(*b*). In the actual example shown in FIG. 41, the radius R1 is set within the range which is equal to or larger than 0 and is equal to or smaller than 25 mm ($0 \leqq R1 \leqq 25$ mm).

According to the seventeenth embodiment, a sufficient intensity of the magnetic field in the vertical direction is held in the central pare 450*c* of the main electrode 450 which serves as the arc diffusion part in order to maintain the arc diffusion in the entire surface. Therefore, concentration of the arc in a limited part in the prior art is prevented and thereby the disconnection characteristic is improved.

The electrode configuration in the above-mentioned seventeenth embodiment is merely an example, the invention of claim 17 is applicable to the vacuum interrupter having general configuration of electrode for generating the magnetic field in the vertical direction, For example, to vacuum interrupters disclosed in the Japanese Patent No. Sho 58-26132 and the Japanese Utility Model No. 62-45401.

[Eighteenth embodiment]

The invention of the eighteenth embodiment is directed to the vacuum interrupter in which a current flowing through a good conductor mounted on the back surface of the main electrode is controlled, and the magnetic field in the axial direction generated by the coil electrodes is effectively utilized. The details are elucidated hereafter.

(Preconditioned technology)

Figure 43:
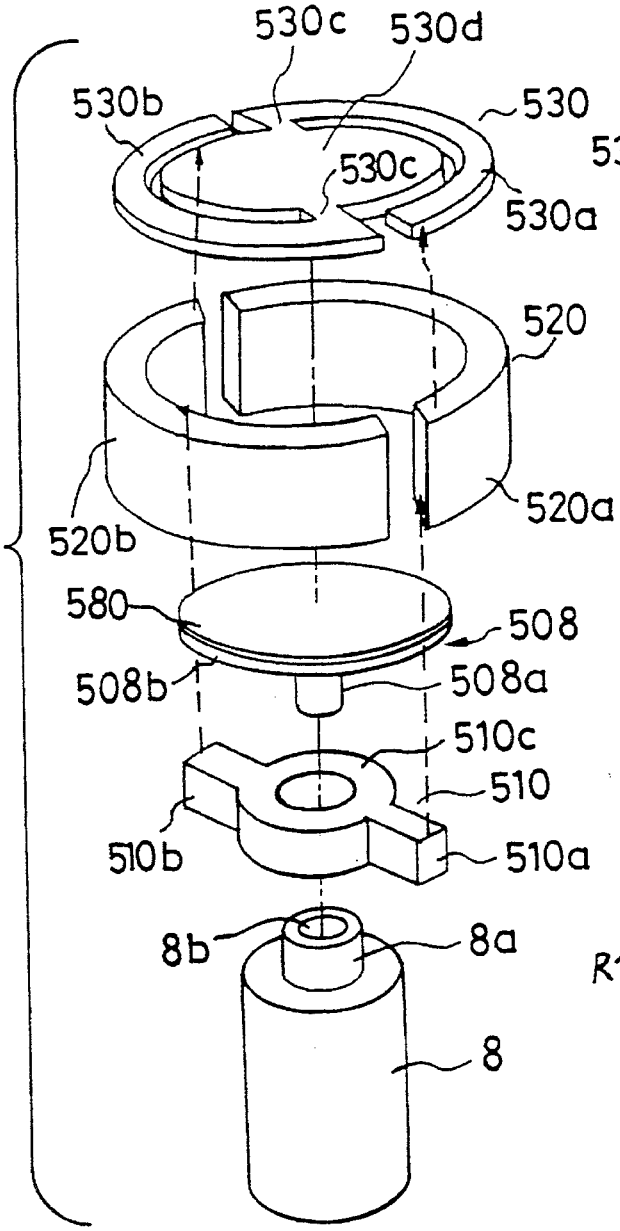
FIG. 43(*a*) is an exploded perspective assembly view of an electrode assembly of the vacuum interrupter in accordance with the present invention.
Figure 43:
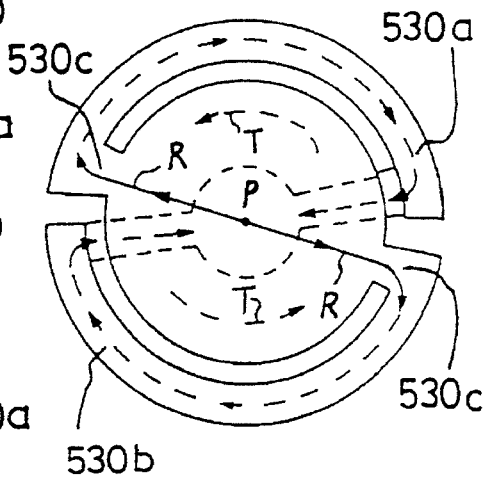
Figure 43:
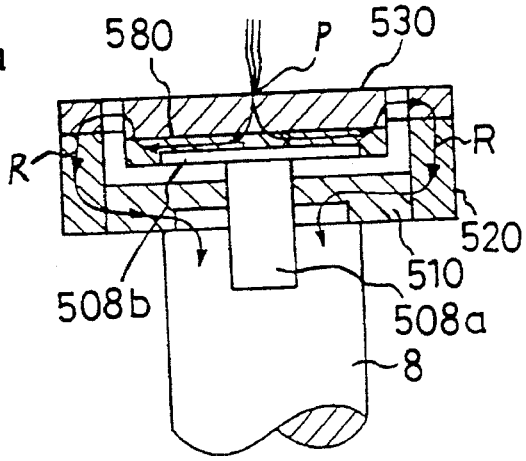

FIG. 43(*a*) is an exploded perspective assembly view of the electrode configuration of the vacuum interrupter which is a precondition of the eighteenth embodiment corresponding to the constitution of claim 18, FIG. 43(*b*) is a plan view of the movable electrode assembly, and FIG. 43(*c*) is a cross-section of the movable electrode assembly.

Referring to FIG. 43(*a*), an arm-shaped connecting member 510 is formed by a ring part 510*c* and arm parts 510*a* and 510*b* extended outward in the radial directions. The connecting member 510 is put on the boss 8*a* of the electrode rod 8 at the ring part 510*c*. A coil electrode 520 comprising two arc-shaped conductors 520*a* and 520*b* is fixed on the connecting member 510.

The arm part 510*a* is connected to an end of the arc-shaped conductor 520*a*, and the other arm part 510*b* is connected to an end of the arc-shaped conductor 520*b*. And thereby a coil current flows on the arc-shaped conductors 510*a* and 510*b* along the same circumference.

A main electrode 530 is connected on the upper surface of the coil electrodes 520 in a manner such that the upper surface of the arc-shaped conductor 520*a* contacts the back surface of an arc-shaped coil part 530*a*, and the upper surface of the arc-shaped conductor 520*b* contacts the back surface of an arc-shaped coil part 530*b*. The arc-shaped coil parts 530*a* and 530*b* of the main electrode 530 are communicated to the central part 530*d* of the main electrode 530 through respective connecting parts 530*c*. The main electrode 530 is made of material which is superior in withstand arc characteristic and withstand voltage characteristic.

A shaft 508*a* of the support member 508 is made of high resistance material, and as shown in FIG. 43(*c*), the shaft 508*a* is inserted in the support hole 8*b* of the electrode rod 8 and is fixed thereby. A good conductor 580 made of copper (Cu), for example, is formed on the upper surface of the disc-shaped support part 508*b* connected to the shaft 508*a* in order to reduce a contact resistance to the main electrode 530.

Operation of the above-mentioned vacuum interrupter is elucidated hereafter.

As shown in FIGS. 43(*b*) and 43(*c*), when the arc is generated at the point P on the surface of the main electrode after disconnection operation of both the main electrodes, the current flows mainly through the main electrode 530 outward in the radial directions from the point P along the current paths R passing through the good conductor 580 of the support member 508 attached the back surface of the main electrode. Subsequently, the current flows in the coil parts 530*a* and 530*b* through the connecting parts 530*c* of the main electrode. Moreover, the current flows through the disc-shaped conductors 520*a* and 520*b* of the main electrode 530, and finally flows in the electrode rod 8 through the arm parts 510*a* and 510*b*. Consequently, the magnetic field in the axial direction is generated by the current flowing the arc-shaped conductors 520*a* and 520*b* along the circumference, and thereby the arc voltage across both the electrodes is reduced and concentration of the arc is prevented.

(Configuration of the eighteenth embodiment)

In the above-mentioned configuration, as shown in FIG. 43(*b*), an eddy current is generated in the good conductor 580 as shown by arrows T with dotted lines. The eddy current serves to weaken the magnetic field in the axial direction generated by the coil electrodes 520. In the eighteenth embodiment, as shown in FIG. 44(*a*), a cross-shaped slit 581 is formed in the good conductor 580 in a manner that the end of the slit 581 does not reach the circumference of the good conductor 580.

The eddy current is interrupted by the slit 581 as shown by an arrow U, and the magnetic field in the axial direction generated by the coil electrodes 520*a* and 520*b* is not weakened, and thereby diffusion of the arc is facilitated.

Figure 44A:
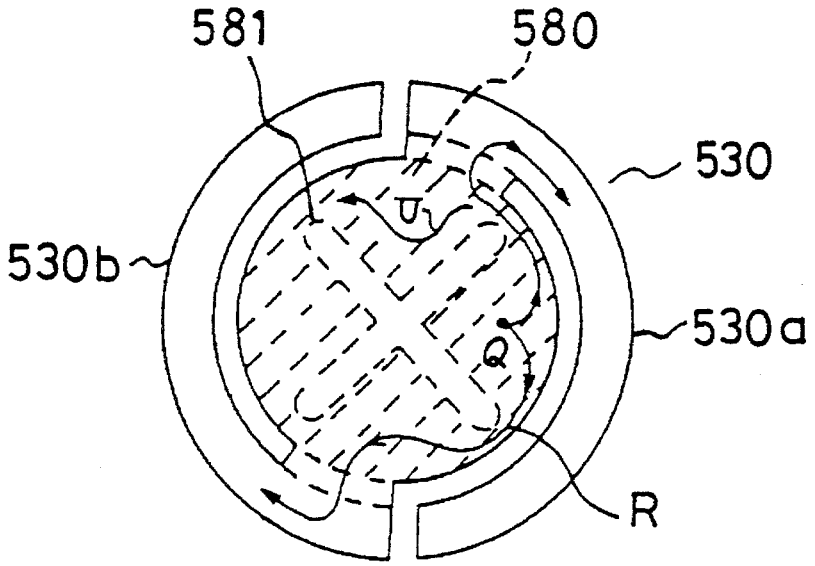
FIG. 44(*a*) is a plan view of an electrode assembly of the vacuum interrupter in an eighteenth embodiment in accordance with the present invention.
Figure 44B:
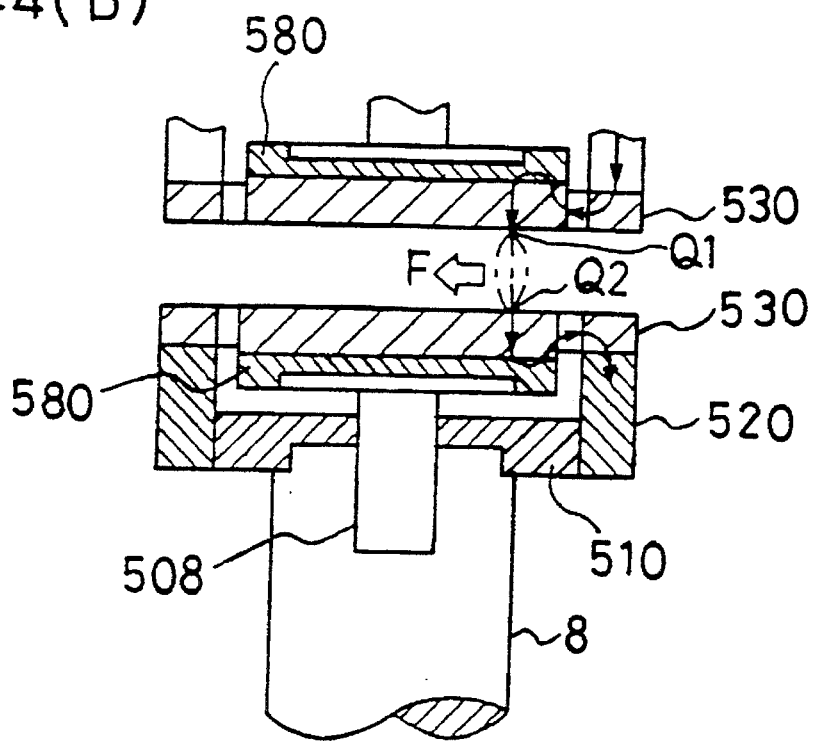

Moreover, as shown in FIG. 44(*a*), when the arc is generated at a point Q in the disconnection operation of the main electrodes, the current flows outward from the point Q in the radial directions along a path R, and flows in the coil parts 530*a* and 530*b* and the coil electrodes 520*a* and 520*b* by passing through the outside of the slit 581.

FIG. 44(*b*) is a cross-section of both the main electrodes 530 illustrating the above-mentioned current path. Referring to FIG. 44(*b*), the current flows from the upper main electrode 530 to the lower main electrode 530 through a point Q1 on the upper main electrode and a point Q2 on the lower main electrode 537 as shown by an arrow. Consequently, a magnetic field which is perpendicular to the paper surface of FIG. 44(*b*) and is directed from behind to before of the paper surface is generated as represented by the known right-handed screw rule. The arc generated between both the point Q1 and Q2 is given a moving force F in the left direction by the known left-hand rule of Fleming. Consequently, the arc is rapidly moved to the center part of the main electrodes and is diffused.

[Nineteenth embodiment]

Figure 45:
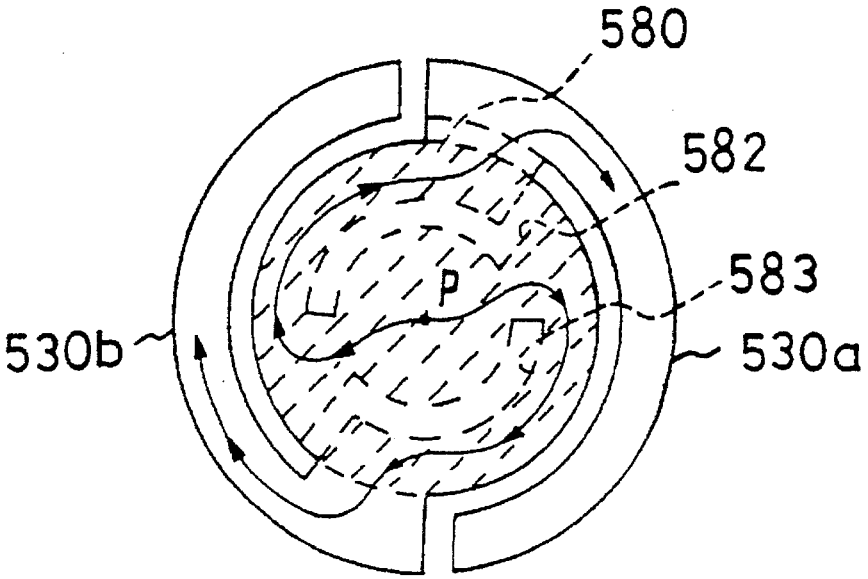
FIG. 45 is a plan view of an electrode assembly of the vacuum interrupter in a nineteenth embodiment in accordance with the present invention.

In the nineteenth embodiment of the vacuum interrupter as shown in a plan view of the electrodes in FIG. 45, slits 582 and 583 are formed in the good conductor 580 on the same circle in order to guide the current to a predetermined path. The slits 582 and 583 are formed by straight slits extended from the circumference to the center part in the radial direction, and arc-shaped slits connected to the inner ends of the straight slits. Consequently, the path the current is flowing through the good conductor 580 is similar to the path of the current along the coil electrodes 520*a* and 520*b*. The magnet field generated by the current flowing the good conductor 580 is added to the magnetic field in the axial direction by the coil parts 530*a* and 530*b* contacting the coil electrodes 520*a* and 520*b*. And thus the magnetic field in the axial direction is enhanced.

[Twentieth embodiment]

Figure 46:
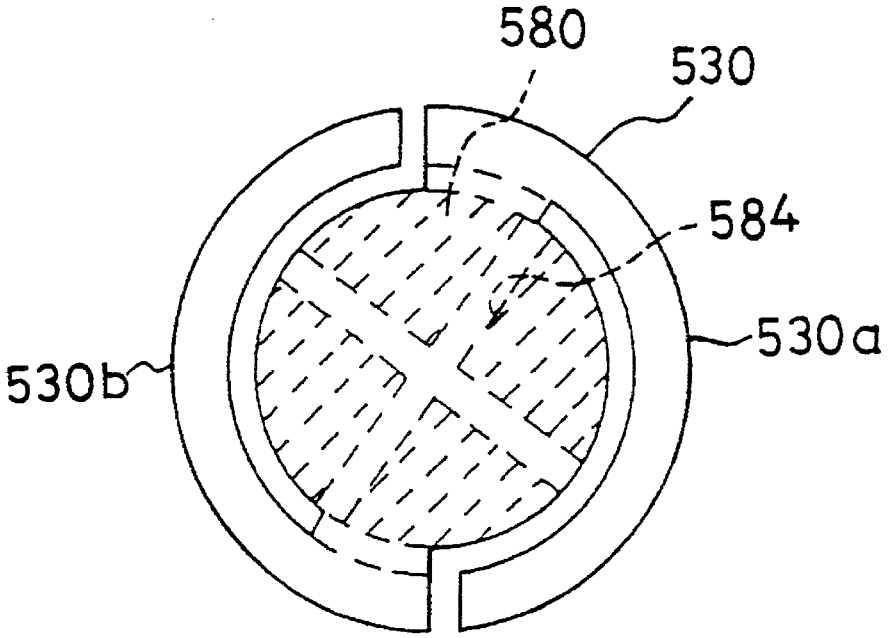
FIG. 46 is a plan view of an electrode assembly of the vacuum interrupter in a twentieth embodiment in accordance with the present invention.

In the twentieth embodiment of the vacuum interrupter as shown in a plan view of the electrode assembly of FIG. 46, the good conductor 580 is divided into four zones by a cross-shaped slit 584 passing through the center of the good conductor 580. Consequently, an eddy current is interrupted, and thereby harmful influence of the eddy current is significantly reduced.

Figure 47:
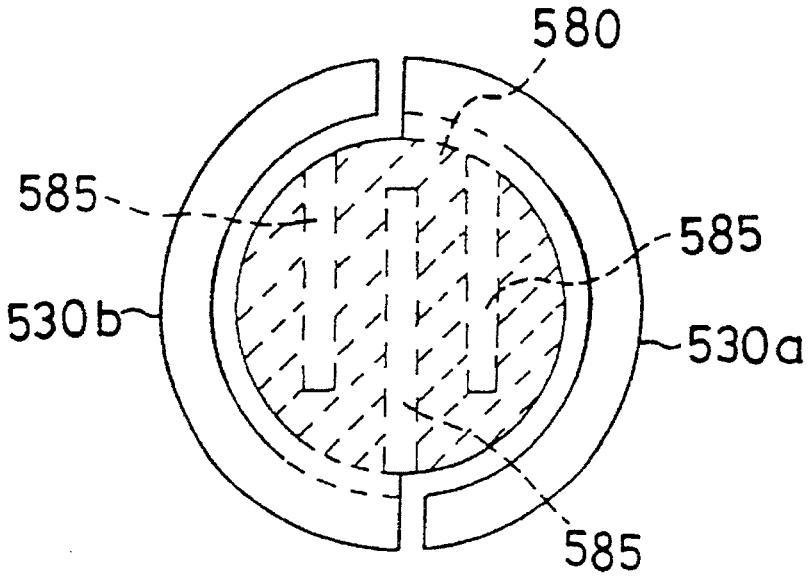
FIG. 47 is a plan view of an example of the electrode assembly of the vacuum interrupter in the twentieth embodiment.

Moreover, as shown in a plan view of the electrode assembly of FIG. 47, plural comb-shaped slits 585 may be formed in the good conductor 580. Each slit 585 is straight-shaped, and one end thereof is alternately terminated before the circumference. The eddy current is interrupted by the plural slits 585 and is reduced.

[Twenty-first embodiment]

Figure 48:
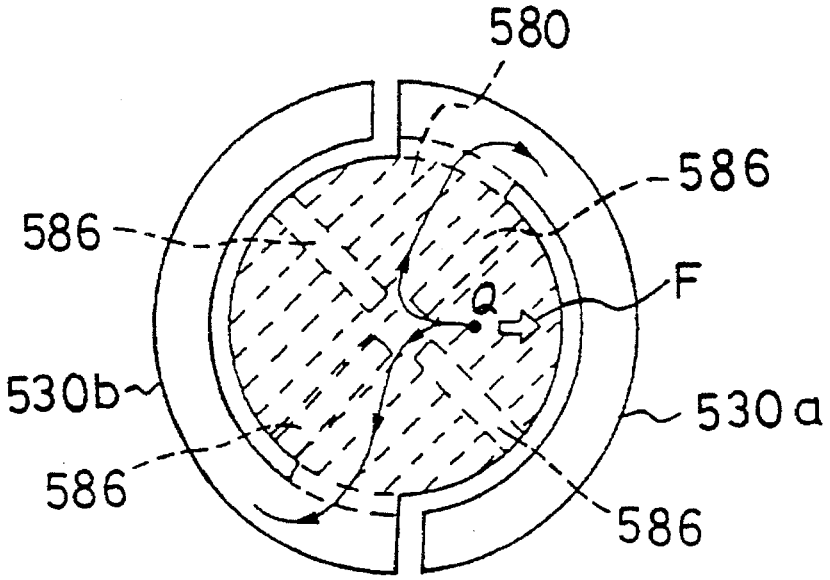
FIG. 48 is a plan view of an electrode assembly of the vacuum interrupter in a twenty-first embodiment in accordance with the present invention.

In the twenty-first embodiment of the vacuum interrupter as shown in a plan view of the electrode assembly of FIG. 48, four separate slits 586 are formed in the good conductor 580. The slits 586 are arranged in the radial directions and one end of each slit 586 is terminated before the center part of the good conductor 580. Consequently, the eddy current is interrupted. When the arc is generated at the point Q in FIG. 48, in the reverse direction to that of the eighteenth embodiment, the current flows outward in the radial direction on the upper electrode, and flows inward in the radial direction on the lower electrode between both the electrodes. Consequently, a magnetic field which is perpendicular to the arc is generated, and the arc is given a moving force in the direction shown by an arrow F. The arc is rapidly moved outward in the radial direction and is diffused.

In the above-mentioned embodiments 18, 19, 20 and 21, the good conductor 580 is formed on the upper surface of the support member 508. The good conductor 580 may be attached on the back surface of the main electrode 530. Moreover, the good conductor 580 may be formed on the electrode in one body.

In the above-mentioned embodiments 18, 19, 20 and 21, though the slits are formed on the good conductor, a high resistance member made of stainless steel, for example, may be formed as replacement for the slit.

Moreover, the number of the coil parts for generating the magnetic field in the axial direction is not limited to two, and one, three, four or plural coil parts may be used. The configuration of the electrodes is applicable to the vacuum interrupter having a general configuration of the electrodes for generating the magnetic field in the axial direction, for example, vacuum interrupters shown in Japanese Patent No. Sho 58-28132 and the Japanese Utility Model Sho 62-45401.

[Twenty-second embodiment]

The twenty second embodiment is directed to the vacuum interrupter of which restrike or reignition of the arc is prevented by preventing generation of a high electric field area on the surface of the main electrode in disconnection operation of both the electrodes, and thereby the withstand voltage characteristic is improved. The details are elucidated hereafter.

(Premise technology)

Figure 49:
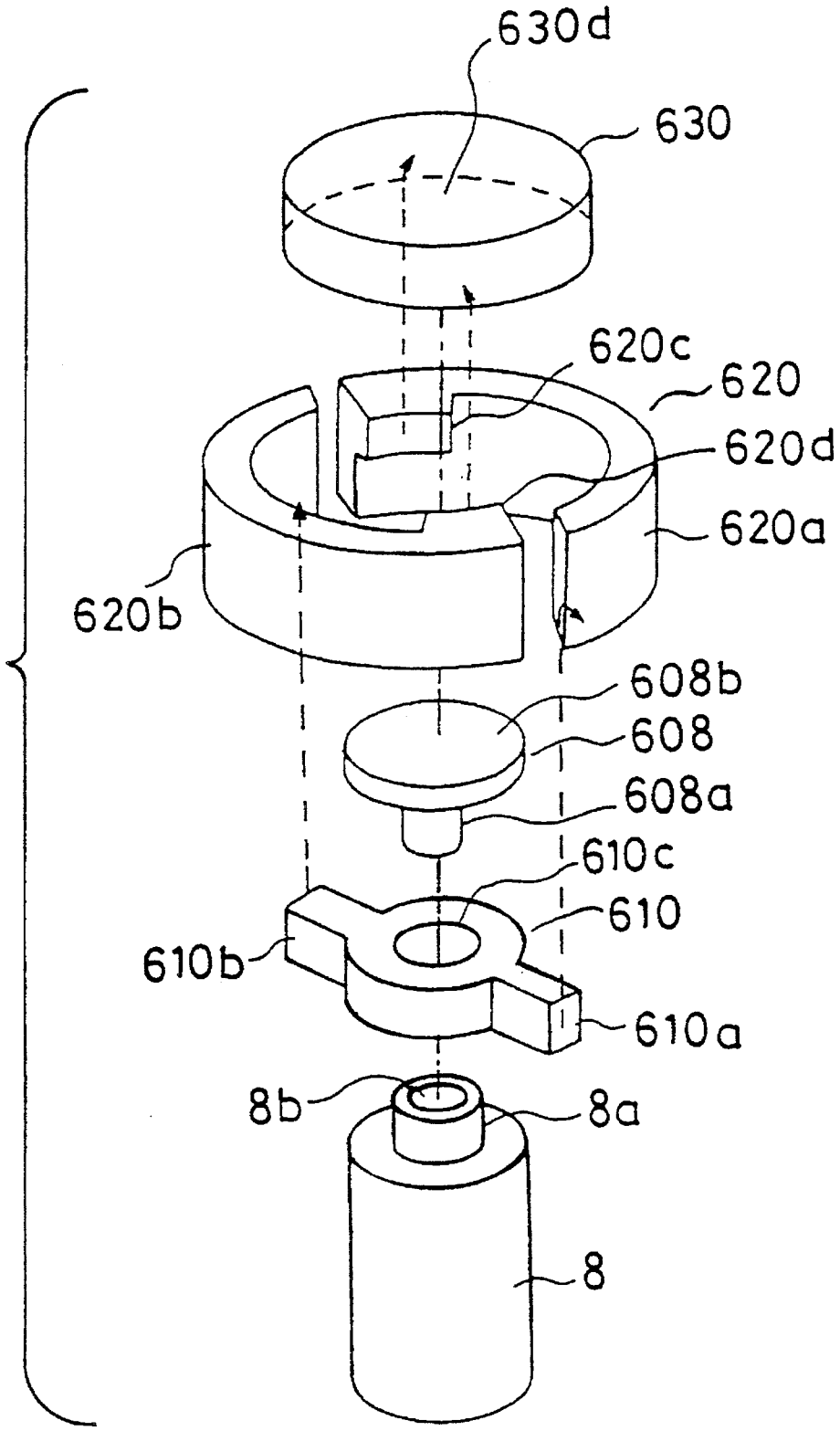
FIG. 49 is an exploded perspective assembly view of an electrode assembly of the vacuum interrupter in the present invention.

FIG. 49 is an exploded perspective assembly view of the electrode configuration of the vacuum interrupter which is a premise technology of the twenty-second embodiment. Referring to FIG. 49, an arm-shaped connecting member 610 has a ring part 610*c* at the center part to be put on the boss 8*a*, and two arm parts 610*a* and 610*b* are extended from the ring part 610*c* in the radial directions.

A coil electrode 620 composed of two arc-shaped conductors 620*a* and 620*b* are fixed on the arm-shaped connecting member 610 in a manner such that the arm part 610*a* is connected to an end of the arc-shaped conductor 620*a* and the arm part 610*b* is connected to an end of the arc-shaped conductor 620*b*. Consequently, a coil current flows along the same circumference.

Moreover, salient connection parts 620*c* and 620*d* are formed on respective inside surfaces of the other ends of the arc-shaped conductors 620*a* and 620*b* of the coil electrode 620 in opposed relationship. A disc-shaped main electrode 630 is connected to the coil electrodes 620 through the connection parts 620*c* and 620*d*.

A shaft 608*a* of a support member 608 is inserted in the support hole 8*b* of the electrode rod 8 and is fixed thereby, and a disc-shaped support part 608*b* supports the back surface of the center part 630*d* of the main electrode 630.

Figure 50A:
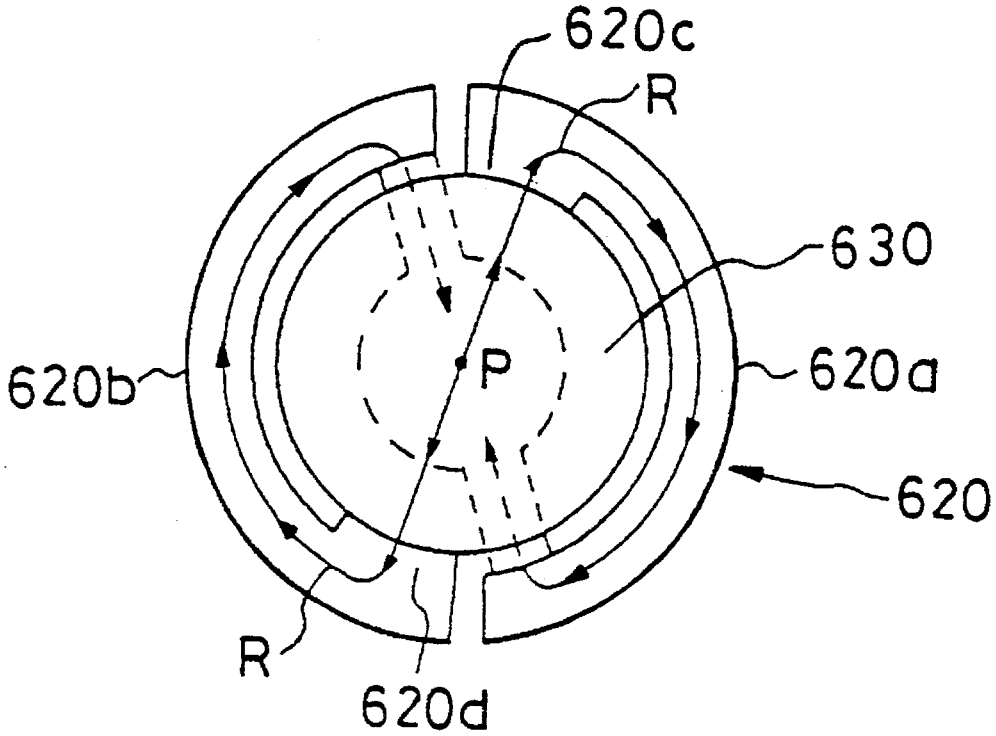
FIG. 50(*a*) is a plan view of the electrode assembly which is used to describe the operation of the electrode assembly.
Figure 50B:
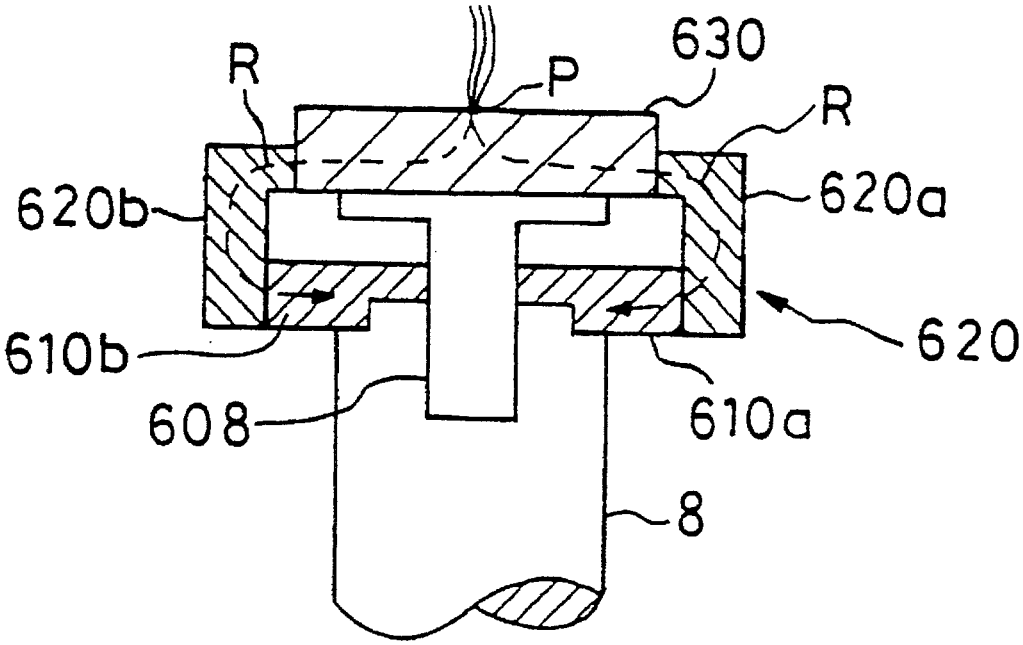

FIG. 50(*a*) is a plan view of the electrode assembly, and FIG. 50(*b*) is a cross-section of the electrode assembly. Referring to FIGS. 50(*a*) and 50(*b*), when the arc is generated at the point P of the surface of the main electrode 630 in disconnection operation, the current flows outward from the point P of the main electrode 630 in the radial directions along current paths R. Subsequently, the current flows to the arc-shaped conductors 620*a* and 620*b* through the connection parts 620*c* and 620*d* of the coil electrode 620. Finally, the current flows in the electrode rod 8 through the arm parts 610*a* and 610*b* connected to the respective ends of the arc-shaped conductors 620*a* and 620*b*.

Consequently, the magnetic field in the radial direction is generated between both the main electrodes arranged in opposed relationship by the current flowing the arc-shaped conductors 620*a* and 620*b* of the coil electrode 620 along the circumference. And thus the arc voltage is reduced and diffusion of the arc is facilitated.

(Deterioration of withstand voltage characteristic)

After the disconnection operation, a high electric potential is generated on an arc-shaped pare of the coil electrode 620 (arc-shaped conductors 620*a* and 620*b* in FIG. 49) and in a gap between an outer edge of the main electrode and an inner edge of the arc-shaped conductors. Therefore, restrike or reignition of the arc is liable to occur, and thereby the withstand voltage characteristic is deteriorated.

The present invention is directed to the vacuum interrupter of which the gap formed by the arc-shaped parts of the coil electrode or the main electrode part is covered by a coil cover, and thereby the restrike of the arc is prevented.

(Configuration of twenty-second embodiment)

Figure 51:
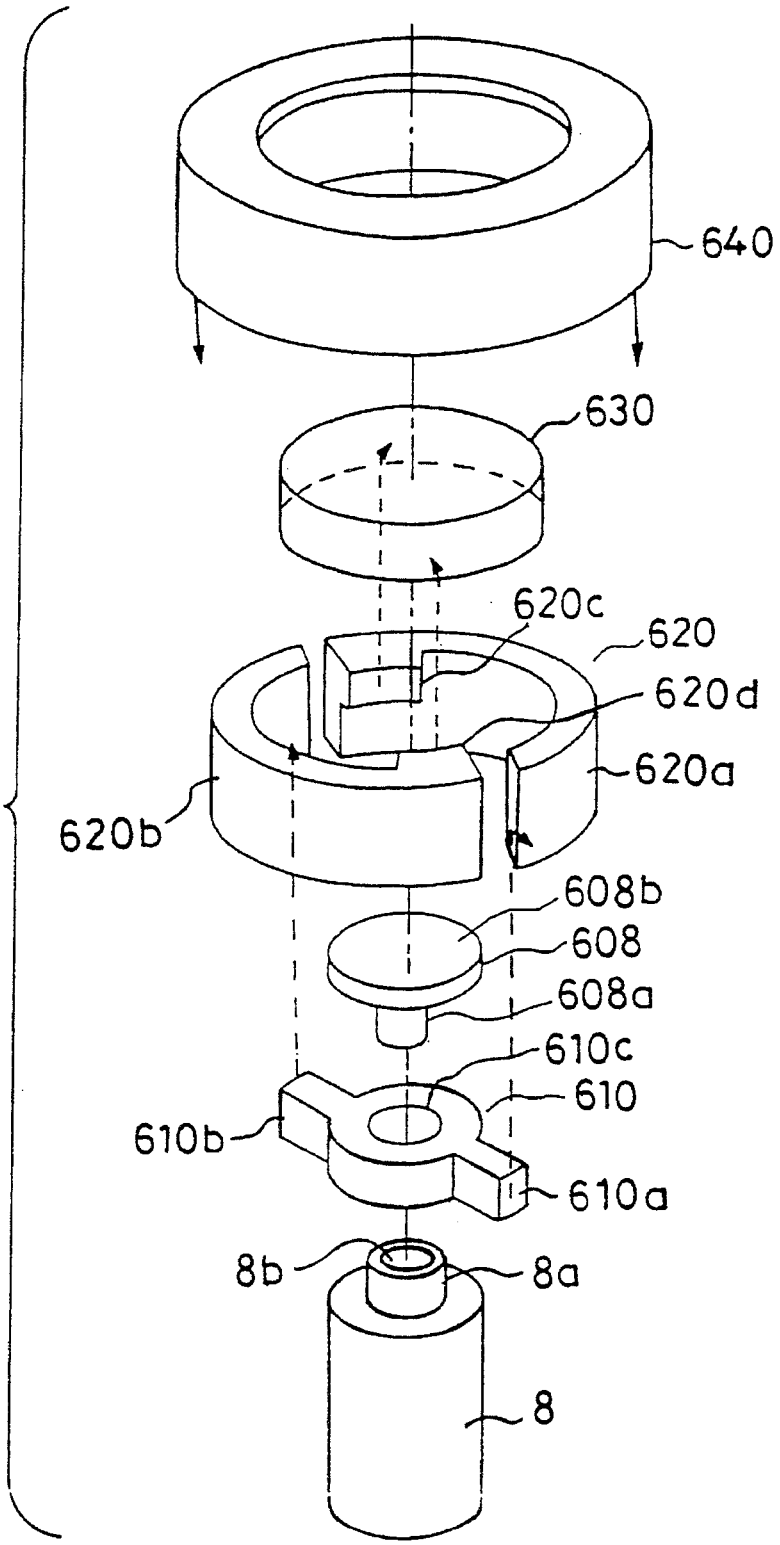
FIG. 51 is an exploded perspective assembly view of an electrode assembly of the vacuum interrupter of twenty-second and twenty-third embodiments in accordance with the present invention.
Figure 52A:
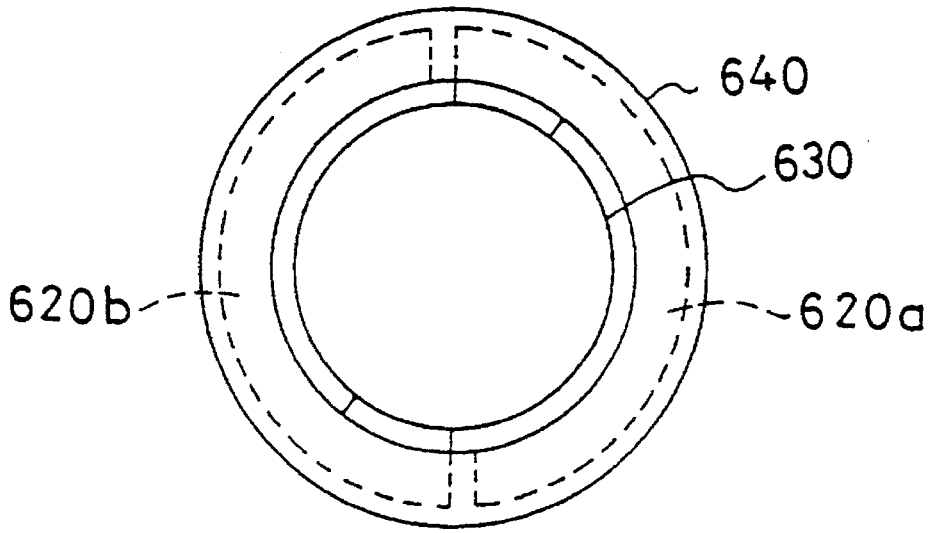
FIG. 52(*a*) is a plan view of the electrode assembly in the twenty-second and twenty-third embodiments.
Figure 52B:
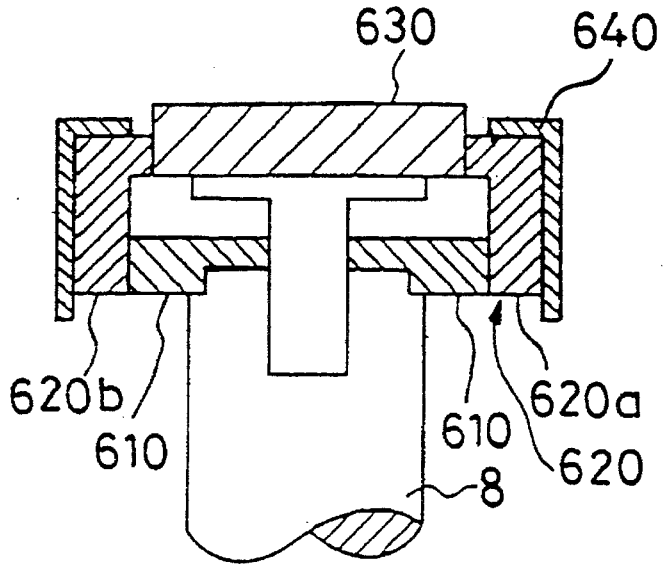

FIG. 51 is an exploded perspective assembly view of the electrode configuration of the vacuum interrupter in accordance with the twenty-second embodiment, FIG. 52(*a*) is a plan view of the electrode, and FIG. 52(*b*) is a cross-section of the electrode assembly. Elements having the same structure and function as the elements in FIGS. 49 and 50 are identified by like numerals and the elucidation is omitted.

A cylindrical coil cover 640 covers the arc-shaped conductors 620*a* and 620*b* of the coil electrode 620 in order not to expose the arc-shaped conductors 620*a* and 620*b* in the direction opposing to the main electrode. The coil cover 640 is made of metal having superior withstand voltage characteristic in comparison with the material of the main electrode 630. For example, since the main electrode 630 is made of oxygen free copper, stainless steel (SUS), alloy of aluminum or alloy of copper is applicable to the material of the coil cover 640.

According to the twenty-second embodiment, the arc-shaped conductor of the coil electrode 620 is protected by covering the arc-shaped conductors 620*a* and 620*b* by the coil cover 640 made of material which is superior in the withstand voltage characteristic than the main electrode material. And thereby the overall withstand voltage characteristic of the electrodes can be improved.

Figure 53A:
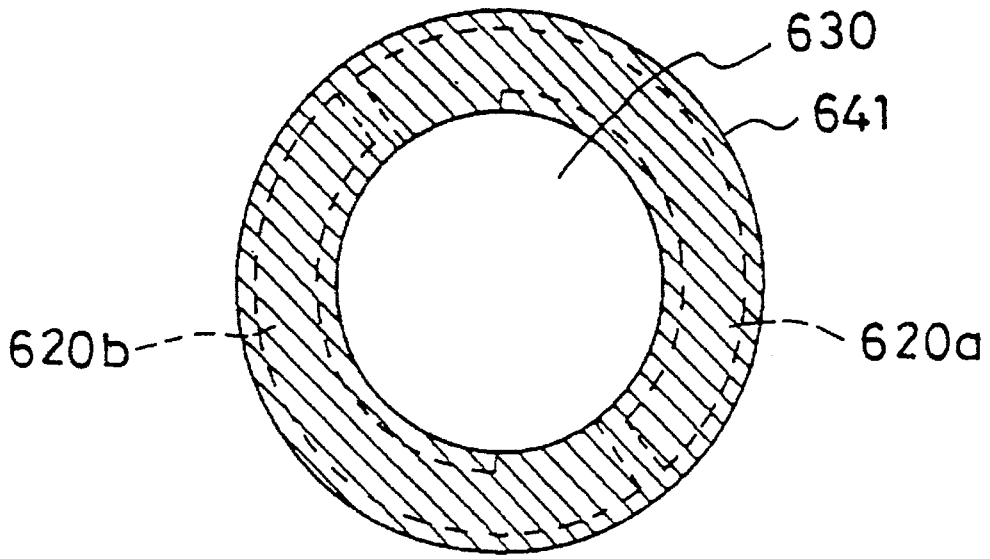
FIG. 53(*a*) is a plan view of another electrode assembly in the twenty-second and twenty-third embodiments.
Figure 53B:
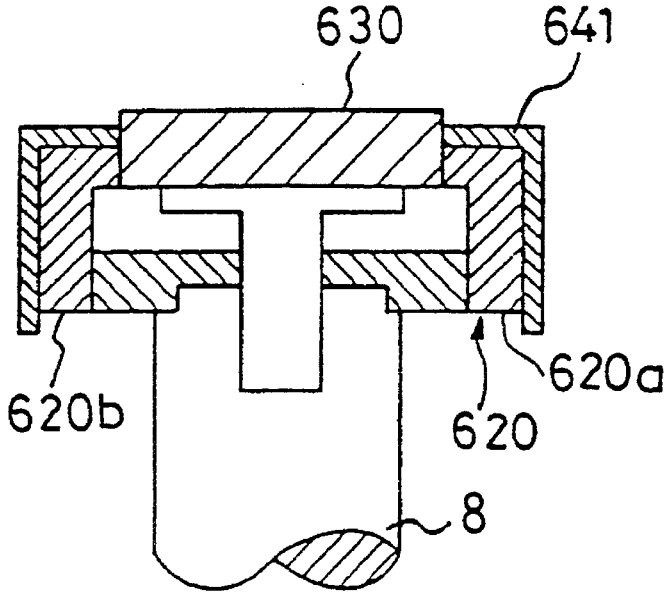

FIG. 53(*a*) is a plan view of the electrode assembly in an example of the twenty-second embodiment, and FIG. 53(*b*) is a cross-section of the electrode assembly. Referring to FIGS. 53(*a*) and 53(*b*), a coil cover 641 covers a gap between the arc-shaped conductors 620*a* and 620*b* of the coil electrode 620 and the main electrode 630. Consequently, the withstand voltage characteristic in the arc-shaped conductor part of the coil and the gap part is improved.

Moreover, a coil cover of a shape which fits the structure of the main electrode may be mounted.

Figure 54:
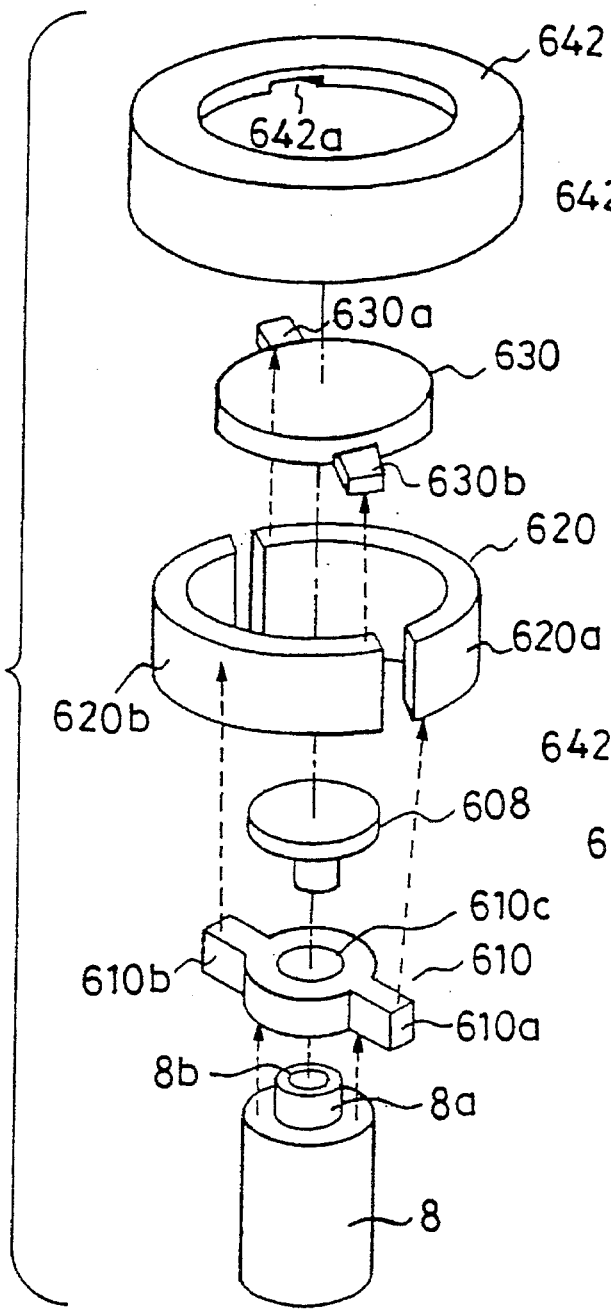
FIG. 54(*a*) is an exploded perspective assembly view of further example of the electrode assembly in the twenty-second and twenty-third embodiments.
Figure 54:
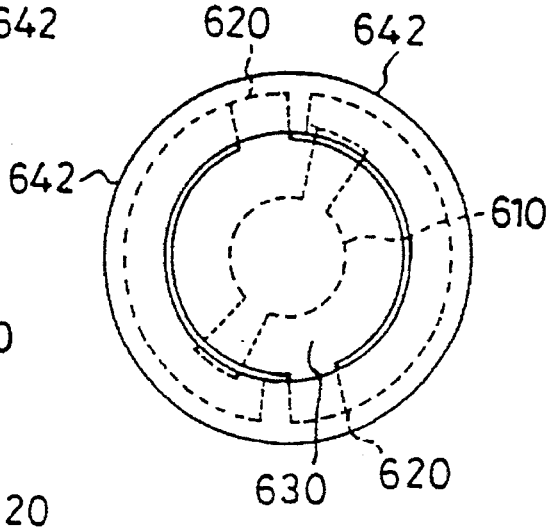
Figure 54:
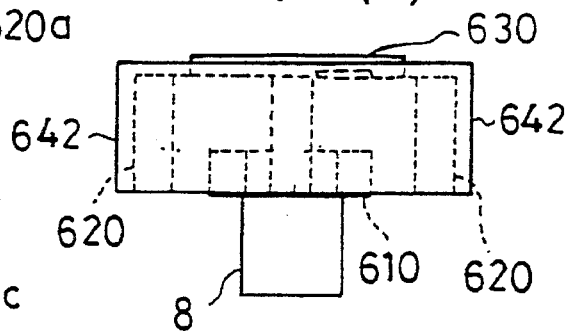

FIG. 54(*a*) is an exploded perspective assembly view of the electrode assembly having a coil cover of another example in the twenty-second embodiment, FIG. 54(*b*) is a plan view of the electrode assembly having the coil cover and FIG. 54(*c*) is a side view of the electrode assembly. Referring to FIGS. 54(*a*), 54(*b*) and 54(*c*), the main electrode 630 is provided with an arm parts 630(*a*) and 630(*b*), and the surface of the main electrode 630 is protruded from the arm parts 630a and 630*b*. Ditches 642*a* are formed on the back surface of the coil cover 642, and the arm parts 630*a* and 630*b* are inserted in the respective ditches 642*a* In assembly. Consequently, gaps in the arc-shaped coil electrode 620 and in the peripheral portion of the main electrode 630 are completely covered by the coil cover 642, and a similar effect to the coil cover shown in FIGS. 53(*a*) and 53(*b*) is realizable.

[Twenty-third embodiment]

In the above-mentioned twenty-second embodiment, though the coil covers 640, 641 and 642 are made of material which is superior in the withstand voltage characteristic than that of the main electrode 630 of the arc diffusion electrode, in the twenty-third embodiment, the coil cover is made of material which is higher in arc voltage than that of the main electrode.

Consequently, generation of the arc in the high electric potential is prevented by covering the arc-shaped part of the coil electrode or the gap part in a manner similar to the Twenty-second embodiment shown in FIGS. 51, 52(*a*), 52(*b*), 53(*a*), 53(*b*), 54(*a*), 54(*b*) and 54(*c*). And the withstand voltage characteristic of the electrode is improved.

As to combination of materials for a coil cover which is higher in the arc voltage than the main electrode 630 (arc diffusion electrode), in the case that the main electrode is made of alloy of a type of "AgWC", the coil cover is made of "Cu" alloy. In the case that the main electrode is made of alloy of a type of "CuCr", the coil cover is made of "Mo" or the like.

In the above-mentioned embodiments 22 and 23, the diameter of the main electrode 630 is smaller than that of the coil electrode 620. Even if the diameter of the main electrode is substantially equal to the diameter of the coil electrode as in a vacuum interrupter shown in the Japanese Patent Sho 58-26132 and the Japanese Utility Model Sho 62-45401, a similar effect is realizable.

[Twenty-fourth embodiment]

Figure 55:
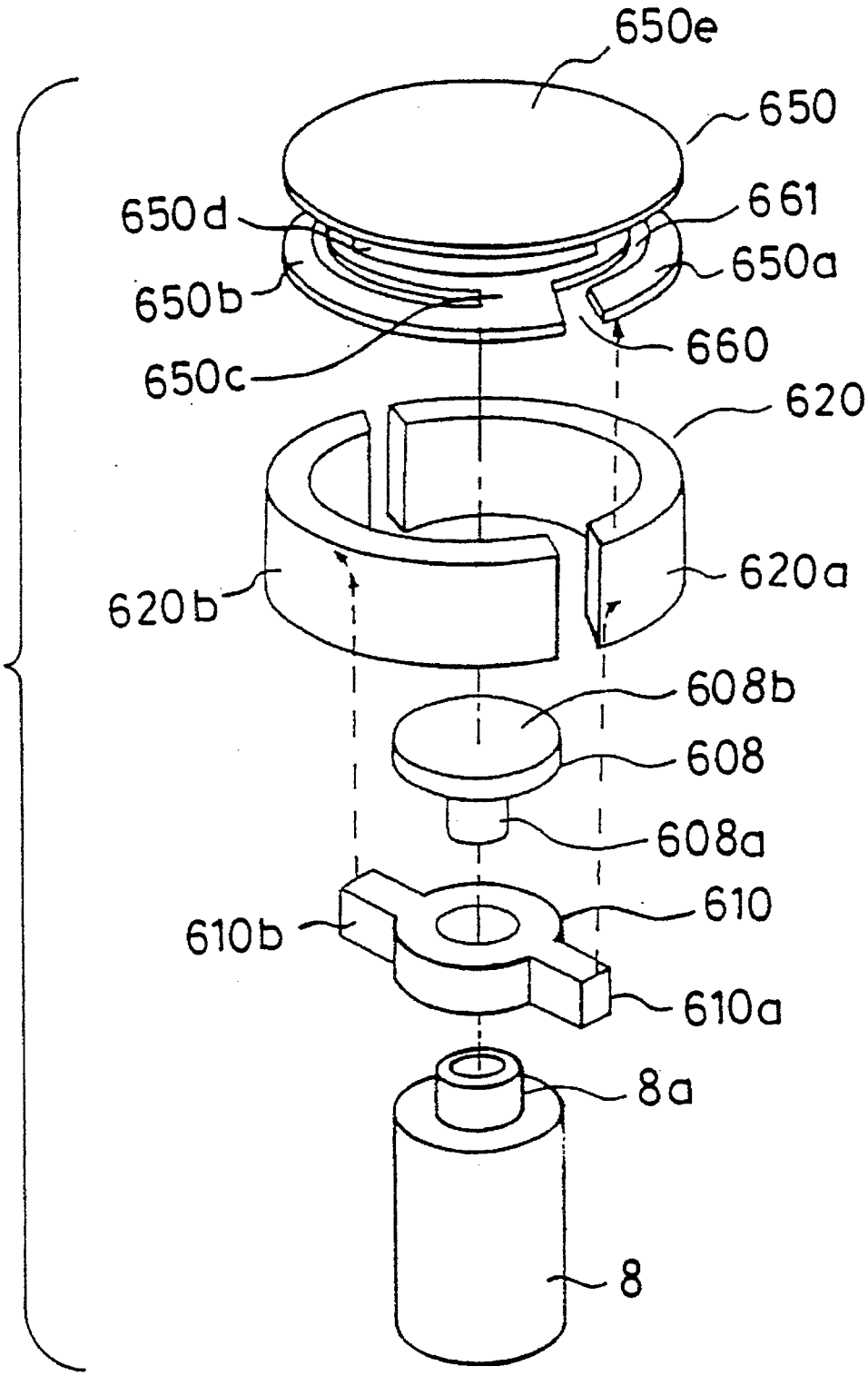
FIG. 55 is an exploded perspective assembly view of an electrode assembly of a twenty-fourth embodiment in accordance with the present invention.

In the twenty-fourth embodiment of the vacuum interrupter as shown in FIG. 55, a main electrode 650 is composed of two disc-shaped members superimposed in the same axis. Slits 660 in the radial directions and slits 661 along the circumference are formed on the lower disc-shaped member in order to form arc-shaped coil parts 650*a* and 650*b* which correspond to arc-shaped conductors 620*a* and 620*b* of the coil electrode 620. The upper disc-shaped member is connected to the lower disc-shaped member by a neck part 650*d* (central part), and the upper disc-shaped part 650*e* serves as the arc diffusion electrode.

According to the twenty-fourth embodiment, the slit 660, the slit 661 and the arc-shaped parts 620*a* and 620*b* of the coil electrode 620 are covered by the disc-shaped part 650*e* of the arc diffusion electrode and are not exposed outside. Therefore, a high potential electric field does not arise in the area, and the withstand voltage characteristic is improved.

[Twenty-fifth embodiment]

Figure 56A:
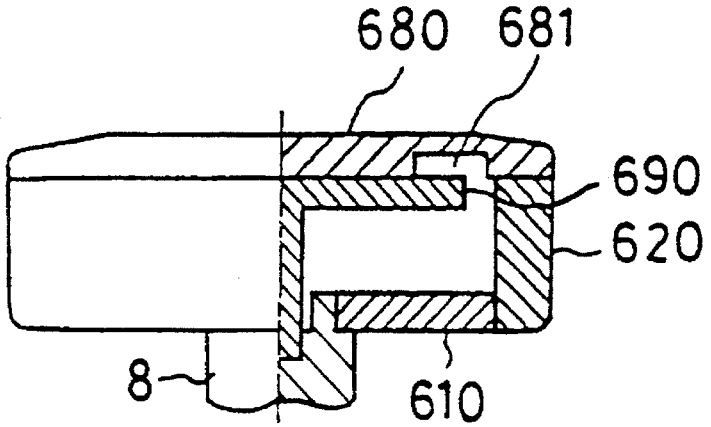
FIG. 56(*a*) is a fragmentary cross-sectional view of an electrode assembly of a twenty-fifth embodiment in accordance with the present invention.
Figure 56B:
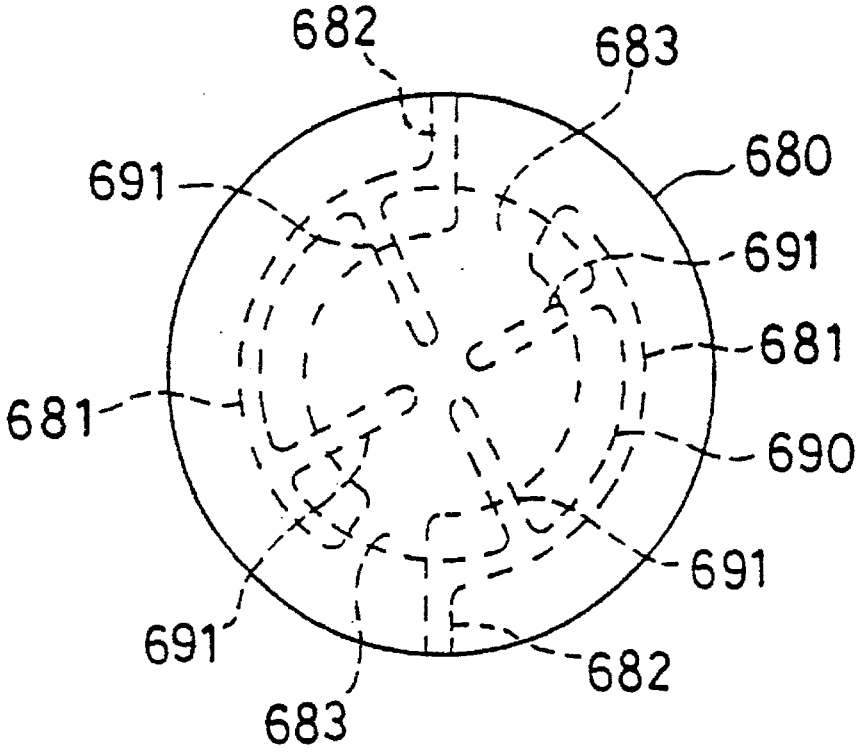
Figure 56C:
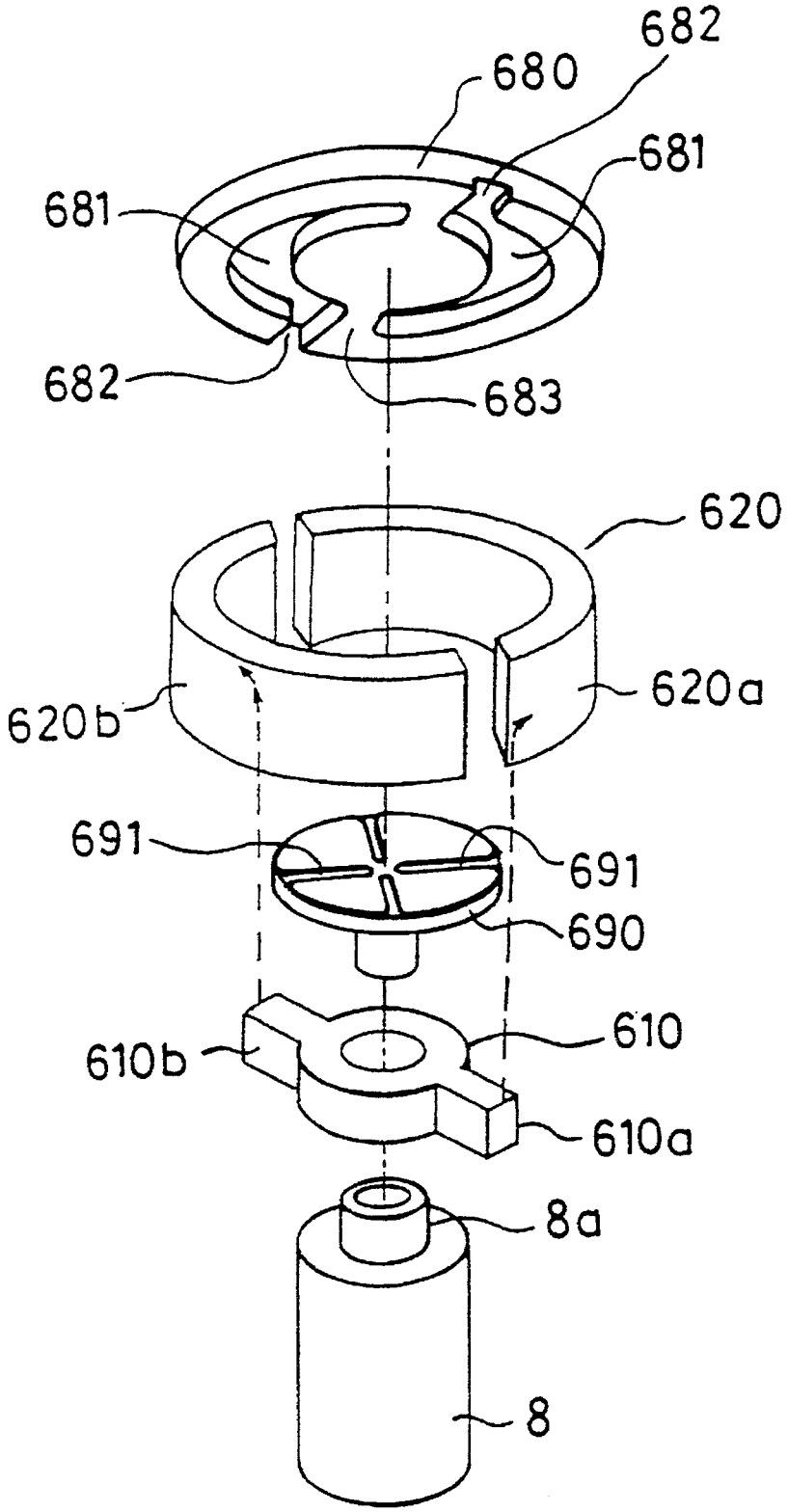
Figure 57:
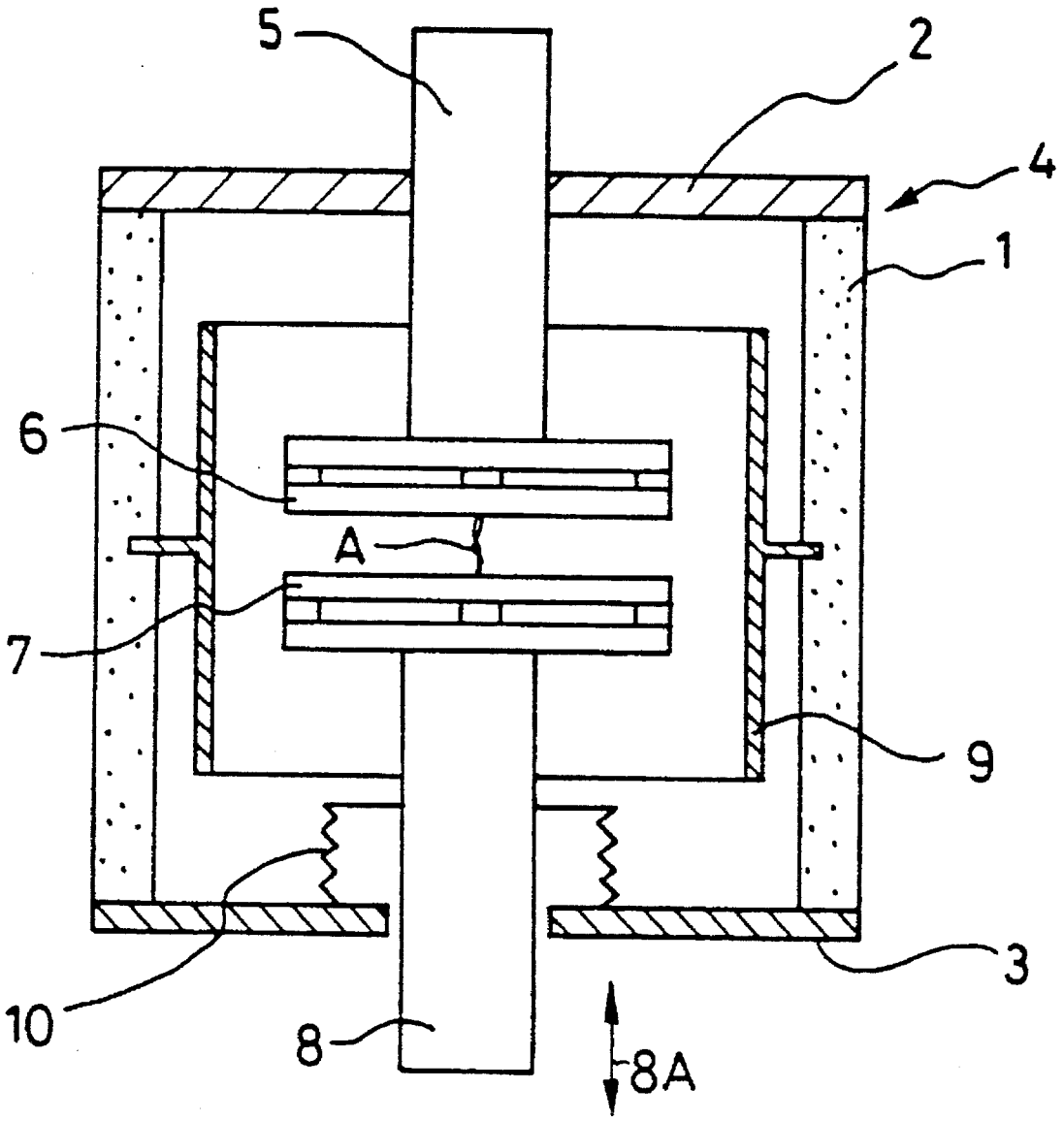
FIG. 57 (Prior Art)
FIG. 57 is the cross-section of the vacuum interrupter of the prior art.
Figure 58:
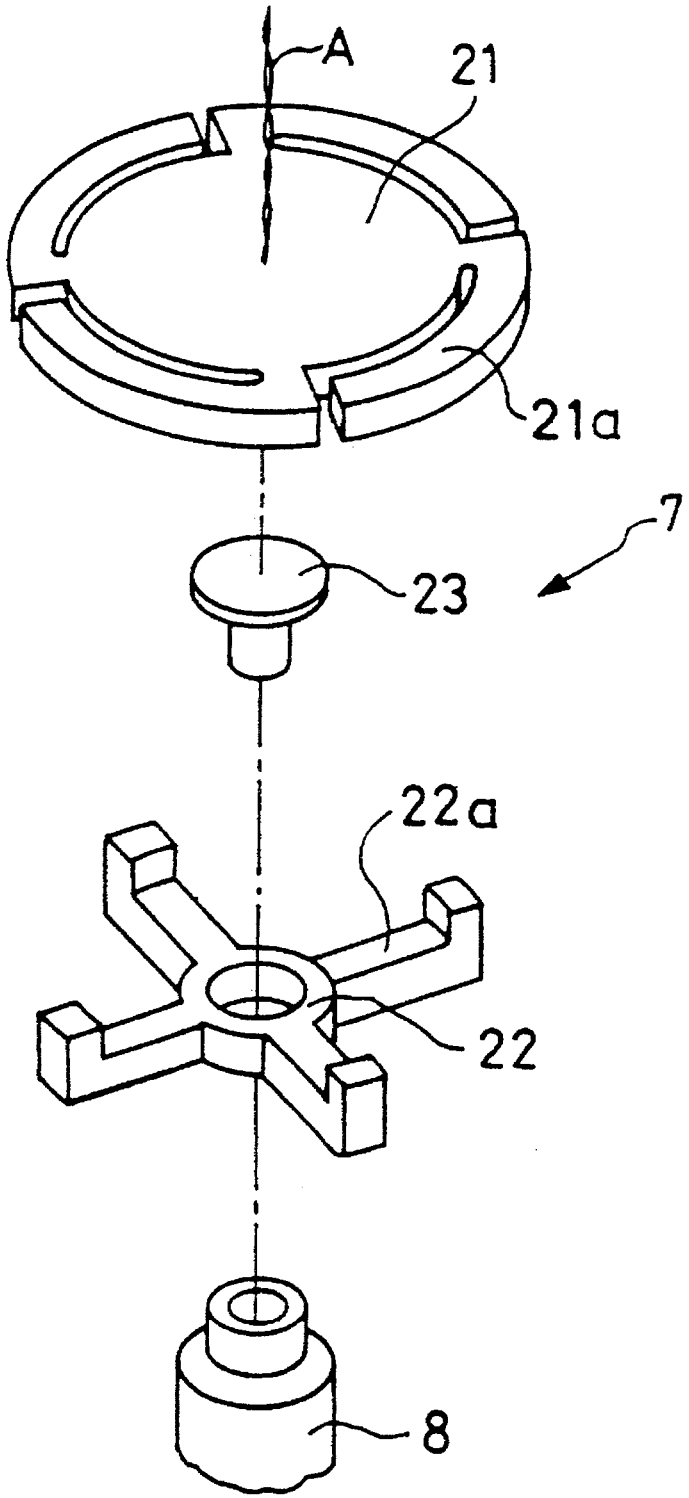
FIG. 58 (Prior Art)
FIG. 58 is the exploded perspective assembly view of the movable electrode assembly of the vacuum interrupter of the prior art.
Figure 59:
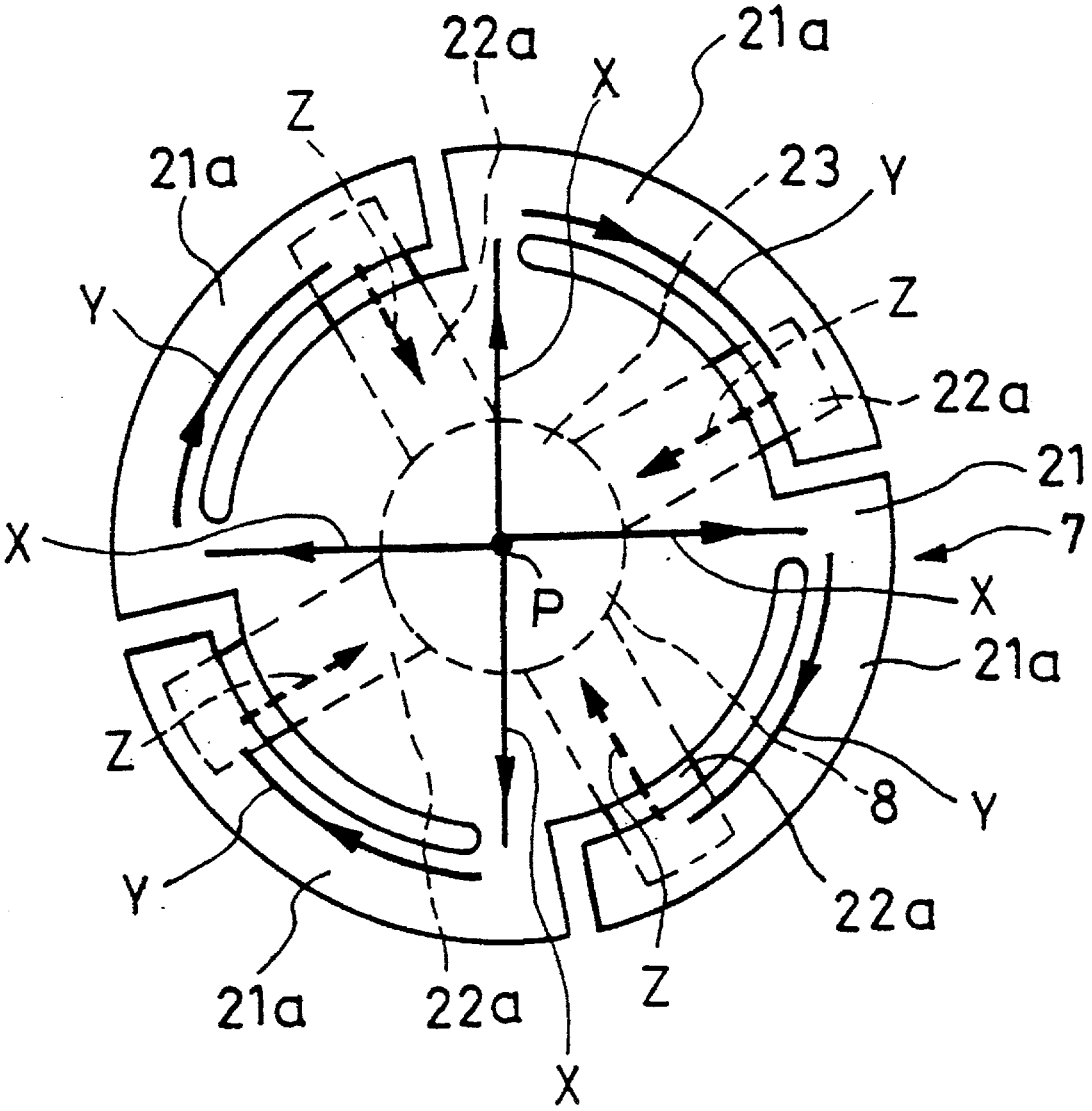
FIG. 59 (Prior Art)
FIG. 59 is the plan view of the movable electrode of the vacuum interrupter shown in FIG. 58.

In the twenty-fifth embodiment of the vacuum interrupter FIG. 56(*a*) is a cross-section of an electrode assembly, FIG. 56(*b*) is a plan view of the electrode assembly and FIG. 56(*c*) is an exploded perspective assembly view of the electrode assembly. Ditches 681 along the circumference and ditches 682 in the radial directions are formed on the back surface of the main electrode 680. In the exploded perspective assembly view of FIG. 56(*c*), the back surface of the main electrode 680 is shown. A conductor plate 690 is attached to the back surface of the main electrode 680. High resistance members 691 (for example slits) are formed on the surface of the conductor plate 690 in the radial directions in order to compensate the magnetic field in the axial direction. The diameter of the conductor plate 690 is larger than the inner diameter of the ditch 681 and is smaller than the outer diameter of the ditch 681.

According to the twenty-fifth embodiment, since the ditches 681 and 682 of the main electrode 680 are not exposed on the surface of the arc diffusion electrode, the withstand voltage characteristic of the electrode is improved.

Incidentally, the ditch 681 may be formed by filling with a high resistance member. In the twenty-fifth embodiment, the most current from the central part of the main electrode 680 to the coil electrode 620 flows the arm parts 683 formed between both the slits 681 and 682, and successively flows along the circumference of the coil electrode 620. Consequently, the current serves to enhance the magnetic field in the axial direction.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A vacuum interrupter comprising:

each electrode assembly of a pair of electrode assemblies having substantially the same structure and arranged in an evacuated envelope in opposed relationship adapted to be connected with or disconnected from each other comprising:

a coil electrode having a plurality of arms extending outwardly from a center ring shaped holding part and a plurality of arc-shaped coil parts formed substantially along the same circumference of said coil electrode and connected to respective ones of said arms, a main electrode comprising:

an arc-shaped arm electrically connected to each arc-shaped coil part of said coil electrode, said coil parts being in contact with corresponding ones of said arc-shaped arms along entire surfaces thereof, and a first arm connected to each of said arc-shaped arms of said main electrode and extended substantially toward a center of said main electrode in the radial direction, and said first arms of one of electrode assemblies being arranged in substantially the same direction as the direction of first arms in the other electrode assembly arranged in opposed relationship to said electrode assembly.

2. A vacuum interrupter in accordance with claim 1, wherein said first arms of said main electrode are bent, said pair of electrode assemblies is arranged in point symmetry, and a current path flowing the bent arm of one of said electrode assemblies is arranged in opposed relationship to a current path flowing the bent arm of the other electrode assembly and is extended substantially in the same direction.

3. A vacuum interrupter comprising:

each of a pair of electrode assemblies having the same structure and arranged in an evacuated envelope in opposed relationship adapted to be connected with or disconnected from each other comprising;

a coil electrode having a plurality of arms extending in a radial direction from a ring shaped holding part of said coil electrode, a plurality of arc-shaped coil parts formed substantially on the same circle and connected to respective ones of said plurality of arms, and a connection part which protrudes toward the opposed electrode assembly at the end of said each coil part, and a solid disc-shaped main electrode mechanically and electrically connecting each connection part of said coil electrode in the vicinity of the circumference, and the connection parts of one electrode assembly being assembled so as to be aligned with the connection parts of the other electrode assembly arranged in opposed relationship with said one electrode assembly.

* * * * *